US010680353B2

(12) United States Patent
Murugiah et al.

(10) Patent No.: US 10,680,353 B2
(45) Date of Patent: Jun. 9, 2020

(54) WEDGE CONNECTOR ASSEMBLIES AND METHODS AND CONNECTIONS INCLUDING SAME

(71) Applicants: TE Connectivity Services GmbH, Schaffhausen (CH); Tyco Electronics Canada ULC, Markham (CA)

(72) Inventors: Sachidanandan Murugiah, Stouffville (CA); Sarzil Rahman, Scarborough (CA); Barry James Johnson, Vaughan (CA); Steven Mitchell, Thompsons Station, TN (US); Jonathan Guppy, Ajax (CA)

(73) Assignees: TE CONNECTIVITY SERVICES GMBH, Schaffhausen (CH); TYCO ELECTRONICS CANADA ULC, Markham (CA)

( * ) Notice: Subject to any disclaimer, the term of this patent is extended or adjusted under 35 U.S.C. 154(b) by 0 days.

(21) Appl. No.: 16/674,146

(22) Filed: Nov. 5, 2019

(65) Prior Publication Data

US 2020/0076094 A1 Mar. 5, 2020

Related U.S. Application Data

(63) Continuation-in-part of application No. 15/961,422, filed on Apr. 24, 2018, now Pat. No. 10,594,054.
(Continued)

(51) Int. Cl.
*H01R 4/50* (2006.01)

(52) U.S. Cl.
CPC ..... *H01R 4/5091* (2013.01)

(58) Field of Classification Search
CPC ..... H01R 4/5083; H01R 4/5091; H01R 4/50
See application file for complete search history.

(56) References Cited

U.S. PATENT DOCUMENTS 3,275,974 A * 9/1966 Mixon, Jr. ..... H01R 4/50 439/783
3,290,746 A 12/1966 Broske
(Continued)

FOREIGN PATENT DOCUMENTS

CA 2334187 A1 8/2002
CN 2634667 Y 8/2004
(Continued)

OTHER PUBLICATIONS

Shear-Lok Grounding Connector data sheet, TE Connectivity (2 pages) (2014).
(Continued)

*Primary Examiner* — Briggitte R. Hammond
(74) *Attorney, Agent, or Firm* — Myers Bigel, P.A.

(57) ABSTRACT

A wedge connector system for connecting first and second elongate electrical conductors includes a C-shaped sleeve member, a wedge member and a locking mechanism. The sleeve member defines a sleeve cavity and opposed first and second sleeve channels on either side of the sleeve cavity. The wedge member includes a wedge body having first and second opposed wedge side walls. The locking mechanism includes a lock member including a sleeve engagement portion, and a clamping mechanism coupled to the wedge member. The sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall. The locking mechanism is mountable on the sleeve member and the wedge member such that the sleeve engagement portion interlocks with the sleeve member and the clamping mechanism can be operated to force the wedge
(Continued)

member into the sleeve cavity to apply clamping loads on the first and second conductors.

23 Claims, 55 Drawing Sheets

Related U.S. Application Data

(60) Provisional application No. 62/503,695, filed on May 9, 2017, provisional application No. 62/760,401, filed on Nov. 13, 2018.

(56) References Cited

U.S. PATENT DOCUMENTS 3,345,454 A 10/1967 Mixon, Jr.
3,515,794 A 6/1970 Beinhaur et al.
3,681,512 A 8/1972 Werner et al.
3,742,582 A 7/1973 Broske
3,761,602 A 9/1973 De Sio et al.
3,826,860 A 7/1974 De Sio et al.
4,027,939 A * 6/1977 White ..... H01R 4/5091 439/783
4,114,977 A 9/1978 Polidori
4,252,992 A 2/1981 Cherry et al.
4,279,461 A 7/1981 Bussen et al.
4,415,222 A 11/1983 Polidori
4,600,264 A 7/1986 Counsel
4,722,189 A 2/1988 Center
4,752,252 A 6/1988 Cherry et al.
4,857,020 A * 8/1989 Crosby ..... H01R 4/5091 439/783
4,863,403 A * 9/1989 Shannon ..... H01R 4/5091 439/783
RE33,098 E 10/1989 Center
5,090,923 A 2/1992 Kenyon et al.
5,092,797 A * 3/1992 Cole ..... H01R 4/5091 411/2
5,145,420 A * 9/1992 Counsel ..... H01R 4/5083 439/783
5,244,422 A 9/1993 Laricchia
5,340,335 A * 8/1994 Haun ..... H01R 4/5091 439/783
5,423,699 A 6/1995 Johnson
5,538,447 A 7/1996 Chadbourne et al.
5,558,546 A * 9/1996 Chadbourne ..... H01R 4/5083 439/783
5,600,096 A 2/1997 Cherry et al.
5,683,273 A 11/1997 Garver et al.
5,692,930 A 12/1997 Garver et al.
5,774,987 A 7/1998 Chadbourne et al.
5,794,334 A 8/1998 Chadbourne et al.
5,862,589 A 1/1999 Chadbourne et al.
5,916,001 A 6/1999 Chadbourne
6,093,064 A 7/2000 Callen et al.
6,261,117 B1 7/2001 LaCroix
6,273,765 B1 * 8/2001 Lalaouna ..... H01R 4/5083 174/94 R
6,309,261 B1 10/2001 Chadbourne
6,817,909 B2 11/2004 Dobrinski et al.
6,851,262 B1 2/2005 Gregory et al.
6,895,663 B2 * 5/2005 Itrich ..... H01R 4/5083 140/113
6,979,236 B1 * 12/2005 Stanton ..... H01R 4/5091 439/783
6,996,987 B2 2/2006 Gregory et al.
7,182,653 B1 2/2007 Hoxha
7,309,263 B2 12/2007 Copper et al.
7,387,546 B2 6/2008 Copper et al.
7,426,782 B2 9/2008 Johnson et al.
7,494,385 B2 2/2009 Copper et al.
7,677,933 B2 3/2010 Copper et al.
7,686,661 B2 3/2010 Shrum et al.
7,707,693 B2 * 5/2010 Schaefer ..... F16G 3/06 24/136 B
7,736,203 B2 * 6/2010 Copper ..... H01R 4/5083 439/836
7,766,702 B2 * 8/2010 De France ..... H01H 33/6661 439/772
7,819,706 B2 10/2010 Copper et al.
7,845,990 B2 12/2010 Shrum et al.
7,862,390 B2 1/2011 Copper
7,997,943 B2 8/2011 Gregory et al.
8,176,625 B2 5/2012 Copper et al.
8,402,641 B2 * 3/2013 Johnson ..... H01R 4/5083 29/745
8,469,721 B2 6/2013 Mitchell et al.
8,550,842 B1 10/2013 Gutierrez et al.
8,608,517 B2 12/2013 La Salvia et al.
9,059,522 B2 6/2015 Spalding et al.
2003/0148671 A1 8/2003 Mello et al.
2004/0029455 A1 2/2004 Johnson et al.
2004/0203294 A1 * 10/2004 Mello ..... H01R 4/5083 439/783
2006/0148333 A1 7/2006 Peterson
2006/0148334 A1 7/2006 Conn et al.
2008/0026644 A1 1/2008 De France et al.
2010/0003864 A1 * 1/2010 Fuzetti ..... H01R 4/5083 439/783
2010/0151735 A1 6/2010 Crutcher et al.
2010/0314232 A1 12/2010 Gregory et al.
2013/0012075 A1 * 1/2013 Mitchell ..... H01R 4/44 439/783
2018/0331435 A1 * 11/2018 Murugiah ..... H01R 4/5091
2018/0342818 A1 11/2018 Johnson et al.

FOREIGN PATENT DOCUMENTS

WO 00/01035 A2 1/2000
WO 2008/013891 A2 1/2008

OTHER PUBLICATIONS

Wrench-Lok data sheet, TE Connectivity (2 pages) (2014).
"Automatic connectors Reliable for wires, strands and conductors" Dribo, spol. s r.o. (4 pages) (Oct. 2003).
U.D.C.—Universal Distribution Connector Reinforced, Tyco Electronics Catalog 125003 (8 pages) (Mar. 1999).
AMPACT Taps, Stirrups, and Application Tooling, Customer Manual 409-2106 Rev M (39 pages) (Feb. 5, 1999).
Grupo Intelli General Catalog www.grupointelli.com IntMKT Set/2009 (52 pages) (Jan. 2009).
Notification of Transmittal of the International Search Report and the Written Opinion of the International Searching Authority, or the Declaration, in corresponding PCT Application No. PCT/US2018/030439 (16 pages) (dated Jul. 19, 2018).
Tyco Electronics Energy Division Ready Reference Guide, retrieved from http://energy.tycoelectronics.com (143 pages) (Published at least as early as Sep. 2011).

* cited by examiner

WEDGE CONNECTOR ASSEMBLIES AND METHODS AND CONNECTIONS INCLUDING SAME

RELATED APPLICATION(S)

The present application is a continuation-in-part (CIP) application of and claims priority from U.S. patent application Ser. No. 15/961,422, filed Apr. 24, 2018, which claims the benefit of and priority from U.S. Provisional Patent Application No. 62/503,695, filed May 9, 2017, and claims the benefit of and priority from U.S. Provisional Patent Application No. 62/760,401, filed Nov. 13, 2018, the disclosures of which are incorporated herein by reference in their entireties.

FIELD OF THE INVENTION

The present invention relates to electrical connectors and, more particularly, to power utility electrical connectors and methods and connections including the same.

BACKGROUND OF THE INVENTION

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, four types of connectors are commonly used for such purposes, namely bolt-on connectors, compression-type connectors, wedge connectors, and transverse wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors.

Compression connectors, instead of utilizing separate connector pieces, may include a single metal piece connector that is bent or deformed around the main power conductor and the tap conductor to clamp them to one another.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from TE Connectivity and is known as an AMPACT Tap or Stirrup Connector. AMPACT connectors include different sized channel members to accommodate a set range of conductor sizes, and multiple wedge sizes for each channel member. Each wedge accommodates a different conductor size.

Exemplary transverse wedge connectors are disclosed in U.S. Pat. Nos. 8,176,625, 7,997,943, 7,862,390, 7,845,990, 7,686,661, 7,677,933, 7,494,385, 7,387,546, 7,309,263, and 7,182,653.

SUMMARY OF THE INVENTION

According to embodiments of the present invention, a wedge connector system for connecting first and second elongate electrical conductors includes a C-shaped sleeve member, a wedge member and a locking mechanism. The sleeve member defines a sleeve cavity and opposed first and second sleeve channels on either side of the sleeve cavity. The wedge member includes a wedge body having first and second opposed wedge side walls. The locking mechanism includes a lock member including a sleeve engagement portion, and a clamping mechanism coupled to the wedge member. The sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall. The locking mechanism is mountable on the sleeve member and the wedge member such that the sleeve engagement portion interlocks with the sleeve member and the clamping mechanism can be operated to force the wedge member into the sleeve cavity to apply clamping loads on the first and second conductors.

According to embodiments of the present invention, a method for connecting first and second elongate electrical conductors includes providing a wedge connector assembly including: a C-shaped sleeve member defining a sleeve cavity and opposed first and second sleeve channels on either side of the sleeve cavity; a wedge member including a wedge body having first and second opposed wedge side walls; and a locking mechanism. The locking mechanism includes a lock member including a sleeve engagement portion, and a clamping mechanism coupled to the wedge member. The method further includes: using the sleeve member and the wedge member, capturing the first and second conductors such that the first conductor is received in the first sleeve channel between the sleeve member and the first wedge side wall and the second conductor is received in the second sleeve channel between the sleeve member and the second wedge side wall; and mounting the locking mechanism on the sleeve member and the wedge member such that the sleeve engagement portion interlocks with the sleeve member; and thereafter operating the clamping mechanism to force the wedge member into the sleeve cavity to apply clamping loads on the first and second conductors.

According to embodiments of the present invention, an electrical connection includes a wedge connector assembly and first and second elongate electrical conductors. The wedge connector assembly includes: a C-shaped sleeve member defining a sleeve cavity and opposed first and second sleeve channels on either side of the sleeve cavity; a wedge member including a wedge body having first and second opposed wedge side walls; and a locking mechanism. The locking mechanism includes a lock member including a sleeve engagement portion, and a clamping mechanism coupled to the wedge member. The first and second elongate electrical conductors are captured between the sleeve member and the wedge member such that the first conductor is received in the first sleeve channel between the sleeve member and the first wedge side wall and the second conductor is received in the second sleeve channel between the sleeve member and the second wedge side wall. The locking mechanism is mounted on the sleeve member and the wedge member such that the sleeve engagement portion interlocks with the sleeve member. The clamping mechanism secures the wedge member in the sleeve cavity to apply clamping loads on the first and second conductors.

According to some embodiments, a wedge connector system for connecting first and second elongate electrical conductors includes a C-shaped sleeve member, a wedge member, a locking mechanism, and a securing mechanism. The sleeve member defines a sleeve cavity and opposed first and second sleeve channels on either side of the sleeve cavity. The wedge member includes a wedge body having first and second opposed wedge side walls, the wedge member having a wedge member lengthwise axis. The locking mechanism includes: a lock member including a sleeve engagement portion; and a clamping mechanism coupled to the lock member. The sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall. The locking mechanism is mounted on or configured to be mounted on the wedge member to collectively form a lock/wedge subassembly. The lock/wedge subassembly is mountable on the sleeve member such that the sleeve engagement portion interlocks with the sleeve member and the clamping mechanism can be operated to force the wedge member into the sleeve cavity to apply clamping loads on the first and second conductors. In the lock/wedge subassembly, the lock member is mounted on the wedge member to permit lateral displacement of the lock member relative to the wedge member into an open position to facilitate installation of the lock member onto the sleeve member. The securing mechanism is positionable into a securing position wherein the securing mechanism prevents the lock member from moving into the open position from an assembled position on the sleeve member.

According to some method embodiments, a method for connecting first and second elongate electrical conductors includes providing a wedge connector system including a C-shaped sleeve member, a wedge member, a locking mechanism, and a securing mechanism. The sleeve member defines a sleeve cavity and opposed first and second sleeve channels on either side of the sleeve cavity. The wedge member includes a wedge body having first and second opposed wedge side walls, the wedge member having a wedge member lengthwise axis. The locking mechanism includes: a lock member including a sleeve engagement portion; and a clamping mechanism coupled to the wedge member. The locking mechanism is mounted on the wedge member to collectively form a lock/wedge subassembly. The method further includes mounting the lock/wedge subassembly on the sleeve member such that: the first conductor is received in the first sleeve channel between the sleeve member and the first wedge side wall, and the second conductor is received in the second sleeve channel between the sleeve member and the second wedge side wall; the lock member is laterally displaced relative to the wedge member into an open position to facilitate installation of the lock member onto the sleeve member; and the sleeve engagement portion interlocks with the sleeve member. The method further includes: operating the clamping mechanism to force the wedge member into the sleeve cavity to apply clamping loads on the first and second conductors; and positioning the securing mechanism into a securing position wherein the securing mechanism prevents the lock member from moving into the open position from an assembled position on the sleeve member.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
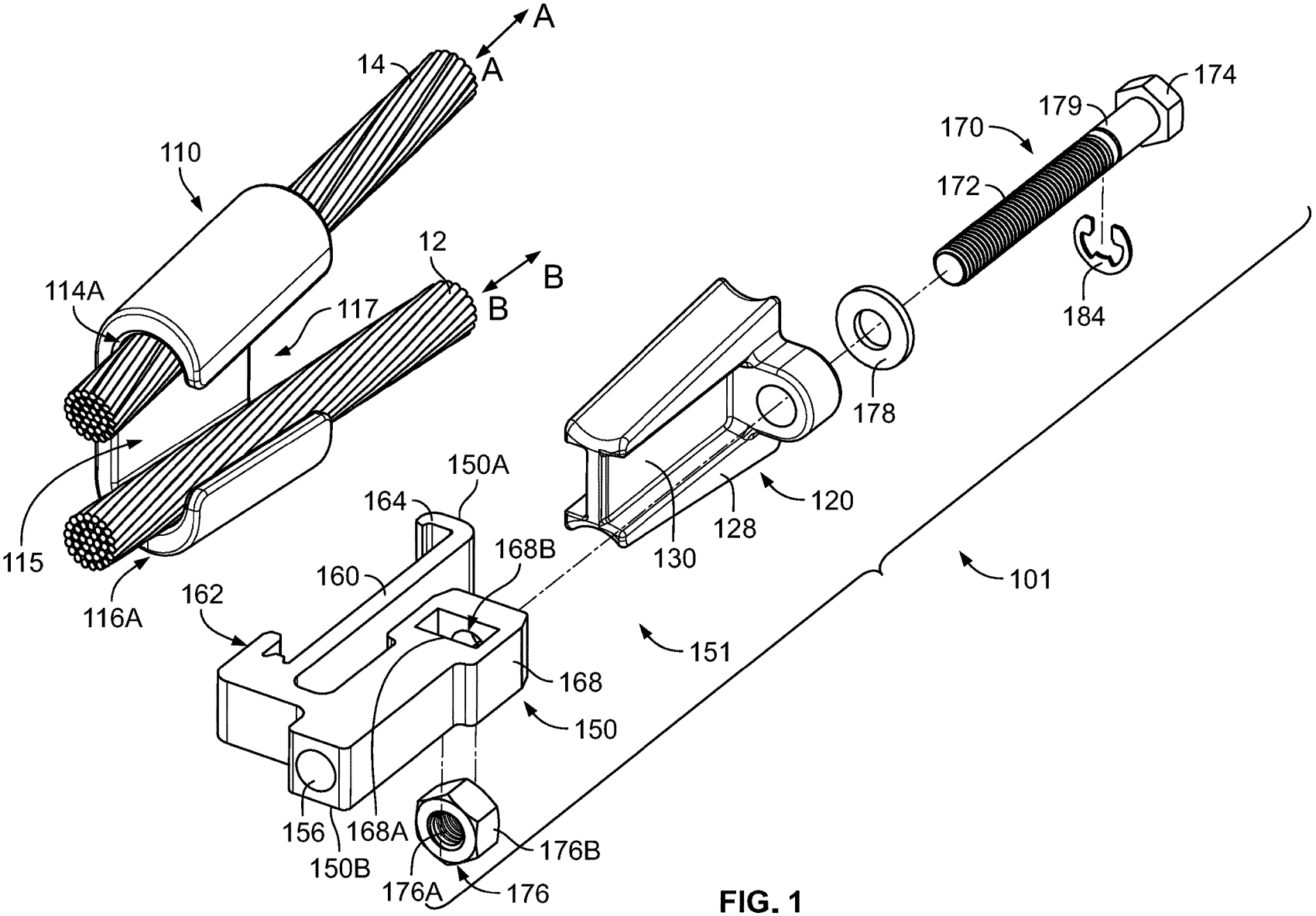
FIG. 1 is an exploded, front perspective view of a wedge connector system according to embodiments of the invention and a pair of conductors.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this disclosure and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-8, a wedge connector system or kit 101 and a wedge connector assembly 100 according to embodiments of the present invention is shown therein. The wedge connector system 101 can be used to form a connection 5 (FIGS. 3-6) including a pair of elongate electrical conductors 12, 14 (e.g., electrical power lines) mechanically and electrically coupled by the wedge connector assembly 100. The connector assembly 100 may be adapted for use as a tap connector for connecting an elongate tap conductor 12 to an elongate main conductor 14 of a utility power distribution system, for example. The wedge connector system 101 can be installed using a rotation driver 32 and a tool 30.

The tap conductor 12, sometimes referred to as a distribution conductor, may be a known electrically conductive metal high voltage cable or line having a generally cylindrical form in an exemplary embodiment. The main conductor 14 may also be a generally cylindrical high voltage cable line. The tap conductor 12 and the main conductor 14 may be of the same wire gage or different wire gage in different applications and the connector assembly 100 is adapted to accommodate a range of wire gages for each of the tap conductor 12 and the main conductor 14. The conductor 12 has a lengthwise axis B-B and the conductor 14 has a lengthwise axis A-A.

When installed to the tap conductor 12 and the main conductor 14, the connector assembly 100 provides electrical connectivity between the main conductor 14 and the tap conductor 12 to feed electrical power from the main conductor 14 to the tap conductor 12 in, for example, an electrical utility power distribution system. The power distribution system may include a number of main conductors 14 of the same or different wire gage, and a number of tap conductors 12 of the same or different wire gage.

The conductors 12, 14 each include a plurality of separable elongate strands 12A, 14A. Alternatively, one of the conductors 12, 14 may be solid.

Figure 5:
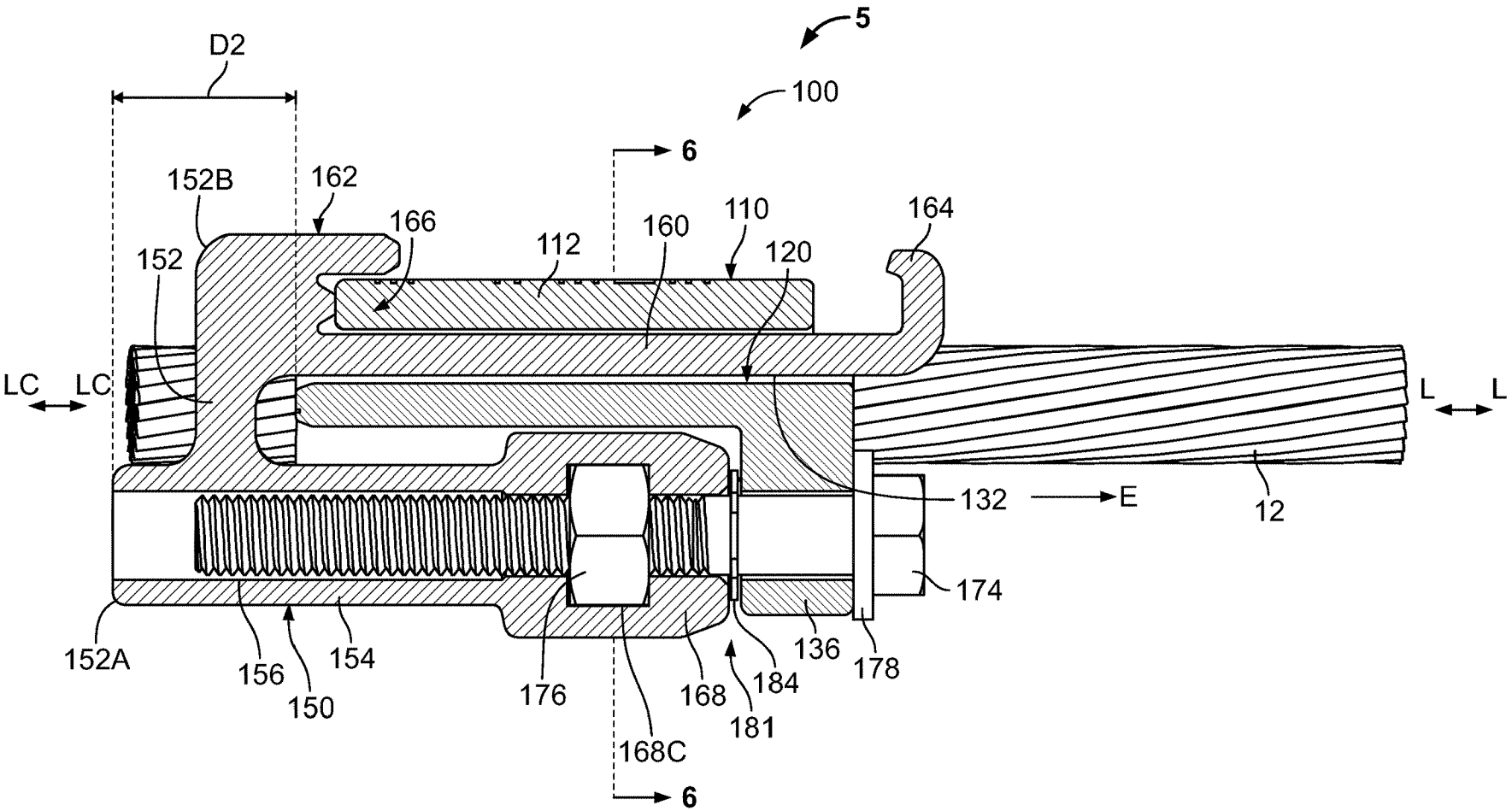
FIG. 5 is a cross-sectional view of the wedge connector assembly of FIG. 3 taken along the line 5-5 of FIG. 3.
Figure 6:
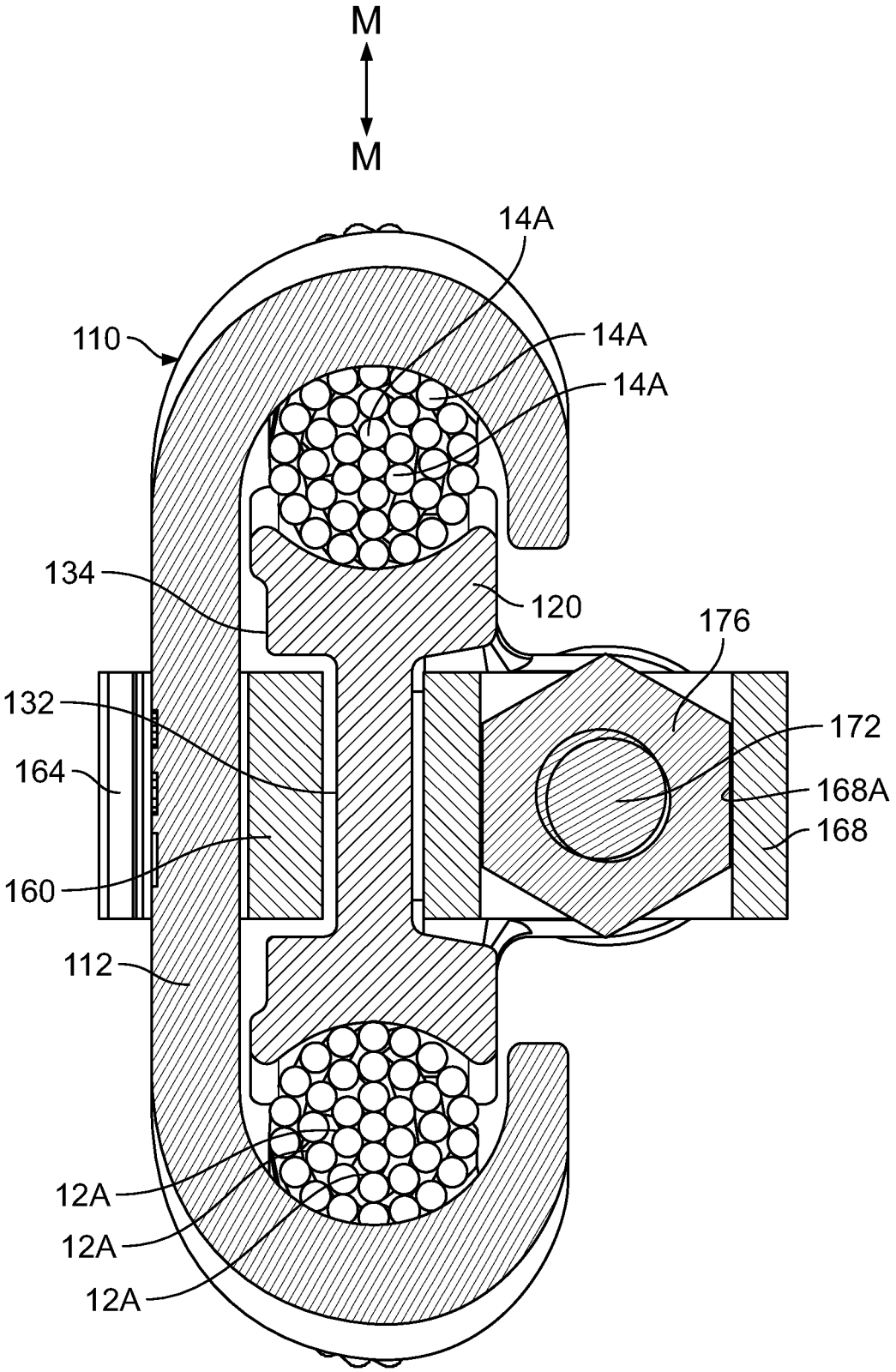
FIG. 6 is a cross-sectional view of the wedge connector assembly of FIG. 3 taken along the line 6-6 of FIG. 5.

With reference to FIG. 1, the wedge connector system 101, and the wedge connector assembly 100 formed therefrom, include a C-shaped channel or sleeve member 110, a wedge member 120, a drive/lock mechanism 151, and a retraction mechanism 181 (FIG. 5). The sleeve member 110 and the wedge member 120 are movable relative to one another to cooperatively mechanically capture the conductors 12, 14 therebetween and electrically connect the conductors 12, 14 to one another.

Figure 3:
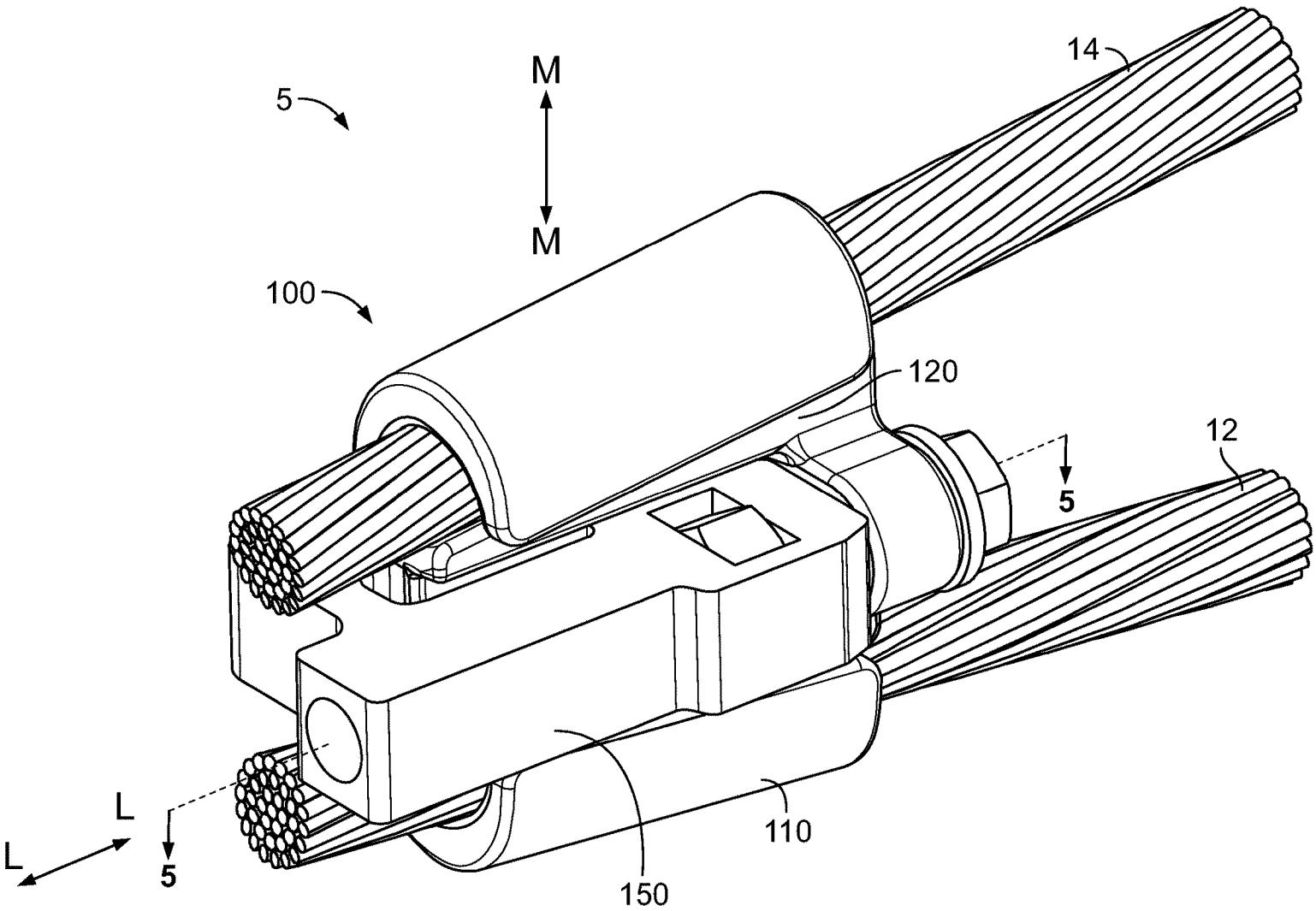
FIG. 3 is a front perspective view of a connection including a wedge connector assembly formed from the wedge connector system of FIG. 1.
Figure 4:
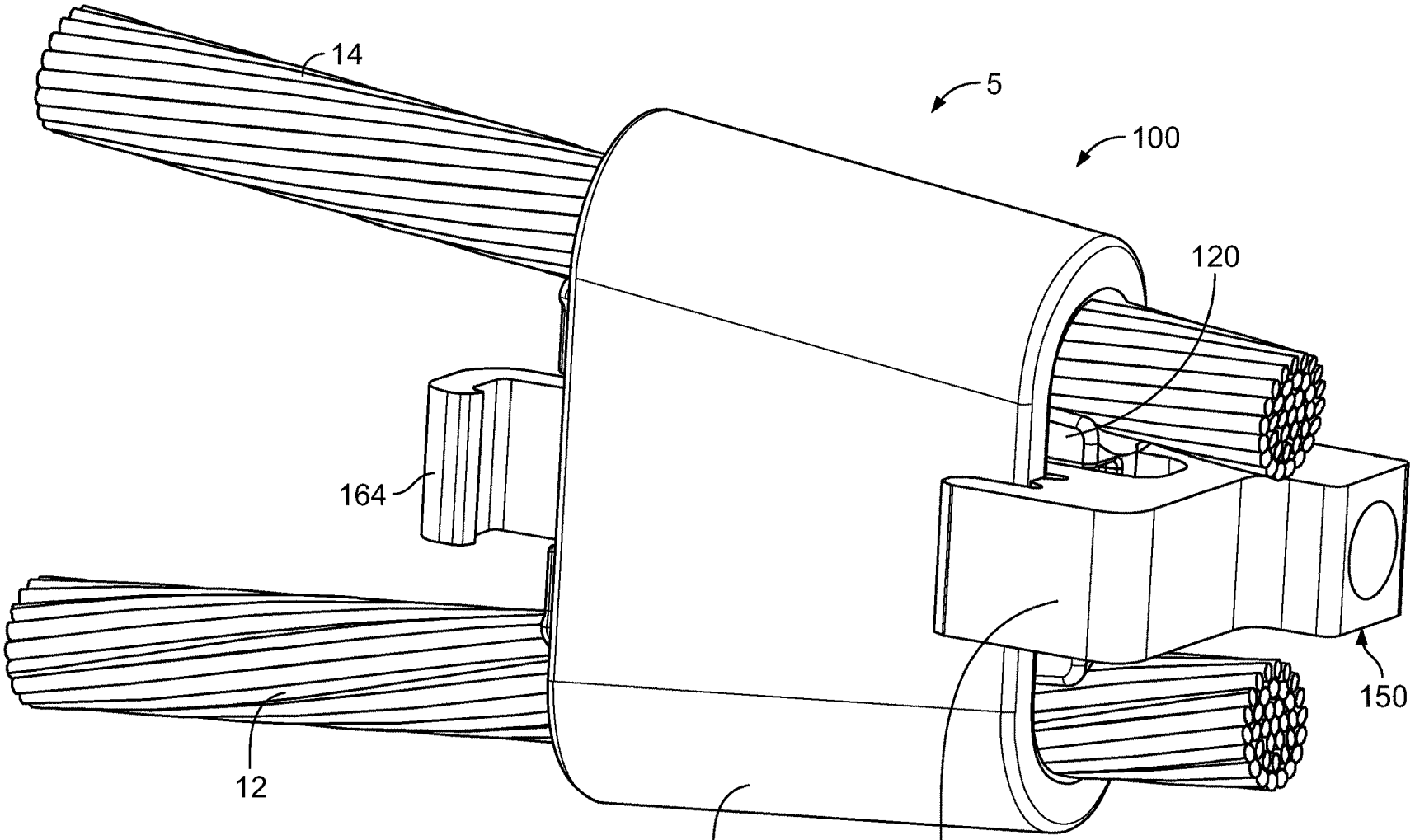
FIG. 4 is a front perspective view of the wedge connector assembly of FIG. 3 from an opposing side of the wedge connector assembly.

With reference to FIG. 3, the assembled connector assembly 100 has a lengthwise axis L-L and a transverse axis M-M.

Figure 7:
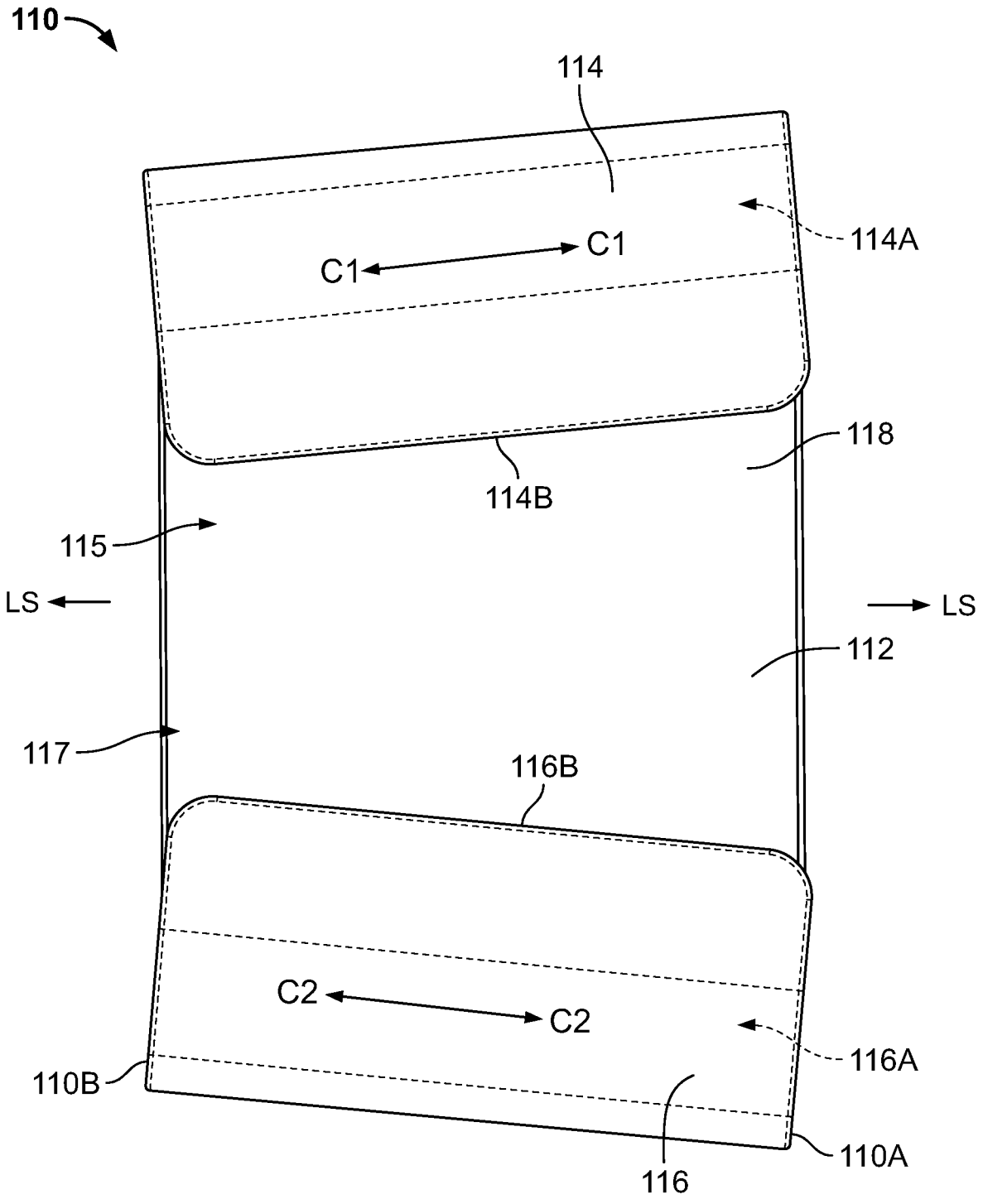
FIG. 7 is a side view of a sleeve member forming a part of the wedge connector system of FIG. 1.

The sleeve member 110 is C-shaped in cross-section. With reference to FIG. 7, the sleeve member 110 tapers inwardly from a rear end 110A to a front end 110B. The sleeve member 110 includes an arcuate first side wall or receiver or hook portion 114, an arcuate second side wall or receiver or hook portion 116, and a connecting portion or body 112 extending therebetween. The hook portions 114, 116 extend longitudinally along opposed side edges of the body 112. The sleeve member 110 further includes an inner surface 118. The sleeve member 110 forms a chamber or cavity 115 defined by the inner surface 118. In some embodiments, the sleeve member 110 is resiliently flexible.

The first hook portion 114 forms a concave first sleeve member cradle or channel 114A positioned at an end of the cavity 115. The first channel 114A is adapted to receive and make contact with the conductor 14 at an apex of the channel 114A. The first hook portion 114 forms a radial bend that wraps around the conductor 14 for about 180 circumferential degrees in an exemplary embodiment, such that a distal end 114B of the first hook portion 114 faces toward the second hook portion 116A.

Similarly, the second hook portion 116 forms a concave second sleeve member cradle or channel 116A positioned at an opposing end of the cavity 115 and opening to oppose the channel 114A. The second channel 116A is adapted to receive and make contact with the conductor 12 at an apex of the channel 116. The second hook portion 116 forms a radial bend that wraps around the conductor 12 for about 180 circumferential degrees in an exemplary embodiment, such that a distal end 116B of the second hook portion 116 faces toward the first hook portion 114.

The distal ends 114B and 116B define a longitudinally extending slot 117 therebetween that opens into the chamber 115.

With reference to FIG. 7, the sleeve member 110 has a lengthwise axis LS-LS. The first channel 114A defines a channel axis C1-C1. The second channel 116A defines a channel axis C2-C2. According to some embodiments and as illustrated, the channel axes C1-C1 and C2-C2 form an oblique angle relative to one another and, in some embodiments, the oblique angle is in the range of from about 10 to 12 degrees. According to some embodiments and as illustrated, the channel axes C1-C1 and C2-C2 form an oblique angle relative to the connector lengthwise axis L-L. When the connector assembly 100 is assembled, the channel axes C1-C1 and C2-C2 each extend transversely to and intersect the transverse axis M-M. According to some embodiments and as illustrated, the transverse axis M-M forms an oblique angle with each of the channel axes C1-C1 and C2-C2. The side channels 114A, 116A taper inwardly or converge from the rear end 110A to the front end 110B.

Figure 8:
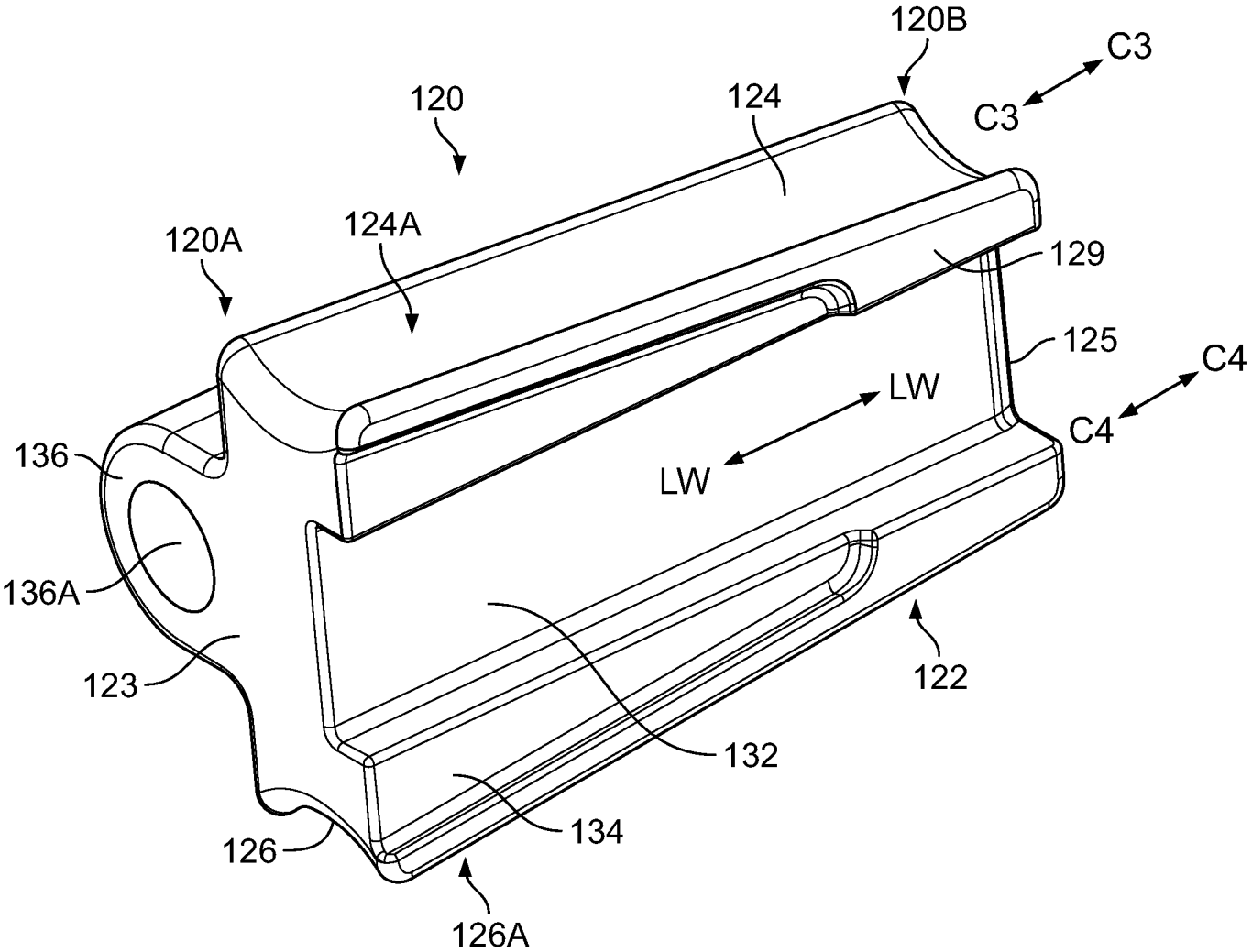
FIG. 8 is rear perspective view of a wedge member forming a part of the wedge connector system of FIG. 1.

With reference to FIGS. 1 and 8, the wedge member 120 includes a body 122 having opposed, arcuate clamping side faces or walls 124, 126, opposed end faces or walls 123, 125, and opposed outer and inner faces or walls 128, 129. The wedge member 120 tapers inwardly from a relatively wide rear end 120A to a relatively narrow front end 120B.

The clamping side walls 124, 126 define opposed, concave grooves or channels 124A, 126A. The channels 124A, 126A taper inwardly or converge from the rear end 120A to the front end 120B.

The wedge member 120 has a lengthwise axis LW-LW (FIG. 8). The channel 124A defines a channel axis C3-C3. The channel 126A defines a channel axis C4-C4. According to some embodiments and as illustrated, the channel axes C3-C3 and C4-C4 form an oblique angle relative to one another and, in some embodiments, the oblique angle is in the range of from about 10 to 12 degrees. According to some embodiments and as illustrated, the channel axes C3-C3 and C4-C4 form an oblique angle relative to the connector lengthwise axis L-L. When the connector assembly 100 is assembled, the channel axes C3-C3 and C4-C4 each extend transversely to and intersect the transverse axis M-M. According to some embodiments and as illustrated, the transverse axis M-M forms an oblique angle with each of the channel axes C3-C3 and C4-C4.

An axially extending alignment slot 130 is defined in the outer wall 128.

An axially extending guide slot 132 is defined in the inner wall 129. Opposed, axially extending bearing ribs may be located on either side of the slot 132. An axially extending deflection slot 134 is also defined in the inner wall 129 over and outward beyond the guide slot 132.

An integral boss 136 is located proximate the rear end 120A. The boss 136 projects outwardly from the body 122 in a direction transverse (e.g., perpendicular) to the connector axis L-L. A bore 136A extends through the boss 136 substantially parallel to the axis L-L. In some embodiments, the bore 136 is nonthreaded.

The lock mechanism includes a lock member 150, a first drive member 170, a cooperating second drive member 176, and a split ring washer 178. In some embodiments and as shown, the first drive member is a drive bolt 170 and the second drive member is a nut 176. The drive bolt 170 and the nut 176 operate as a clamping mechanism.

The retraction mechanism 181 includes a rear engagement portion 164 (on the rear end of the lock member 150), an annular retainer clip mount slot 179 (on the rear end of the drive bolt 170), and a retainer member, ring or clip 184.

With reference to FIGS. 1 and 5, the lock member 150 extends from a rear end 150A to a front end 150B along a lock member axis LC-LC. The lock member 150 includes a body 152, an integral bolt receiving portion 154, an integral guide rail 160, an integral hook or engagement portion 162, and an integral nut holder portion 168. The body 152 is located proximate the front end 150B and extends transversely to the axis LC-LC from an outer end 152A to an inner end 152B.

The bolt receiving portion 154 is located proximate the outer end 152A of the body 152 and extends rearwardly substantially parallel to the axis LC-LC. An extension portion 154A extends forwardly from the body 152. A bolt bore 156 extends through the bolt receiving portion 154. In some embodiments, the bore 156 is nonthreaded.

The guide rail 160 is located at a midsection of the body 152 and extends rearwardly substantially parallel to the axis LC-LC. The guide rail 160 is a substantially flat, elongate plate. An integral, axially extending bearing rib may be located on the outer face of the guide rail.

The engagement portion 162 includes a sleeve slot 166 (FIG. 5).

The nut holder portion 168 includes a cavity 168B and a side opening 168A communicating with the cavity 168B. Anti-rotation features in the form of flats 168C (FIG. 5) are located in the cavity 168B.

The bolt 170 (FIG. 1) has an externally threaded cylindrical shank, rod or shaft 172 and an integral driver engagement feature 174 on the rear end of the shaft 172. The driver engagement feature 174 may be provided in the form of a geometric head (e.g., a hexagonal faceted head) or a geometric socket. The drive head 174 may be a hex head as illustrated, for example.

The annular retainer clip mount slot 179 is defined in the outer surface of the bolt 170 proximate the head 174. The retainer clip 184 is seated in the slot 179. The retainer clip 184 is thereby positioned on rear side of the boss 136, opposite the bolt head 174. The retainer clip 184 permits the bolt 170 to rotate about the bolt's lengthwise axis within and relative to the boss 136, but limits relative forward axial displacement of the bolt 170 relative to the boss 136. In this way, the retainer clip 184 prevents the bolt from moving forwardly out of the boss 136 beyond a relatively short prescribed distance.

The nut 176 includes an internally threaded bore 176A and outer geometric engagement facets or faces 176B. For example, the nut 176 may be a hex nut, as illustrated.

The sleeve member 110 may be formed of any suitable electrically conductive material. According to some embodiments, the sleeve member 110 is formed of metal. According to some embodiments, the sleeve member 110 formed of aluminum or steel. The sleeve member 110 may be formed using any suitable technique. According to some embodiments, the sleeve member 110 is monolithic and unitarily formed. According to some embodiments, the sleeve member 110 is extruded and cut. Alternatively or additionally, the spring sleeve 110 may be stamped (e.g., die-cut), cast and/or machined.

The wedge member 120 may be formed of any suitable material. According to some embodiments, the wedge member 120 is formed of metal. According to some embodiments, the wedge member 120 is formed of aluminum or copper alloy. The wedge member 120 may be formed using any suitable technique. According to some embodiments, the wedge member 120 is cast and/or machined.

The lock member 150 may be formed of any suitable material. According to some embodiments, the lock member 150 is formed of metal. According to some embodiments, the lock member 150 is formed of aluminum or copper alloy. The clamping member 150 may be formed using any suitable technique. According to some embodiments, the lock member 150 is cast and/or machined.

The sleeve member 110, the wedge member 120, and the lock member 150 may be separately fabricated from one another or otherwise formed into discrete connector components and are assembled to one another as explained below. While exemplary shapes of these components have been illustrated herein, it is recognized that they may be alternatively shaped in other embodiments as desired.

The bolt 170, the nut 176, and the retainer clip 184 may be formed of any suitable material. According to some embodiments, the bolt 170, the nut 176, and the retainer clip 184 are formed of metal. According to some embodiments, the bolt 170, the nut 176, and the retainer clip 184 are formed of aluminum or steel.

With reference to FIGS. 2-6, exemplary methods for assembling and using the connector assembly 100 in accordance with embodiments of the present invention will now be described.

The sleeve member 110, the wedge member 120, the lock member 150, the bolt 170, the nut 176, the washer 178, and the retainer clip 184 may each be manufactured as individual, discrete parts from the others, and thereafter assembled together. Each of the assembly steps may be executed in a factory or by an end user or installer.

Figure 2:
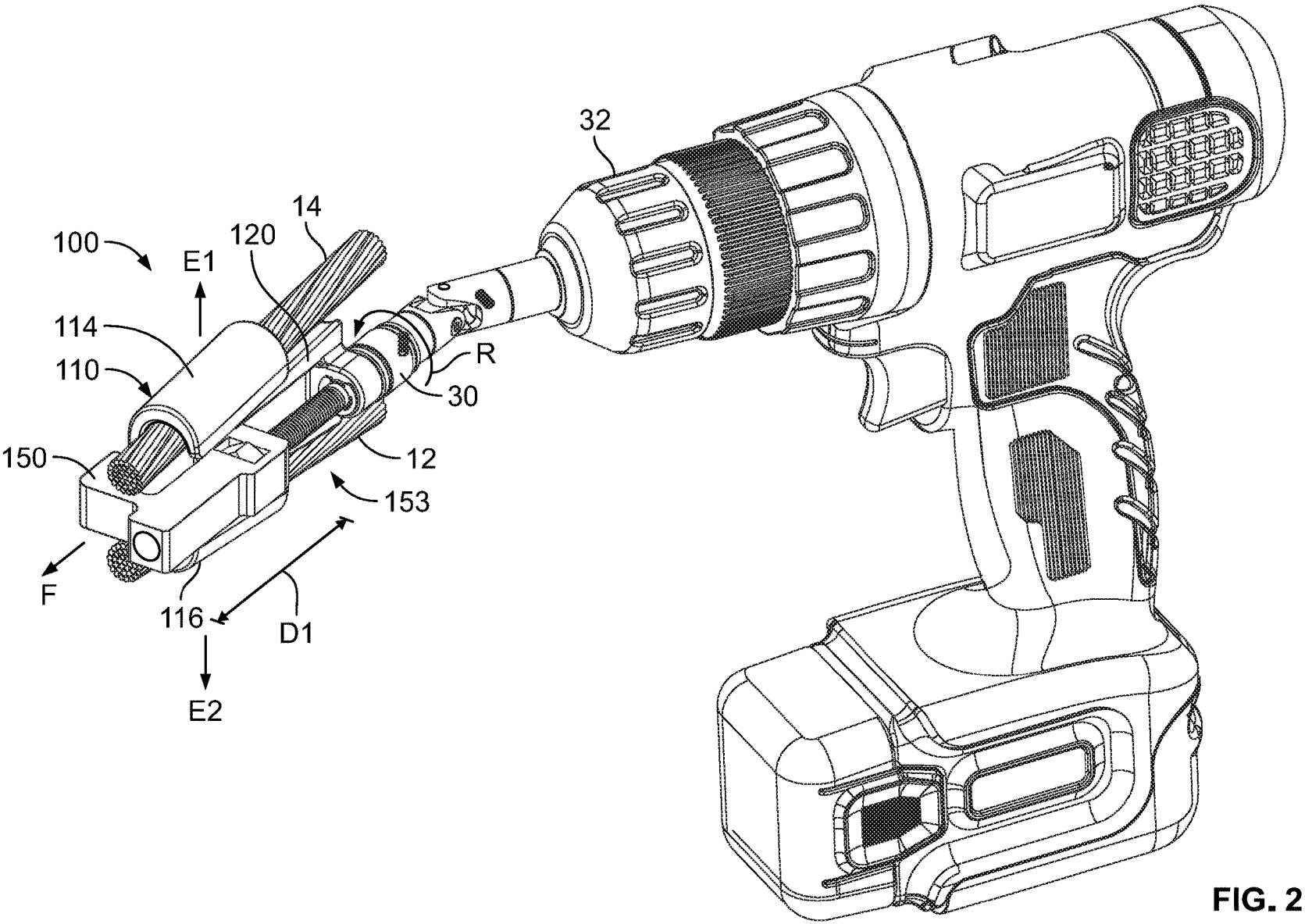
FIG. 2 is a front perspective view of the wedge connector system of FIG. 1 illustrating installation of the wedge connector system on the conductors.

The wedge member 120, the lock member 150, the bolt 170, the nut 176 the washer 178, and the retainer clip 184 are assembled together to form a wedge subassembly 153 (FIG. 2). More particularly, the guide rail 160 is slid into the guide slot 132 from the front end 120B. The nut 176 is inserted through the opening 168A and seated in the cavity 168B. The shaft 172 of the bolt 170 is inserted through the bore 136A and threadedly engages with the nut 176. The nut 176 is prevented from rotation with the bolt 170 by the flats 168C. The retainer clip 184 is installed in the slot 179 to axially secure or limit the bolt 170 relative to the wedge member 120. The bolt 170 may be adjusted so that the guide rail 160 is captured in the guide slot 132 and the wedge subassembly 153 will maintain the arrangement as shown in FIG. 2.

In some embodiments, the wedge subassembly 153 is assembled at the factory and provided to the end user or installer assembled. In other embodiments, the wedge subassembly 153 is assembled by the end user and, in some embodiments, is assembled onsite at the location of the tap installation by the installer. The wedge subassembly 153 can assume an open position (as shown in FIG. 2) wherein the wedge member 120 is extended and the front end 120B of the wedge member 120 is spaced a distance D1 (FIG. 2) from the front end 150B of the lock member 150. The wedge subassembly 153 can alternatively assume a closed position (as shown in FIGS. 3-6) wherein the wedge member 120 is retracted and the front end 120B of the wedge member 120 is spaced a distance D2 (FIG. 5) from the front end 150B of the lock member 150. The distance D2 is less than the distance D1.

As shown in FIG. 2, the C-shaped sleeve member 110 is placed over the conductor 12 such that the conductor 12 is received in the side channel 116A. The conductor 14 is placed in the other side channel 114A.

With the wedge subassembly 153 in the open position, the wedge subassembly 153 is laterally inserted into the sleeve member cavity 115 through the slot 117. The wedge member 120 is partially inserted into the cavity 115 between the conductors 12, 14 such that the conductors 12, 14 are received in the opposed grooves 124A, 126A. The wedge member 120 may be forced into the sleeve member 110 by hand or using a hammer or the like to temporarily hold the wedge member 120 and the conductors 12, 14 in position.

The tool 30 is engaged with the bolt head 174. Advantageously, the head 174 is accessible for engagement with the tool 30 from the rear side of the wedge assembly 153. The tool 30 is forcibly driven by the driver 32 to rotate the bolt 170 in a direction R relative to the fixed nut 176. The wedge member 120 and the lock member 150 are thereby linearly displaced and pulled together in opposed converging directions toward the closed position of the wedge subassembly 153. The wedge member 120 abuts the conductors 12, 14 in the sleeve member 110 and the lock member 150 hooks over and receives the front end 110B of the sleeve member 110 in the slot 166.

The driver 32 and tool 30 are further used to forcibly rotate the bolt 170 so that the wedge member 120 is further forced forwardly (direction F, FIG. 2) relative to the sleeve member 110 until the wedge member 120 is in a desired final position to form the connection 10 as shown in FIGS. 3-6. The connection 10 may be formed by forming interference fits between the wedge member 120, the C-shaped sleeve member 110 and the conductors 12, 14. Moreover, the wedge member 120 is secured in place by the interlocking engagement between the engagement portion 162 and the sleeve member 110.

During installation, the engagement portion 162 locks onto the front end 110B of the sleeve member 110 and maintains proper alignment between the wedge member 120 and the sleeve member 110. This interlock may also act as a safety feature at the beginning stages of the installation.

The wedge member 120, the sleeve member 110 and/or the conductors 12, 14 may be deformed. The C-shaped sleeve member 110 may be elastically deformed so that it applies a bias or spring force against the wedge member 120 and the conductors 12, 14. The sleeve member 110 may be plastically deformed.

In some embodiments, the hook portions 114, 116 are deflected outward (in directions E1 and E2 (FIG. 2), respectively) along the transverse axis M-M. The sleeve member 110 is elastically and plastically deflected resulting in a spring back force (i.e., from stored energy in the bent sleeve member 110) to provide a clamping force on the conductors 12, 14. As a result of the clamping force, the sleeve member 110 may generally conform to the conductors 12, 14. According to some embodiments, a large application force, on the order of about 26 to 31 kN of clamping force is provided, and the clamping force ensures adequate electrical contact force and electrical connectivity between the connector assembly 100 and the conductors 12, 14. Additionally, elastic deflection of the sleeve member 110 provides some tolerance for deformation or compressibility of the conductors 12, 14 over time, such as when the conductors 12, 14 deform due to compression forces. Actual clamping forces may be lessened in such a condition, but not to such an amount as to compromise the integrity of the electrical connection.

In some embodiments, the elastic deflection of the sleeve member 110 causes the central body 112 to bend or bulge toward the wedge member 120, where a portion of the body 112 is received in the deflection slot 134.

In some embodiments, the outer surface of the bolt receiver portion 154 is lubricated to reduce friction with the wedge member 120 in the alignment slot 130.

The tubular bolt receiving portion 154, including the extension portion 154A, covers the bolt shaft 172 after termination.

Once installed, the connector system 101 can be operated as follows to disassemble the connection and connection assembly 100 in accordance with methods of the invention. The bolt 170 is rotated opposite the direction R (i.e., counterclockwise) to force the wedge member 120 to move axially rearwardly and away from the bolt head 174. Because the axial position of the retainer clip 184 on the bolt 170 is fixed and the rear engagement portion 164 prevents relative axial displacement between the lock member 150 and the sleeve member 110, the bolt rotation force displaces the wedge member 120 rearwardly (direction E in FIG. 5) relative to the sleeve member 110. In this way, the sleeve member 110 and the wedge member 120 are freed from one another and the connection. The lock bar 150 can then be removed from the sleeve member 110.

Any suitable type or construction of driver 32 may be used to forcibly rotate the bolt 170 in the rotation direction R. According to some embodiments, the bolt 170 is rotated using a power tool 32. The power tool may be an electrically, pneumatically or hydraulically powered tool. According to some embodiments, the power tool is a battery powered tool. According to some embodiments, the tool 30 is rotated using a manual driver. The manual driver may be a ratcheting driver, for example.

A corrosion inhibitor compound may be provided (i.e., applied at the factory) on the conductor contact surfaces of the wedge member 120 and/or the sleeve member 110. The corrosion inhibitor may prevent or inhibit corrosion formation and assist in abrasion cleaning of the conductors 12, 14. The corrosion inhibitor can inhibit corrosion by limiting the presence of oxygen at the electrical contact areas. The corrosion inhibitor material may be a flowable, viscous material. The corrosion inhibitor material may be, for example, a base oil with metal particles suspended therein. In some embodiments, the corrosion inhibitor is a cod oil derivative with aluminum nickel alloy particles. Suitable inhibitor materials are available from TE Connectivity. According to some embodiments, the corrosion inhibitor layer has a thickness in the range of from about 0.02 to 0.03 inch.

It will be appreciated that the connector assembly 100 can effectively accommodate conductors 12, 14 of a range or different sizes and configurations as a result of the flexibility of the spring member 110. Different connector assemblies 100 can themselves be sized to accommodate different ranges of conductor sizes, from relatively small diameter wires for low current applications to relatively large diameter wires for high voltage energy transmission applications. In some embodiments, the size of the main conductor 14 is 336.4 kcmil or greater and the size of the tap conductor 12 is #6 AWG or greater.

It is recognized that effective clamping force on the conductors 12, 14 is dependent upon the geometry and dimensions of the members 110, 120 and size of the conductors used with the connector assembly 100. Thus, with strategic selections of angles for the engagement surfaces, and the size and positioning of the conductors 12, 14, varying degrees of clamping force may be realized when the connector assembly 100 is used as described above.

As illustrated, the channels 114A, 116A are generally arcuate. However, some or all of the channels 114A, 116A may have cross-sectional shapes of other configurations.

Elongate, protruding ribs may be provided in the channels 124A, 126A to reduce friction as the wedge member 120 is driven into the sleeve member 110. The ribs typically will not significantly reduce electrical contact surface with the conductors 12, 14. According to some embodiments, each rib has a height in the range of from about 0.008 to 0.012 inch and a width in the range of from about 0.018 to 0.022 inch.

Figure 9:
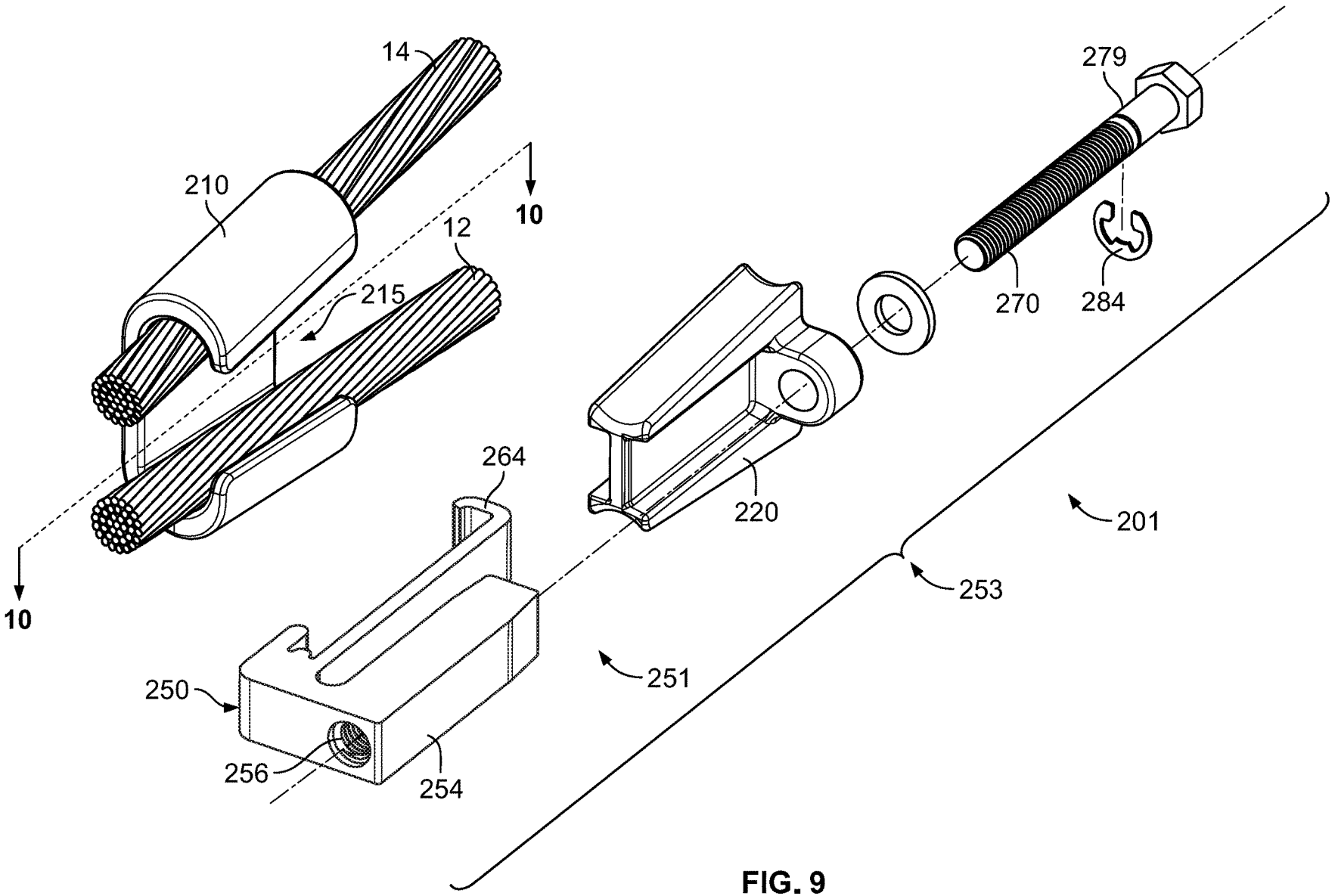
FIG. 9 is an exploded, front perspective view of a wedge connector system according to further embodiments of the invention and a pair of conductors.
Figure 10:
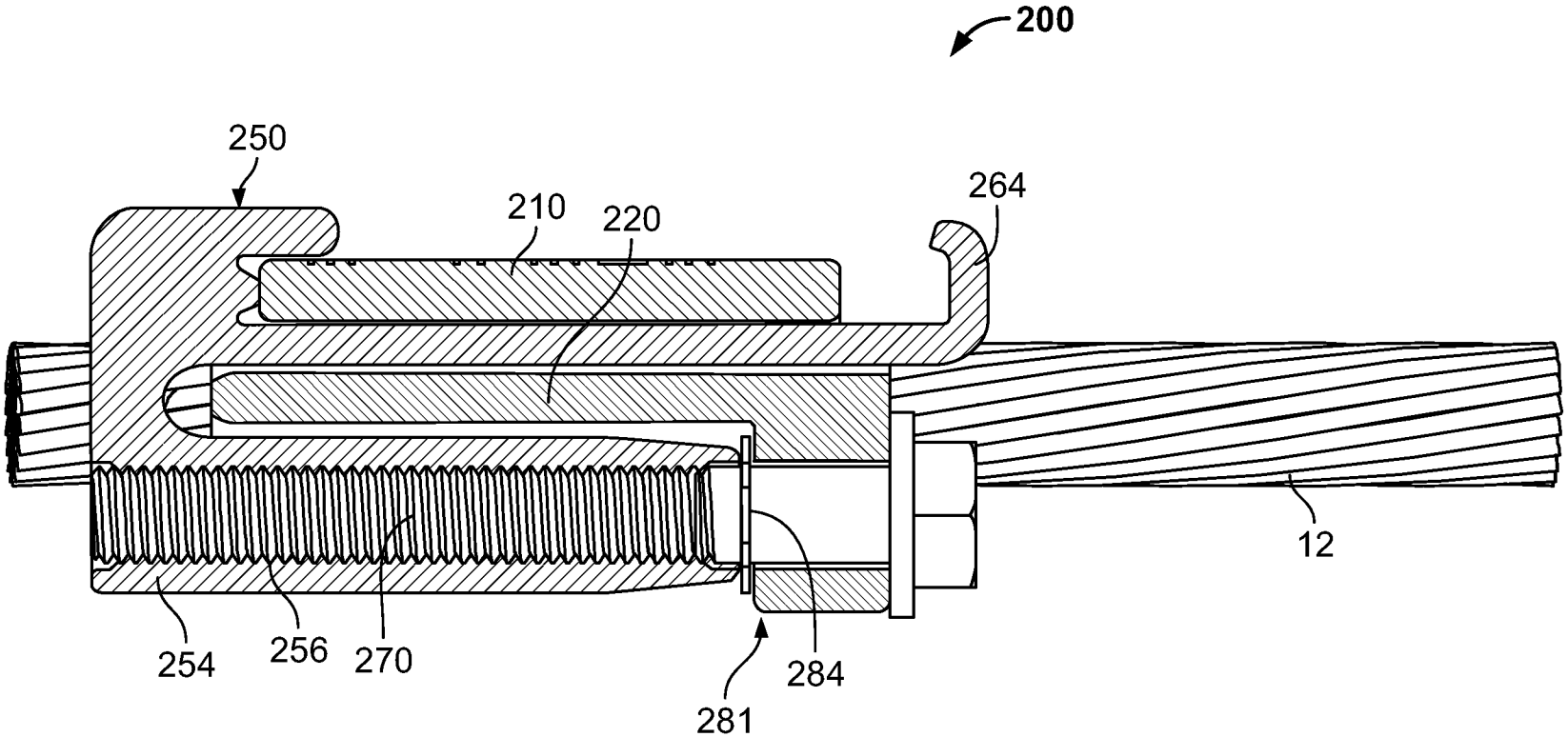
FIG. 10 is a cross-sectional view of the wedge connector assembly of FIG. 9 taken along the line 10-10 of FIG. 9.

With reference to FIGS. 9 and 10, a wedge connector system 201 and a wedge connector assembly 200 according to further embodiments is shown therein. The connector assembly 200 corresponds to and may be used in the same manner as the connector assembly 100, except as discussed below. The connector assembly 200 includes a sleeve member 210 and a wedge member 220, corresponding to the sleeve member 110 and a wedge member 120, respectively.

The connector assembly 200 further includes a drive/lock mechanism 251 corresponding to the drive/lock mechanism 151 except as follows. In place of the nut 176 and the nut holder portion 168, the lock member 250 is provided with an internally threaded bore 256 in its bolt receiver portion 254. In use, a wedge subassembly 253 is formed by threadedly engaging the bolt 270 with the threaded bore 256. The wedge subassembly 253 can then be installed on the sleeve member 210 and the conductors 12, 14. The wedge subassembly 253 can be contracted by rotating the bolt head 274 to clamp the wedge subassembly 253 onto the sleeve member 210 and force the wedge member 220 into the sleeve member cavity 215 to mechanically capture the conductors 12, 14 therebetween and electrically connect the conductors 12, 14 to one another. The rear end of the bolt receiver portion 254 can serve as a stop face to limit wedge member travel.

The connector assembly 200 also includes a retraction mechanism 281 corresponding to the retraction mechanism 181. The retraction mechanism 281 includes a rear engagement portion 264 (on the rear end of the lock member 250), an annular retainer clip mount slot 279 (on the rear end of the drive bolt 270), and a retainer member, ring or clip 284. The connector assembly 200 can be disassembled and removed in the same manner as described above for the connector assembly 100.

Figure 11:
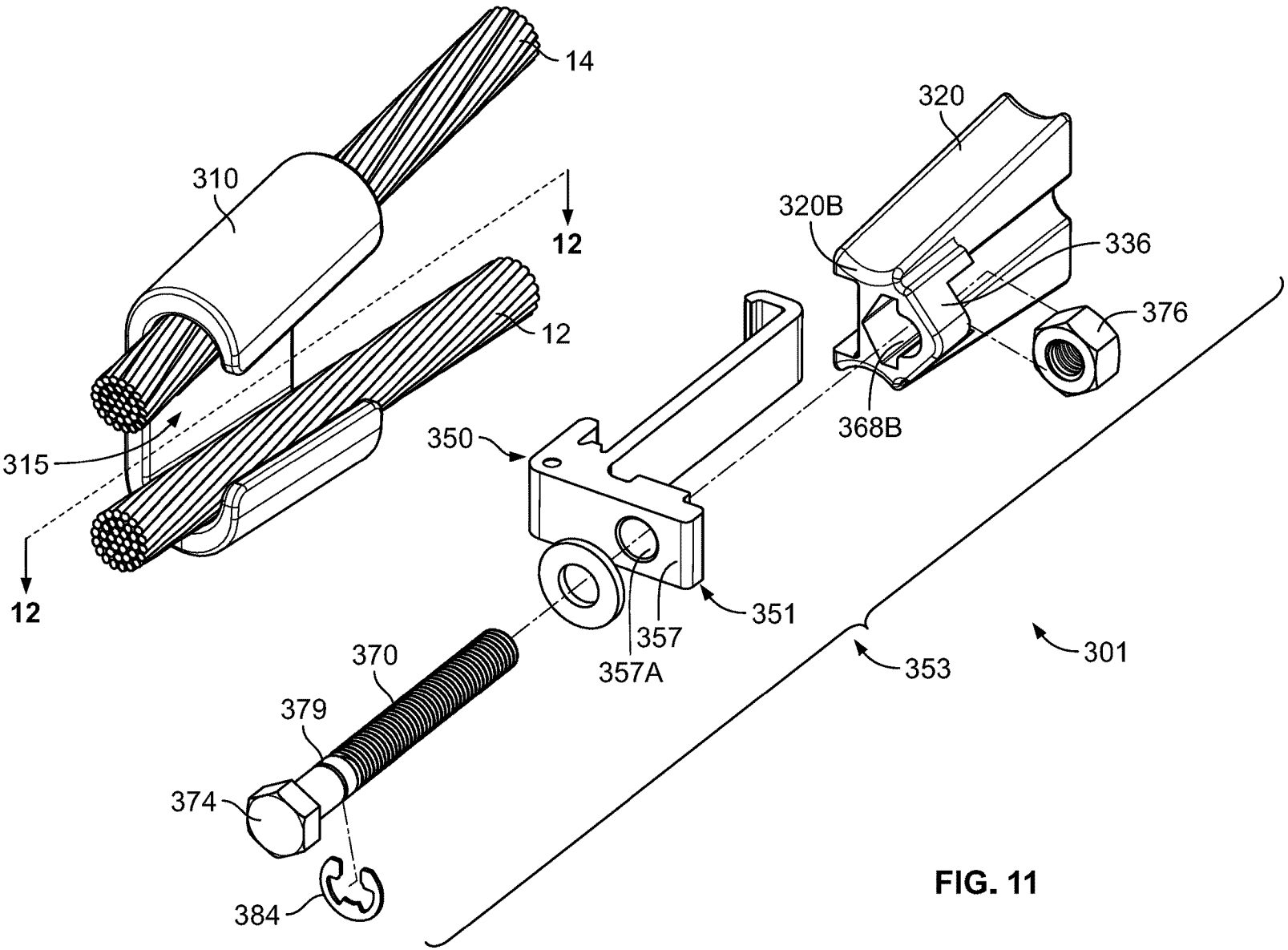
FIG. 11 is an exploded, front perspective view of a wedge connector system according to further embodiments of the invention and a pair of conductors.
Figure 12:
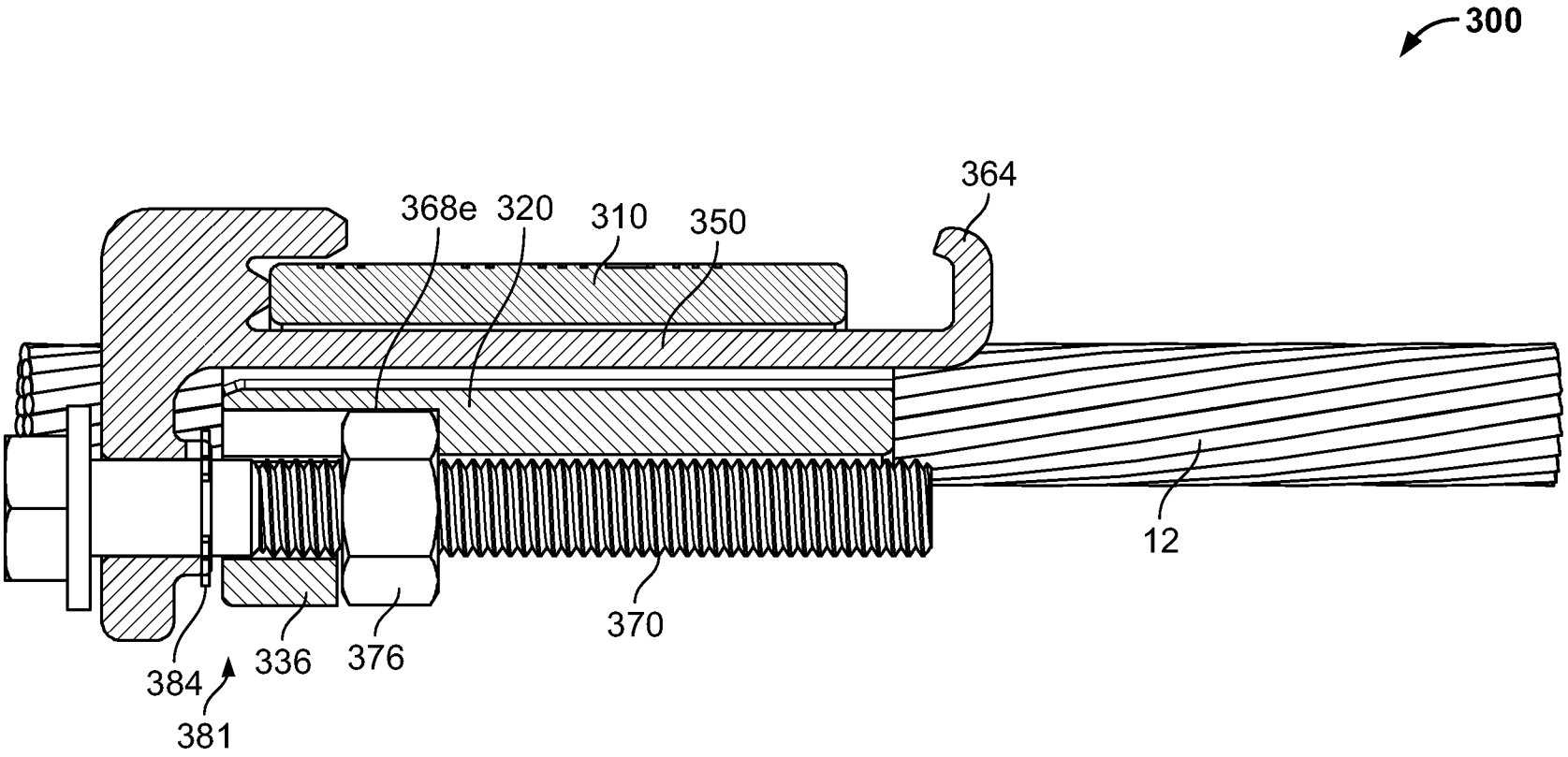
FIG. 12 is a cross-sectional view of the wedge connector assembly of FIG. 11 taken along the line 12-12 of FIG. 11.

With reference to FIGS. 11 and 12, a wedge connector system 301 and a connector assembly 300 according to further embodiments is shown therein. The connector assembly 300 corresponds to and may be used in the same manner as the connector assembly 100, except as discussed below. The connector assembly 300 includes a sleeve member 310 corresponding to the sleeve member 110. The connector assembly 300 further includes a drive/lock mechanism 351 corresponding to the drive/lock mechanism 151 except as discussed below.

The connector assembly 300 includes a wedge member 320 corresponding to the wedge member 120 except that the wedge member 320 is provided with a boss 336 on its front end 320B. The boss 336 includes a nut slot 368B having anti-rotation features 368C. The nut 376 is seated in the nut slot 368B.

The connector assembly 300 further includes a lock member 350 corresponding to the lock member 150 except that the lock member 150 is provided with bolt receiving arm 357 and a bore 357A.

In use, a wedge subassembly 353 is formed by inserting the bolt 370 through the bore 357A and threadedly engaging the bolt 370 with the nut 376. The wedge subassembly 353 can then be installed on the sleeve member 310 and the conductors 12, 14. The wedge subassembly 353 can be contracted by engaging the bolt head 374 and rotating the bolt 370 to clamp the wedge subassembly 353 onto the sleeve member 310 and force the wedge member 320 into the sleeve member cavity 315 to mechanically capture the conductors 12, 14 therebetween and electrically connect the conductors 12, 14 to one another. It will be appreciated that in the case of the connector assembly 300, the bolt head 374 is engaged by the tool 30 from the front end of the wedge subassembly 353.

The connector assembly 300 also includes a retraction mechanism 381 corresponding to the retraction mechanism 181. The retraction mechanism 381 includes a rear engagement portion 364 (on the rear end of the lock member 350), an annular retainer clip mount slot 379 (on the rear end of the drive bolt 370), and a retainer member, ring or clip 384. The connector assembly 300 can be disassembled and removed in the same manner as described above for the connector assembly 100.

Figure 13:
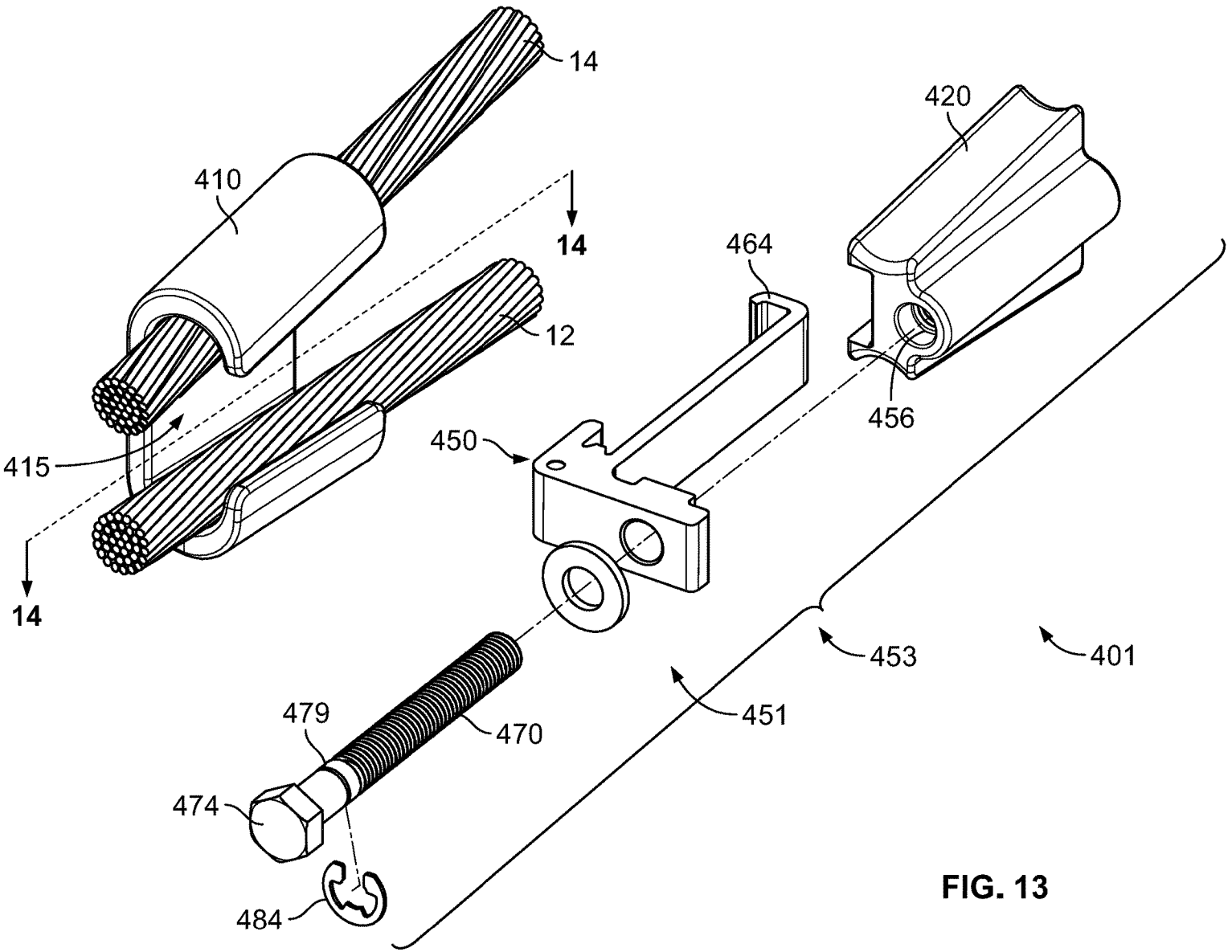
FIG. 13 is an exploded, front perspective view of a wedge connector system according to further embodiments of the invention and a pair of conductors.
Figure 14:
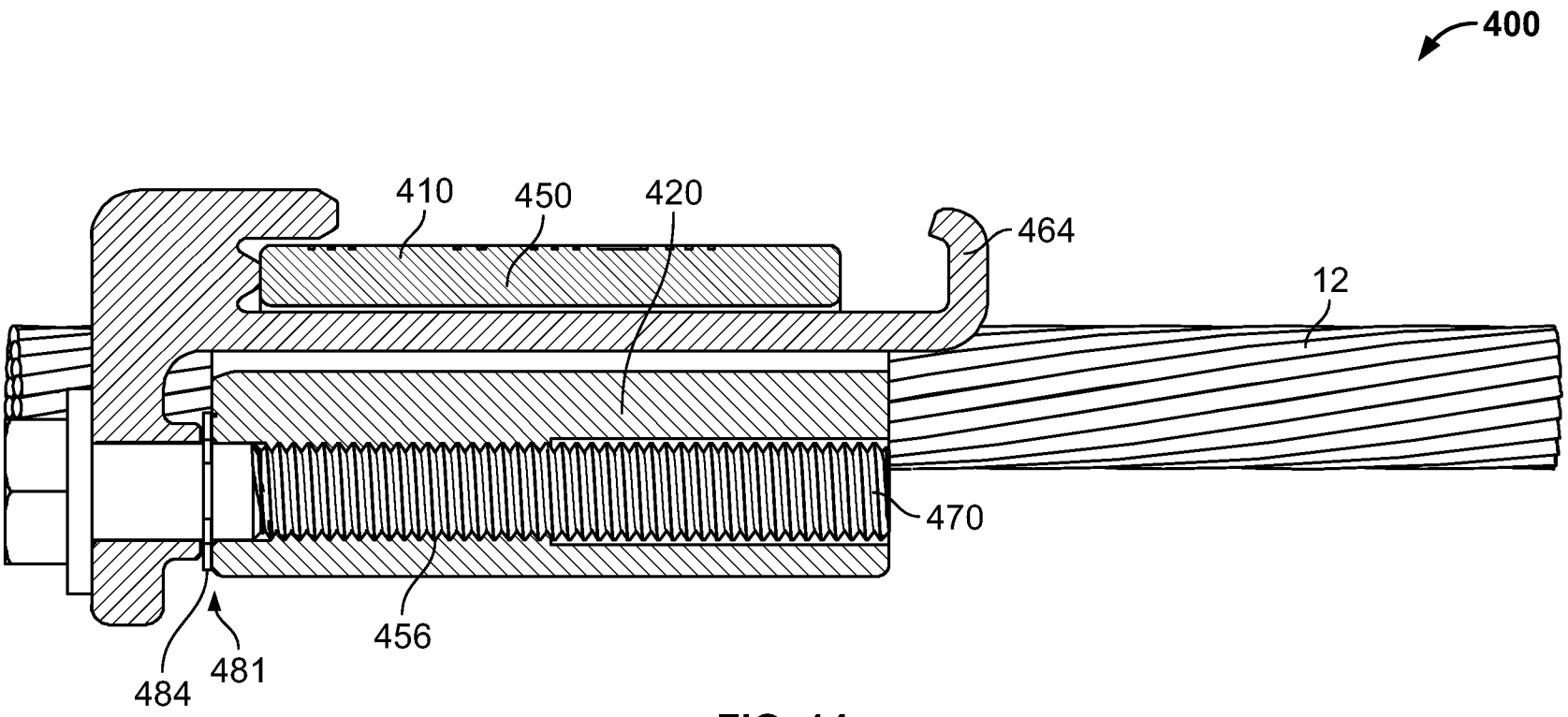
FIG. 14 is a cross-sectional view of the wedge connector assembly of FIG. 13 taken along the line 14-14 of FIG. 13.
Figure 15:
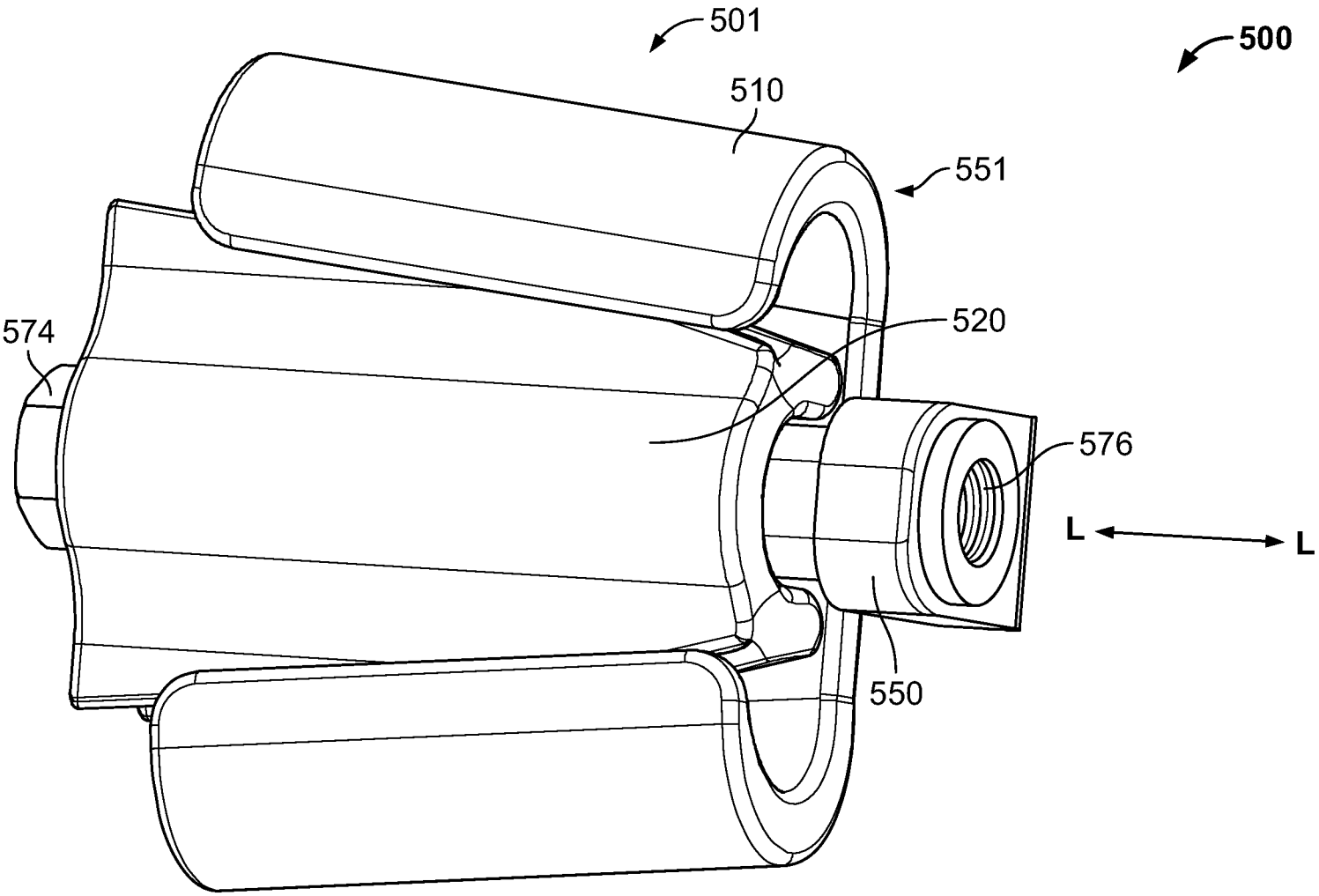
FIG. 15 is a front perspective view of a wedge connector system and wedge connector assembly according to further embodiments of the invention.
Figure 16:
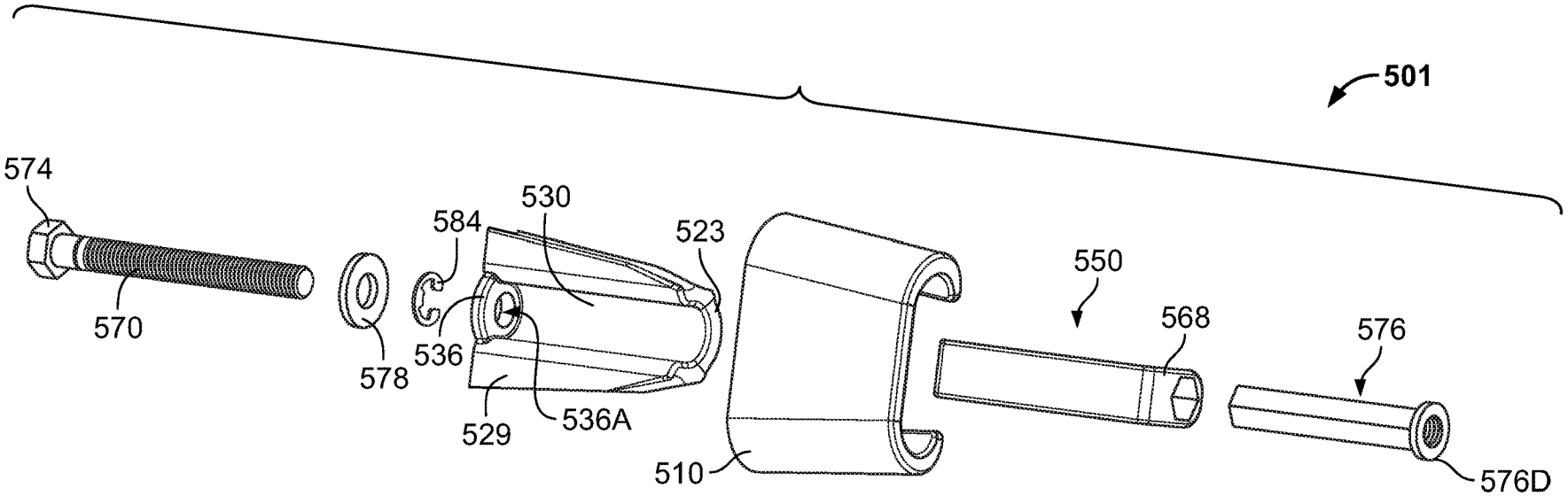
FIG. 16 is an exploded, front perspective view of the wedge connector system of FIG. 15.
Figure 17:
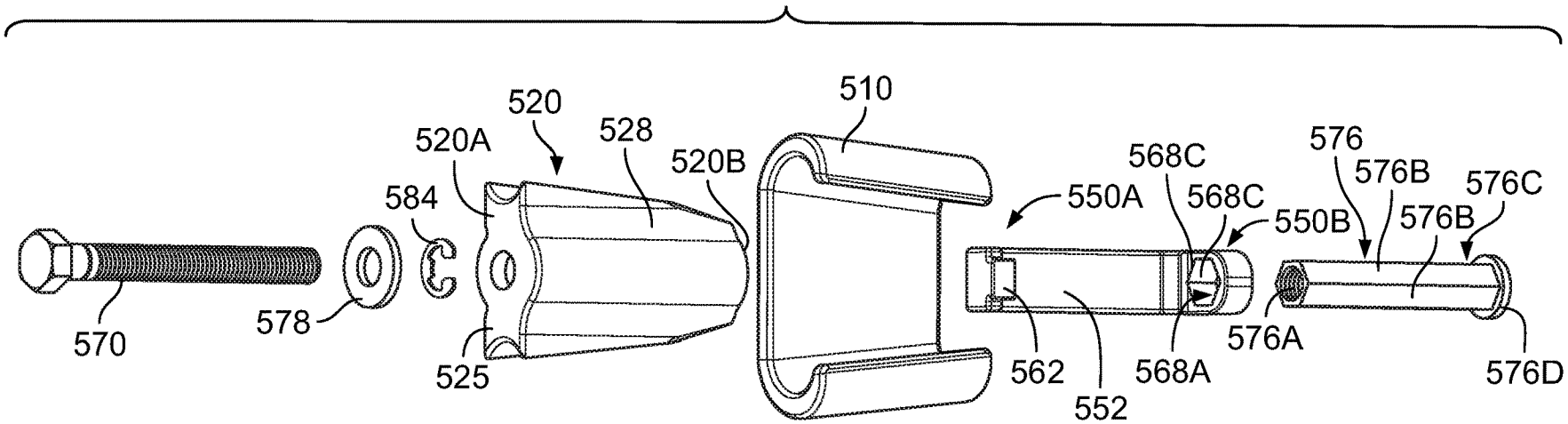
FIG. 17 is an exploded, rear perspective view of the wedge connector system of FIG. 15.
Figure 18:
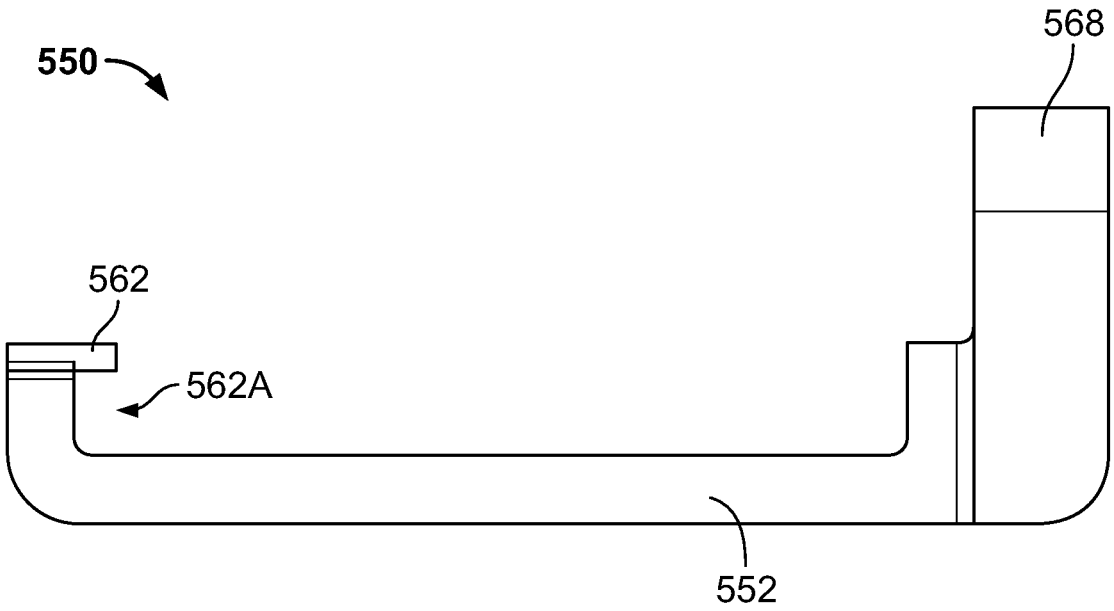
FIG. 18 is a side view of a lock member forming a part of the wedge connector system of FIG. 15.
Figure 19:
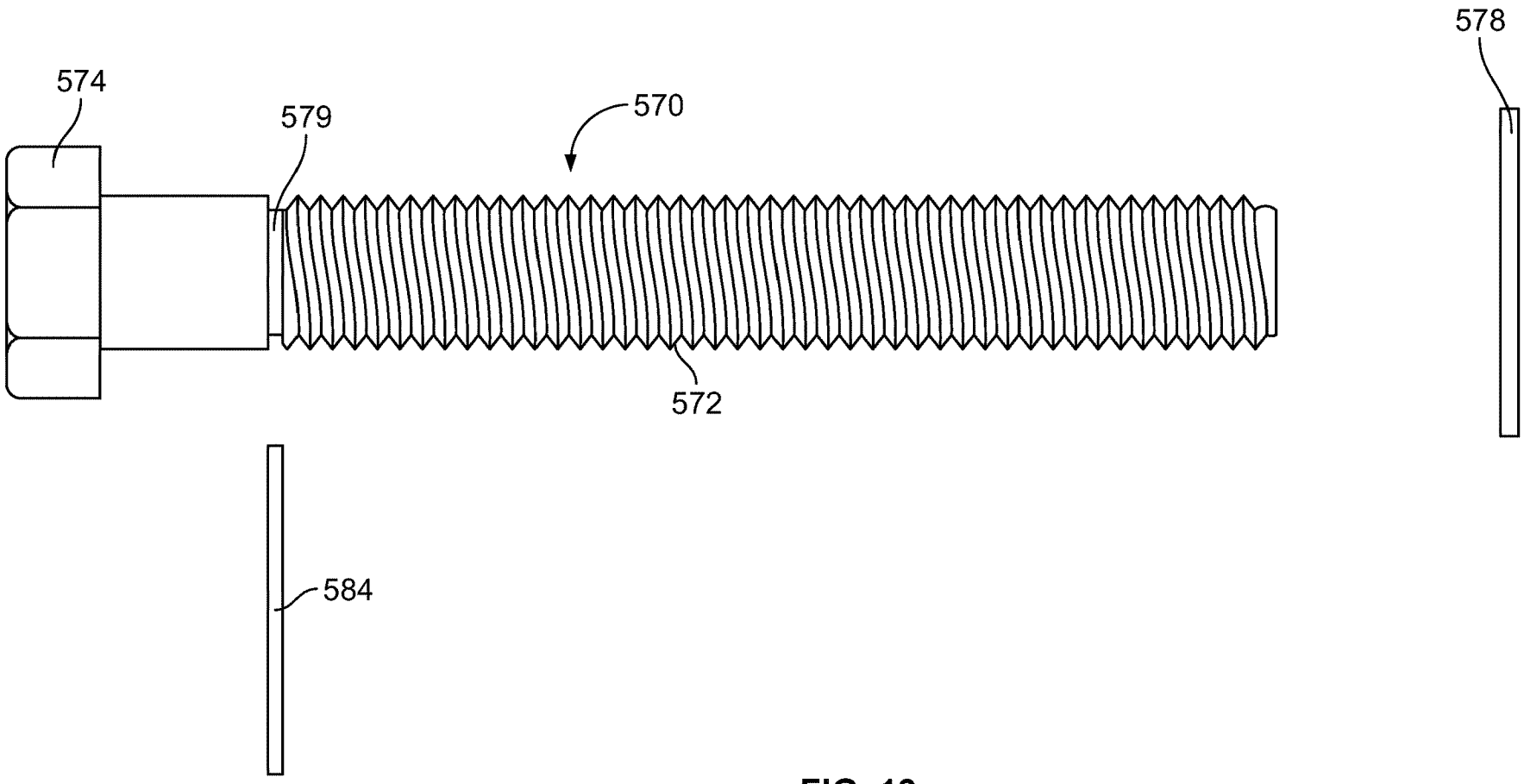
FIG. 19 is a side view of a drive bolt and a retainer clip forming a part of the wedge connector system of FIG. 15.

With reference to FIGS. 13 and 14, a wedge connector system 401 and a wedge connector assembly 400 according to further embodiments is shown therein. The connector assembly 400 corresponds to and may be used in the same manner as the connector assembly 300, except as discussed below. The connector assembly 400 includes a sleeve member 410 corresponding to the sleeve member 110.

The connector assembly 400 further includes a drive/lock mechanism 451 corresponding to the drive/lock mechanism 351 except as follows. In place of the nut 376 and the nut holder slot 368B, the wedge member 420 is provided with an internally threaded bore 456. In use, a wedge subassembly 453 is formed by threadedly engaging the bolt 470 with the threaded bore 456. The wedge subassembly 453 can then be installed on the sleeve member 410 and the conductors 12, 14. The wedge subassembly 453 can be contracted by engaging the bolt head 474 to rotate the bolt 470 to clamp the wedge subassembly 453 onto the sleeve member 410 and force the wedge member 420 into the sleeve member cavity 415 to mechanically capture the conductors 12, 14 therebetween and electrically connect the conductors 12, 14 to one another.

The connector assembly 400 also includes a retraction mechanism 481 corresponding to the retraction mechanism 181. The retraction mechanism 481 includes a rear engagement portion 464 (on the rear end of the lock member 450), an annular retainer clip mount slot 479 (on the rear end of the drive bolt 470), and a retainer member, ring or clip 484. The connector assembly 400 can be disassembled and removed in the same manner as described above for the connector assembly 100.

With reference to FIGS. 15-22, a wedge connector system 501 and a wedge connector assembly 500 according to further embodiments is shown therein. The connector assembly 500 corresponds to and may be used in the same manner as the connector assembly 100, except as discussed below. The connector assembly 500 includes a sleeve member 510 and a wedge member 520, corresponding to the sleeve member 110 and the wedge member 120, respectively. The connector assembly 500 includes a drive/lock mechanism 551. The sleeve member 510 and the wedge member 520 are movable relative to one another to cooperatively mechanically capture the conductors 12, 14 therebetween and electrically connect the conductors 12, 14 to one another.

The wedge member 520 includes a body 522 having opposed, arcuate clamping side faces or walls 524, 526, opposed end faces or walls 523, 525, and opposed outer and inner faces or walls 528, 529. The wedge member 520 tapers inwardly from a relatively wide rear end 520A to a relatively narrow front end 520B.

An axially extending alignment slot 530 is defined in the inner wall 529.

An integral boss 536 is located proximate the rear end 520A. The boss 536 projects outwardly from the body 522 in a direction transverse (e.g., perpendicular) to the connector axis L-L and toward the sleeve member 510. A bore 536A extends through the boss 536 substantially parallel to the axis L-L. In some embodiments, the bore 536A is nonthreaded.

The lock mechanism 551 includes a lock member 550, a first drive member 570, a cooperating second drive member 576, a washer 578, and a retainer clip 584. In some embodiments and as shown, the first drive member is a drive bolt 570 and the second drive member is a nut 576. The drive bolt 570 and the nut 576 operate as a clamping mechanism.

The lock member 550 extends from a rear end 550A to a front end 550B along a lock member axis LC-LC. The lock member 550 includes a longitudinally extending body 552, an integral rear engagement or hook portion 562, and an integral nut holder portion 568.

The hook portion 562 is located on the rear end 550A. The hook portion 562 defines a slot 562A.

The nut holder portion 568 is a boss located on the front end 550B and projects laterally away from the connecting wall 512 of the sleeve member 510. The nut holder portion 568 includes a bore 568A. Anti-rotation features in the form of flats 568C are located in the bore 568A and define a hexagonal passage.

The bolt 570 has an externally threaded cylindrical shank, rod or shaft 572 and an integral driver engagement feature 574 on the rear end of the shaft 572. The driver engagement feature 574 may be provided in the form of a geometric head (e.g., a hexagonal faceted head) or a geometric socket. The drive head 574 may be a hex head as illustrated, for example.

An annular retainer ring mount slot 579 is defined in the outer surface of the bolt 570 proximate the head 574. The retainer clip 584 is seated in the slot 579. The retainer clip 584 is thereby positioned on front side of the boss 536, opposite the bolt head 574. The retainer clip 584 permits the bolt 570 to rotate about the bolt's lengthwise axis relative to the boss 536, but limits relative rearward axial displacement of the bolt 570 relative to the boss 536. In this way, the retainer clip 584 prevents the bolt from moving rearwardly out of the boss 536 beyond a relatively short prescribed distance. Other retention devices (e.g., a split pin) or features may be used in addition to or in place of the retainer clip 584 to axially constrain the bolt 570 relative to the wedge member 520 while permitting the bolt 570 to rotate relative to the wedge member 520.

The nut 576 is an extended or elongate capped coupling nut. The nut 576 has a nut body 576C and an internally threaded bore 576A. The outer surface of the nut body 576C has geometric engagement facets or faces 576B and is hexagonal in cross-section. The nut 576 also has a stop feature 576D on the capped end of the body 576C having an outer diameter greater than that of the nut body 576C. The nut 576 is seated in the bore 568A of the lock member 550 such that the faceted outer surface of the nut 576 mates with the complementary faceted inner surface of the bore 568A to prevent or limit rotation of the nut 576 relative to the bore 568A. The nut body 576C may fit closely in the bore 568A, but is permitted to slide axially through the bore 568A. The stop feature 576D is sized to prevent it from passing through the bore 568A.

The sleeve member 510, wedge member 520, lock member 550, bolt 570, and nut 576 may be formed of materials and using techniques as described above for the sleeve member 110, wedge member 120, lock member 150, bolt 170, and nut 176.

Exemplary methods for assembling and using the connector assembly 500 in accordance with embodiments of the present invention will now be described.

Figure 20:
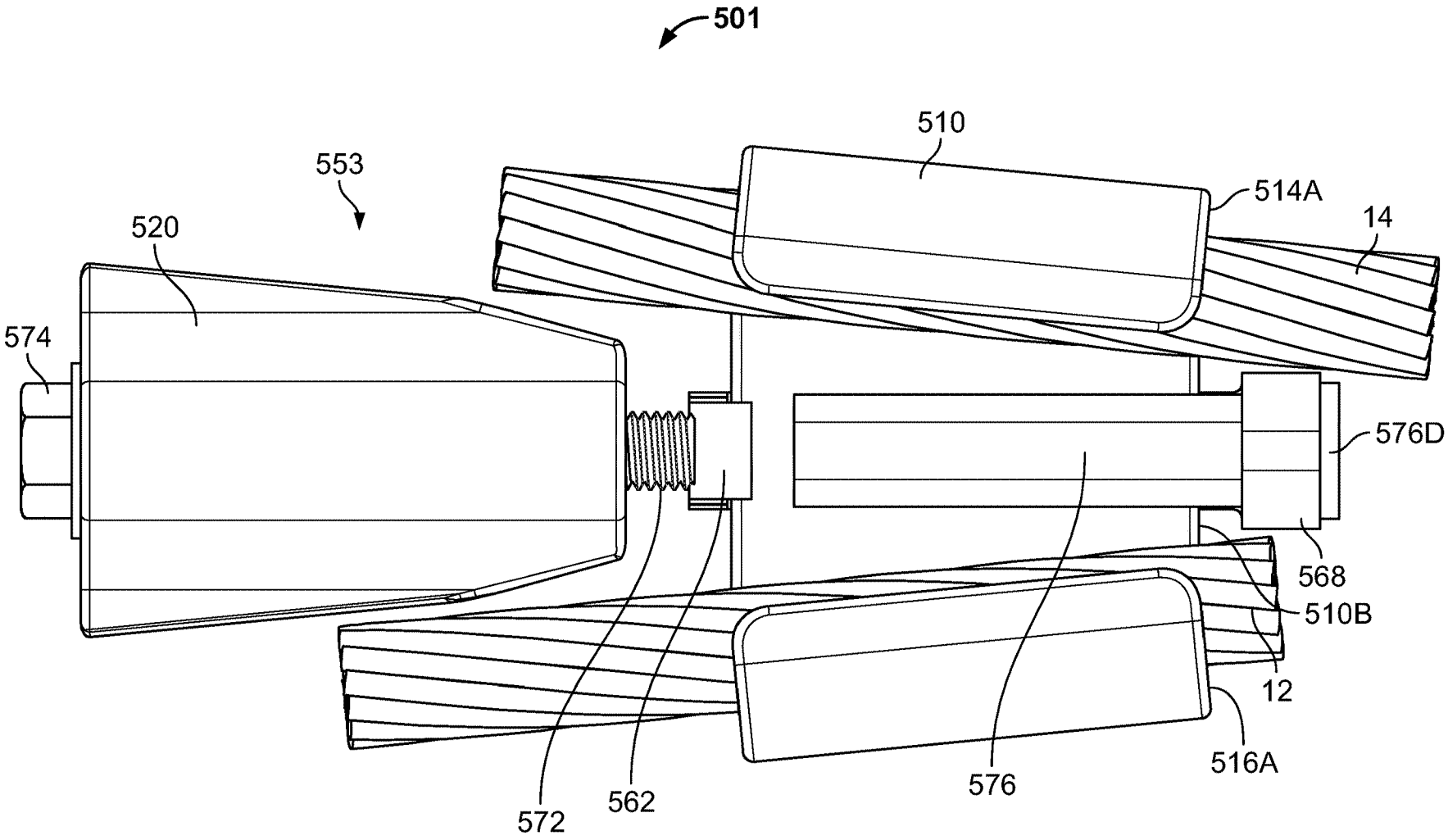
FIG. 20 is side view of the wedge connector system of FIG. 15 mounted on a pair of conductors, wherein the wedge connector system is in an open position.

In order to assemble the wedge connector assembly 500, the lock member 550 is mounted on the sleeve member 510 as shown in FIG. 20 such that the rear edge of the sleeve member 510 is received and captured in the slot 562A. The lock member body 552 extends along the outside of the sleeve member connecting portion 512. The boss 568 is positioned at the front end 510B of the sleeve member 510.

The nut 576 is inserted through the bore 568A. The washer 578 is mounted on the shaft 572 of the bolt 570 and the shaft 572 is then is inserted through the bore 536A. The retainer clip 584 is then mounted on the shaft 572 in the slot 579. The bolt 570 is thereby secured in the wedge member 520 to form a wedge subassembly 553 that is held together by the retainer clip 584 and the bolt head 574.

In some embodiments, the wedge subassembly 553 is assembled at the factory and provided to the end user or installer assembled. In other embodiments, the wedge subassembly 553 is assembled by the end user and, in some embodiments, is assembled onsite at the location of the tap installation by the installer.

As shown in FIG. 20, the C-shaped sleeve member 510 is placed over the conductor 12 such that the conductor 12 is received in the side channel 516A. The conductor 14 is placed in the other side channel 514A.

The wedge subassembly 553 is partially inserted into the cavity between the conductors 12, 14 such that the conductors 12, 14 are received in the opposed grooves 524A, 526A of the wedge member 520. The wedge member 520 may be forced into the sleeve member 510 by hand or using a hammer or the like to temporarily hold the wedge member 520 and the conductors 12, 14 in position. This may cause the nut 576 to slide forwardly in the boss 568 and protrude forwardly beyond the boss 568. When mated with the C-shaped sleeve member 510, the lock member 550 has clearances between the lock member body 552 and the rear wall of the C-shaped sleeve member 510 and between the features 562, 568 and the ends of the C-shaped sleeve member 510 to allow relative movement between the lock member 550 and the C-shaped sleeve member 510 during installation of the conductors 12, 14. This allows the wedge subassembly 553 to be temporarily secured in the sleeve member 510 (e.g., by hand or using a hammer) as described.

Figure 21:
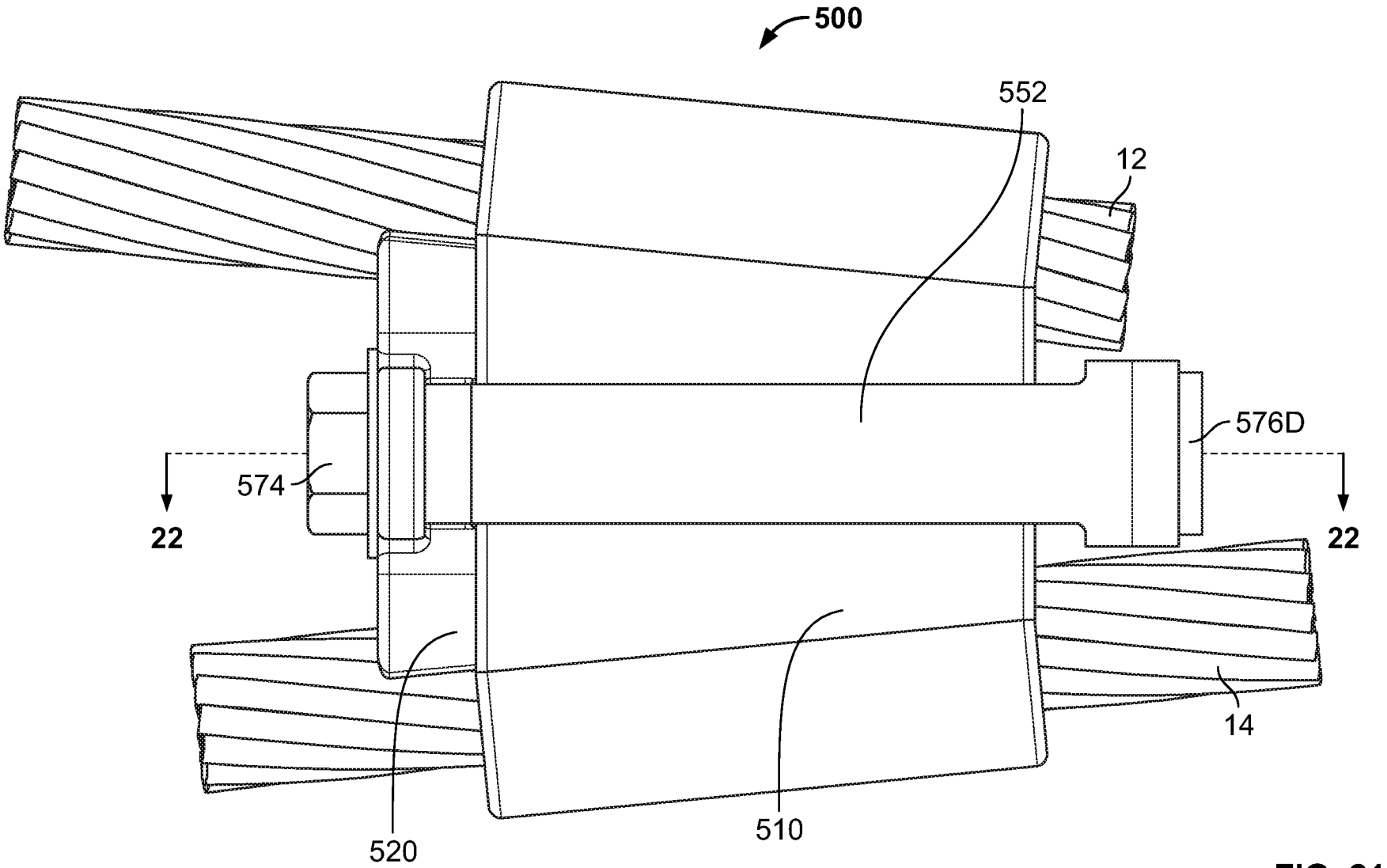
FIG. 21 is a side view, from a side opposite the view of FIG. 20, of a connection including the wedge connector assembly formed from the wedge connector system of FIG. 15.
Figure 22:
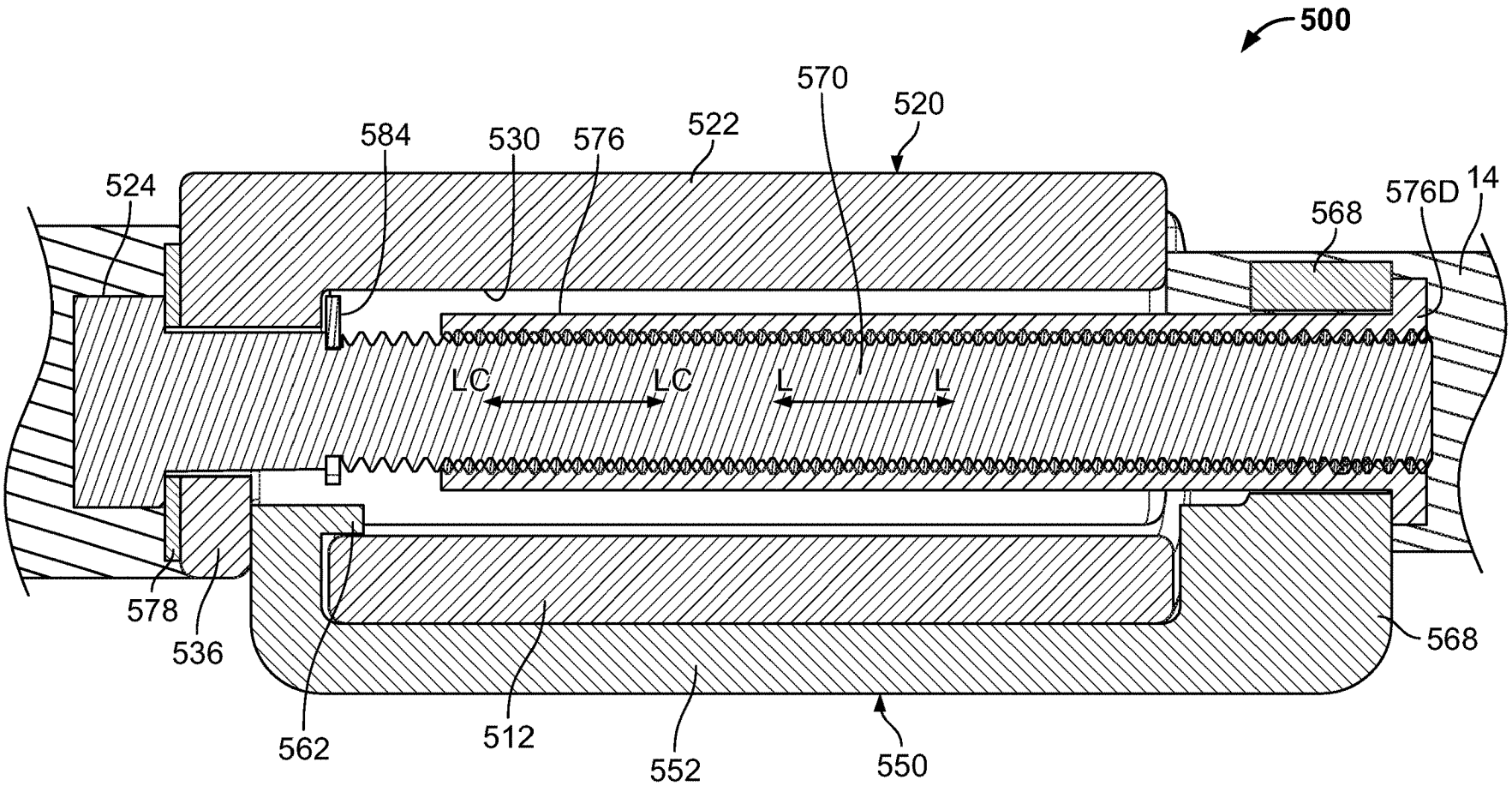
FIG. 22 is a cross-sectional view of the connection of FIG. 21 taken along the line 22-22 of FIG. 21.
Figure 23:
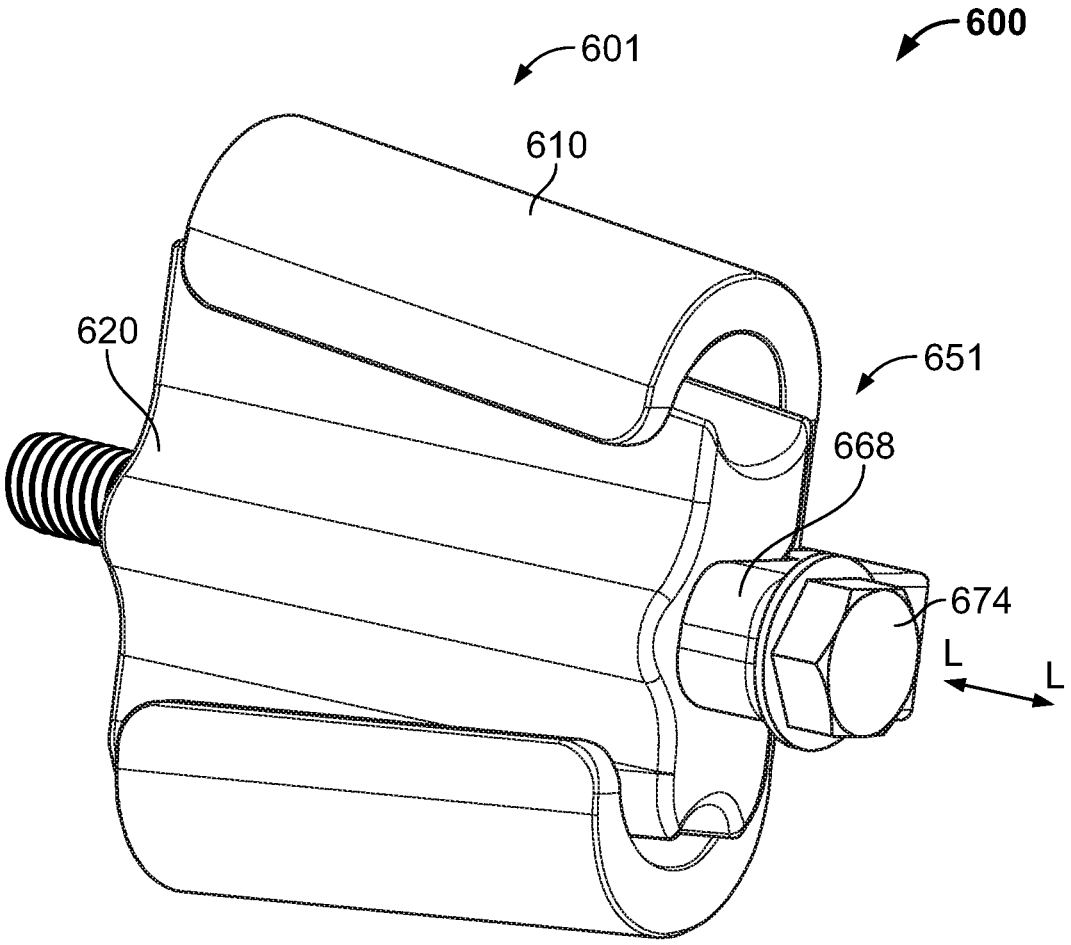
FIG. 23 is a front perspective view of a wedge connector system and wedge connector assembly according to further embodiments of the invention.
Figure 24:
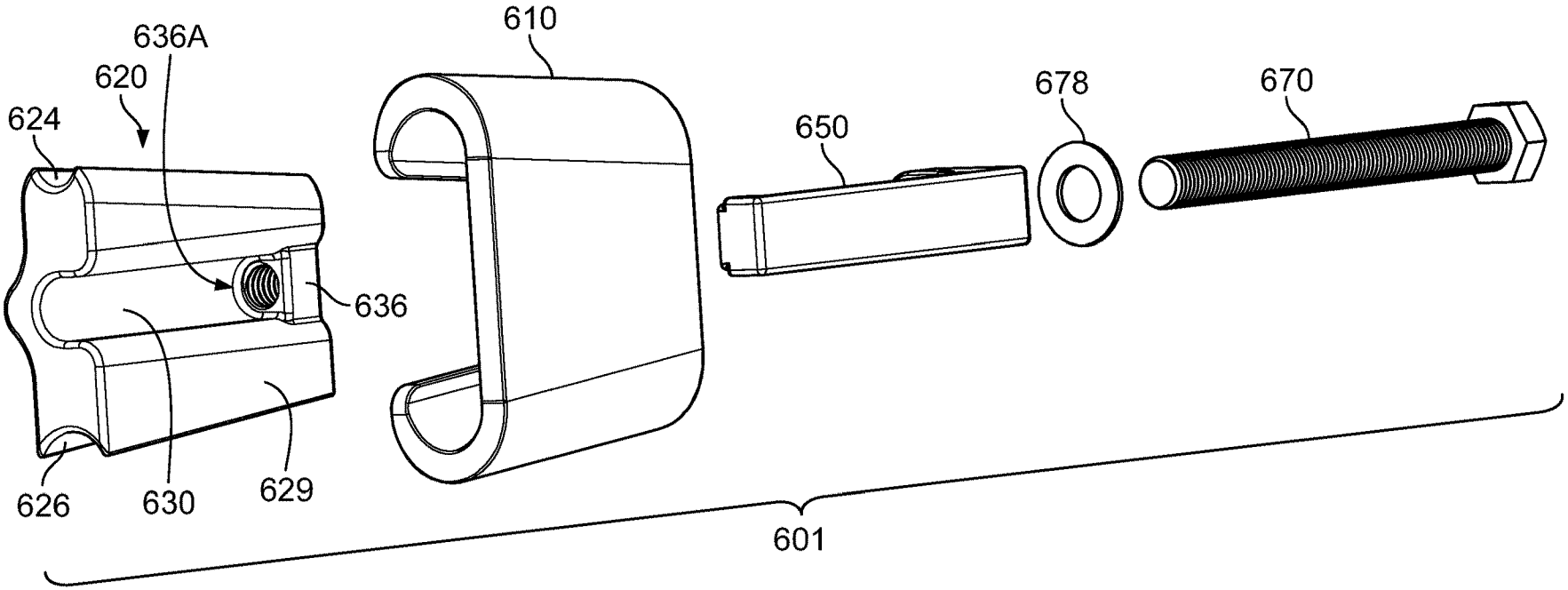
FIG. 24 is an exploded, rear perspective view of the wedge connector system of FIG. 23.
Figure 25:
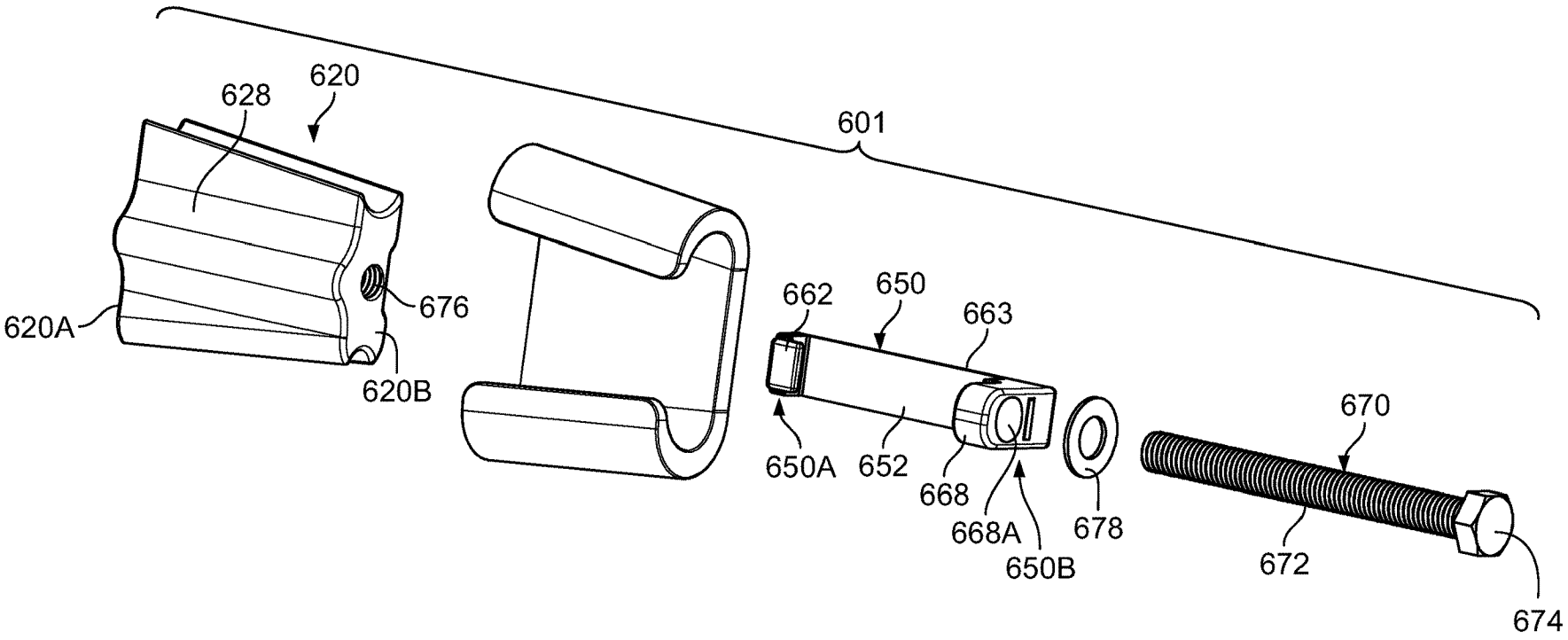
FIG. 25 is an exploded, front perspective view of the wedge connector system of FIG. 23.
Figure 26:
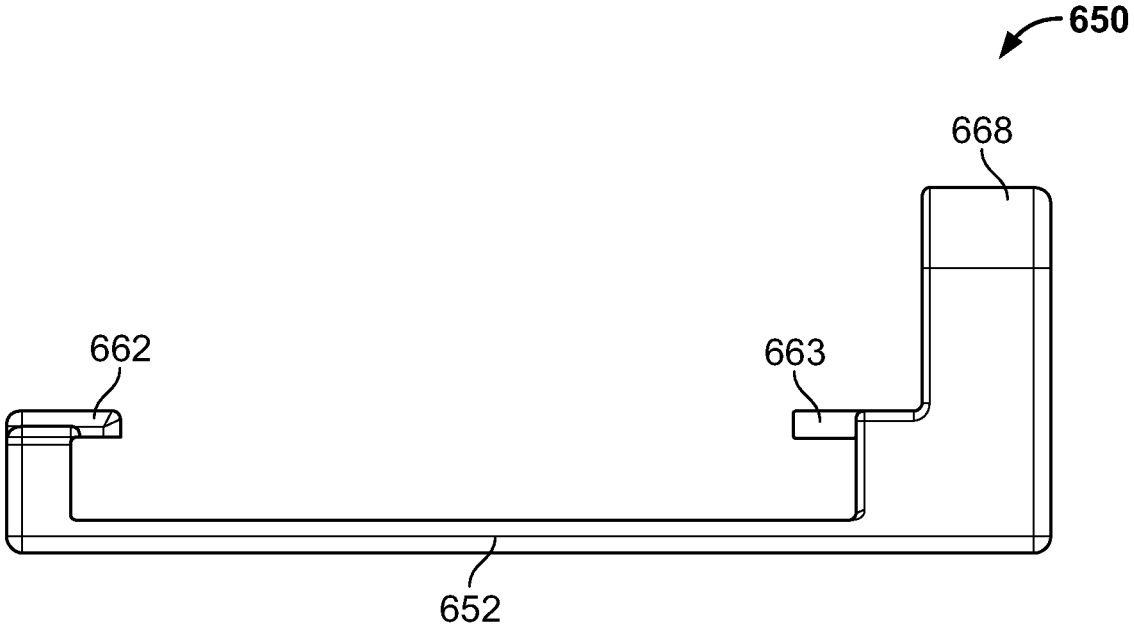
FIG. 26 is a side view of a lock member forming a part of the wedge connector system of FIG. 23.

The front end of the bolt 570 is then threadedly engaged with the nut 576. The nut 576 is prevented from rotation with the bolt 570 by the flats 568C, 576B. As the bolt 570 is rotated (e.g., using a driver 32 and tool 30 as shown in FIG. 2), the nut 576 is drawn axially further into the bore 568A until the stop feature 568D abuts the boss 568. The bolt 570 is rotated (e.g., using driver 32 and tool 30) so that the nut 576 is axially anchored and the bolt 570 forcibly pulls the wedge member 520 into the sleeve member 510 until the wedge member 520 is in a desired final position to form the connection as shown in FIGS. 21 and 22. The boss 568 rotationally fixes or locks the nut 576 for torqueing the bolt 570 during assembly. The boss 536 can act as a hard stop to limit insertion of the wedge member 520. The connection 10 may be formed by forming interference fits between the wedge member 520, the C-shaped sleeve member 510 and the conductors 12, 14. Moreover, the wedge member 520 is secured in place by the lock member 550.

As discussed above with regard to the wedge connector system 101, the wedge member 520, the sleeve member 510 and/or the conductors 12, 14 may be deformed. The C-shaped sleeve member 510 may be elastically deformed so that it applies a bias or spring force against the wedge member 520 and the conductors 12, 14. The sleeve member 510 may be plastically deformed.

The connector system 501 can be removed and disassembled by rotating the bolt 570 counterclockwise to force the nut 576 to move axially forwardly and away from the bolt head 574. The retainer clip 584 and the front boss 568 cooperate to prevent or limit relative axial displacement between the bolt 570 and lock member 550 and the sleeve member 510. As a result, the bolt rotation force displaces the nut 576 forwardly (along the axis LC-LC) relative to the sleeve member 510. The bolt 570 is rotated in this manner until the stop feature 576D is spaced a short distance (e.g., about 0.5 inch) from the boss 568 and the threads of the bolt 570 remain threadedly engaged with the threads of the nut 576. The front end of the nut 576 is then struck (e.g., by a hammer) to drive the bolt 570 rearwardly. Because the bolt 570 is axially constrained by the retainer clip 584, the drive force is thereby applied to the wedge member 520 to drive the wedge member 520 rearwardly relative to the sleeve member 510. In this way, the sleeve member 510 and the wedge member 520 are freed from one another and the connection.

With reference to FIGS. 23-29, a wedge connector system 601 and a wedge connector assembly 600 according to further embodiments is shown therein. The connector assembly 600 corresponds to and may be used in the same manner as the connector assembly 500, except as discussed below. The connector assembly 600 includes a sleeve member 610 and a wedge member 620, corresponding to the sleeve member 510 and the wedge member 520, respectively. The connector assembly 600 includes a drive/lock mechanism 651. The sleeve member 610 and the wedge member 620 are movable relative to one another to cooperatively mechanically capture the conductors 12, 14 therebetween and electrically connect the conductors 12, 14 to one another.

The wedge member 620 includes a body 622 having opposed, arcuate clamping side faces or walls 624, 626, opposed end faces or walls 623, 625, and opposed outer and inner faces or walls 628, 629. The wedge member 620 tapers inwardly from a relatively wide rear end 620A to a relatively narrow front end 620B.

An axially extending alignment slot 630 is defined in the inner wall 629.

An integral boss 636 is located proximate the front end 620B. The boss 636 projects outwardly from the body 622 in a direction transverse (e.g., perpendicular) to the connector axis L-L and toward the sleeve member 610. A bore 636A extends through the boss 636 substantially parallel to the axis L-L.

The lock mechanism 651 includes a lock member 650, a first drive member 670, a cooperating second drive member 676, and a washer 678. In some embodiments and as shown, the first drive member is a drive bolt 670. In some embodiments and as shown, the second drive member is an internal screw thread 676 formed in the bore 636A. In other embodiments, the screw thread 676 may be formed in a nut rotationally and axially secured within the bore 636A. The drive bolt 670 and the threaded bore 636A operate as a clamping mechanism The lock member 650 extends from a rear end 650A to a front end 650B along a lock member axis LC-LC. The lock member 650 includes a longitudinally extending body 652, an integral rear engagement or hook portion 662, an integral front hook portion 663, and an integral front brace portion 668.

The rear hook portion 662 is located on the rear end 650A. The hook portion 662 defines a slot 662A.

The integral front brace portion 668 is a boss located on the front end 650B and projects laterally away from the connecting wall 612 of the sleeve member 610. The front brace portion 668 includes a bore 668A. The inner diameter of the bore 668A is dimensioned to permit the drive bolt 670 to spin freely. The front hook portion 663 projects rearwardly from the brace portion 668.

The bolt 670 has an externally threaded cylindrical shank, rod or shaft 672 and an integral driver engagement feature 674 on the front end of the shaft 672. The driver engagement feature 674 may be provided in the form of a geometric head (e.g., a hexagonal faceted head) or a geometric socket. The drive head 674 may be a hex head as illustrated, for example.

The sleeve member 610, wedge member 620, lock member 650, and bolt 670 may be formed of materials and using techniques as described above for the sleeve member 110, wedge member 120, lock member 150, bolt 170, and nut 176.

Exemplary methods for assembling and using the connector assembly 600 in accordance with embodiments of the present invention will now be described.

Figure 27:
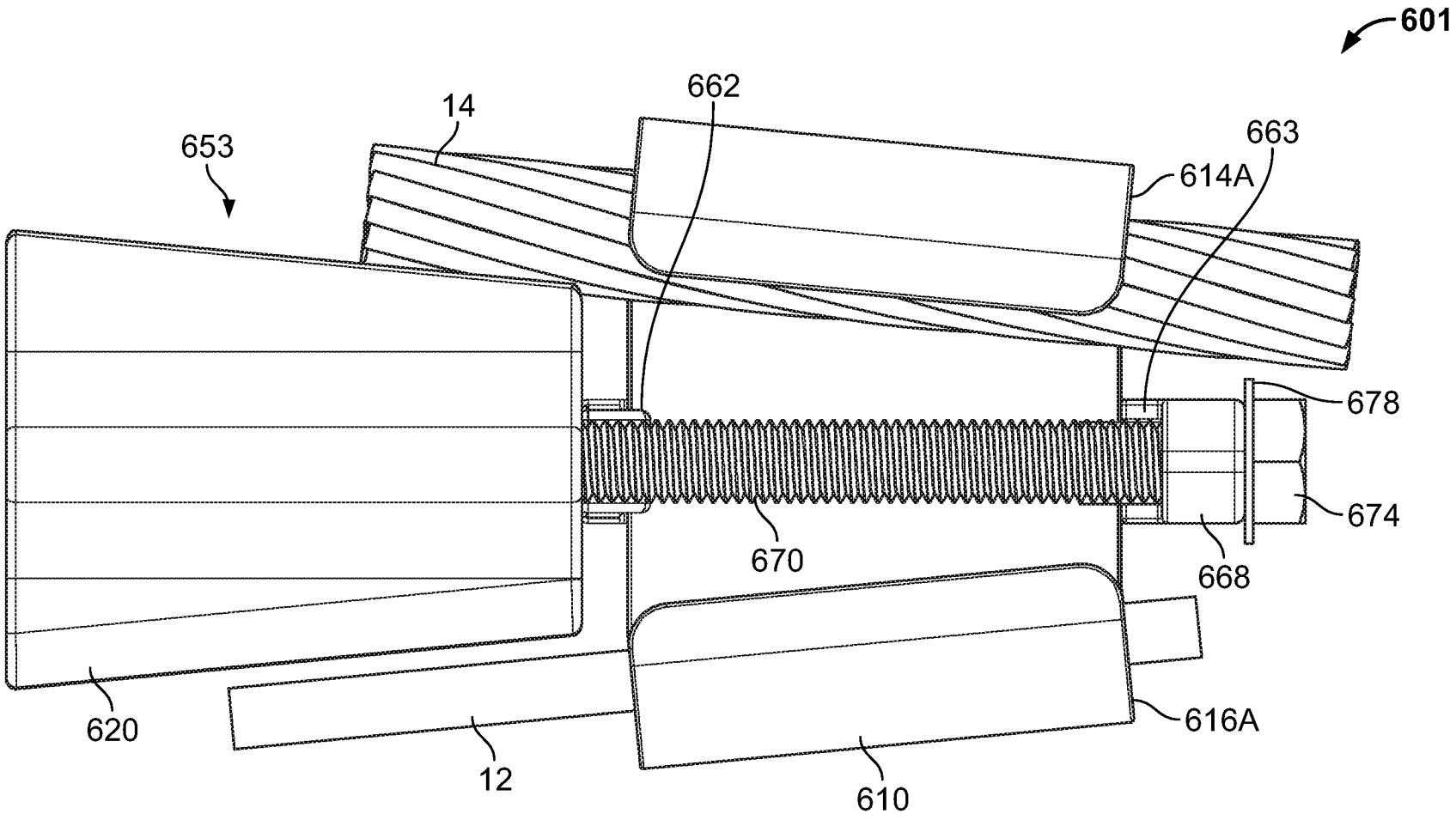
FIG. 27 is side view of the wedge connector system of FIG. 23 mounted on a pair of conductors, wherein the wedge connector system is in an open position.

In order to assemble the wedge connector assembly 600, the lock member 650 is mounted on the sleeve member 610 as shown in FIG. 27 such that the rear edge of the sleeve member 610 is received and captured in the slot 662A and the front edge of the sleeve member 610 is captured by the front hook portion 663. The lock member body 652 extends along the outside of the sleeve member connecting portion 612. The brace portion 668 is positioned at the front end 610B of the sleeve member 610.

The washer 678 is mounted on the shaft 672 of the bolt 670 and the shaft 672 is then is inserted through the bore 668A. The bolt 670 is threaded into the threaded bore 636A of the wedge member 620. The bolt 670 is thereby secured in the wedge member 620 and the lock member 650 to form a wedge subassembly 653.

In some embodiments, the wedge subassembly 653 is assembled at the factory and provided to the end user or installer assembled. In other embodiments, the wedge subassembly 653 is assembled by the end user and, in some embodiments, is assembled onsite at the location of the tap installation by the installer.

As shown in FIG. 27, the C-shaped sleeve member 610 is placed over the conductor 12 such that the conductor 12 is received in the side channel 616A. The conductor 14 is placed in the other side channel 614A.

The wedge subassembly 653 is inserted into the cavity between the conductors 12, 14 such that the conductors 12, 14 are received in the opposed grooves 624A, 626A of the wedge member 620. The wedge member 620 may be forced into the sleeve member 610 by hand or using a hammer or the like to temporarily hold the wedge member 620 and the conductors 12, 14 in position.

Figure 28:
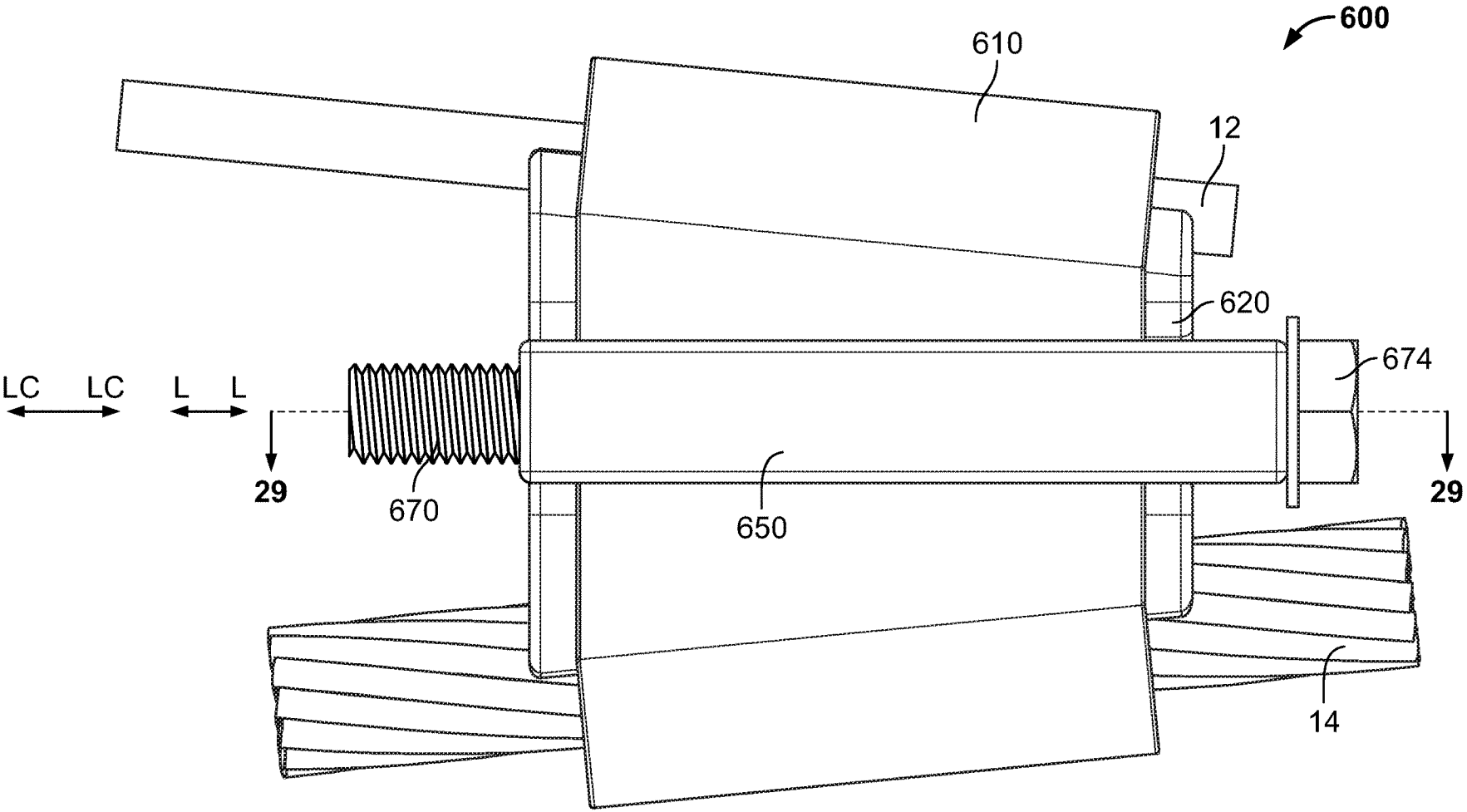
FIG. 28 is a side view, from a side opposite the view of FIG. 27, of a connection including the wedge connector assembly of FIG. 23.
Figure 29:
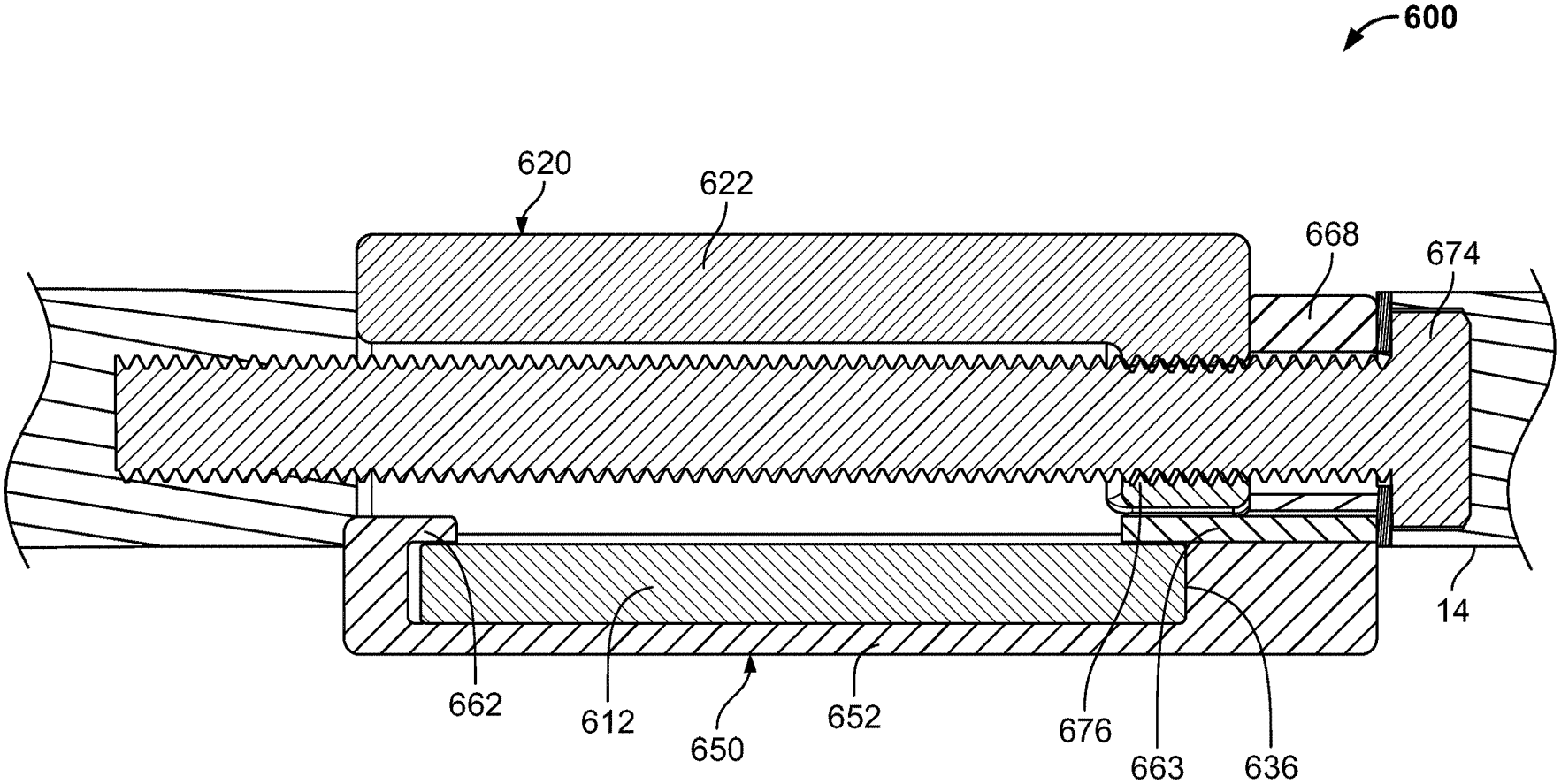
FIG. 29 is a cross-sectional view of the connection of FIG. 28 taken along the line 29-29 of FIG. 28.

The bolt 670 is then further rotated (e.g., using a driver 32 and tool 30 as shown in FIG. 2), so that the bolt head 674 loads against the brace portion 668 and the bolt 670 forcibly pulls the wedge member 620 forwardly into the sleeve member 610 until the wedge member 620 is in a desired final position to form the connection as shown in FIGS. 28 and 29. The connection 10 may be formed by forming interference fits between the wedge member 620, the C-shaped sleeve member 610 and the conductors 12, 14. Moreover, the wedge member 620 is secured in place by the lock member 650.

As discussed above with regard to the wedge connector system 101, the wedge member 620, the sleeve member 610 and/or the conductors 12, 14 may be deformed. The C-shaped sleeve member 610 may be elastically deformed so that it applies a bias or spring force against the wedge member 620 and the conductors 12, 14. The sleeve member 610 may be plastically deformed.

The connector system 601 can be removed and disassembled by rotating the bolt 670 counterclockwise. This forces the bolt 670 to back out or move axially forwardly (along the axis LC-LC) relative to the sleeve member 610 and away from the wedge member 620 and the brace portion 668. The bolt 670 is rotated in this manner until the bolt head 674 is spaced a short distance (e.g., about 0.5 inch) from the brace portion 668. The bolt head 674 is then struck (e.g., by a hammer) to drive the bolt 670 rearwardly. Because the bolt 670 is axially constrained with respect to the wedge member 620 by the mated threads of the bolt 670 and the bore 636A, the drive force is thereby applied to the wedge member 620 to drive the wedge member 620 rearwardly relative to the sleeve member 610. In this way, the sleeve member 610 and the wedge member 620 are freed from one another and the connection.

Figure 30:
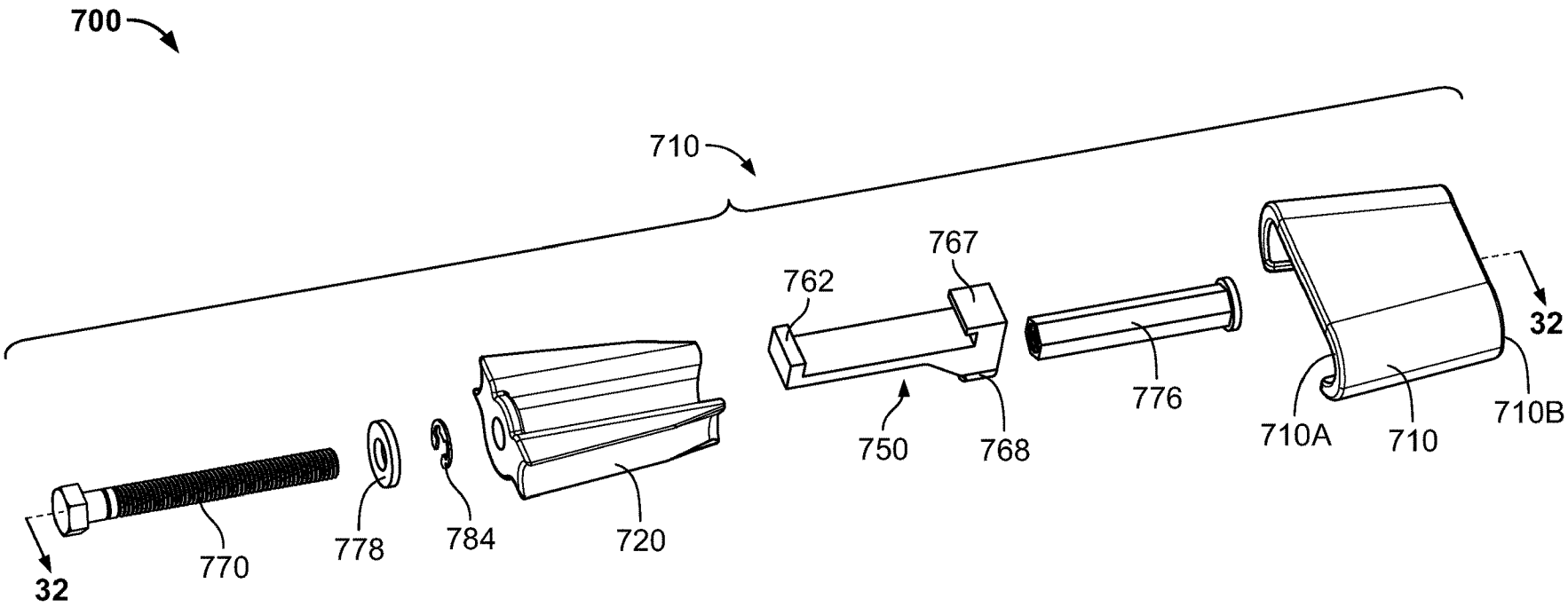
FIG. 30 is an exploded, rear perspective view of a wedge connector system according to further embodiments of the invention.
Figure 31:
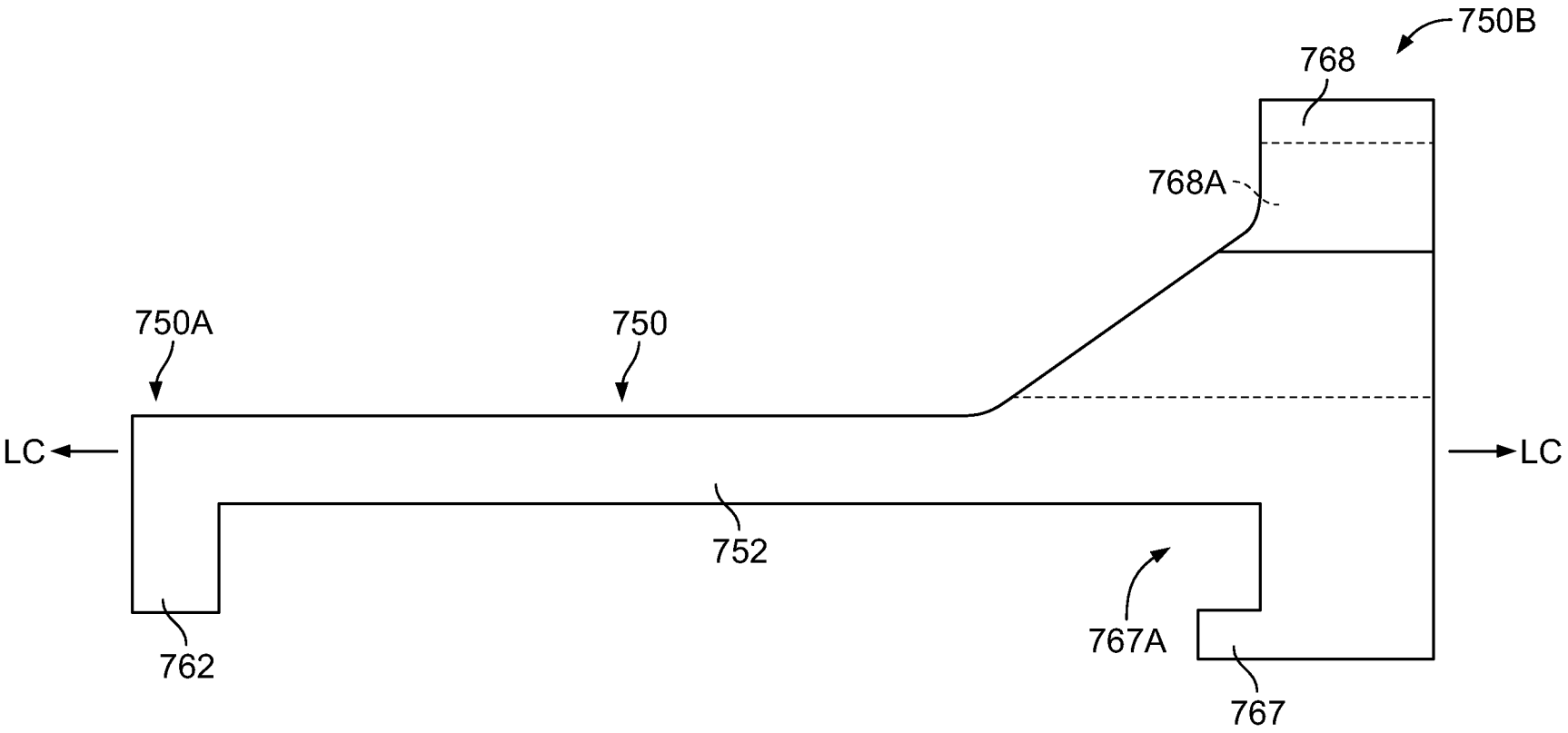
FIG. 31 is a side view of a lock member forming a part of the wedge connector system of FIG. 30.
Figure 32:
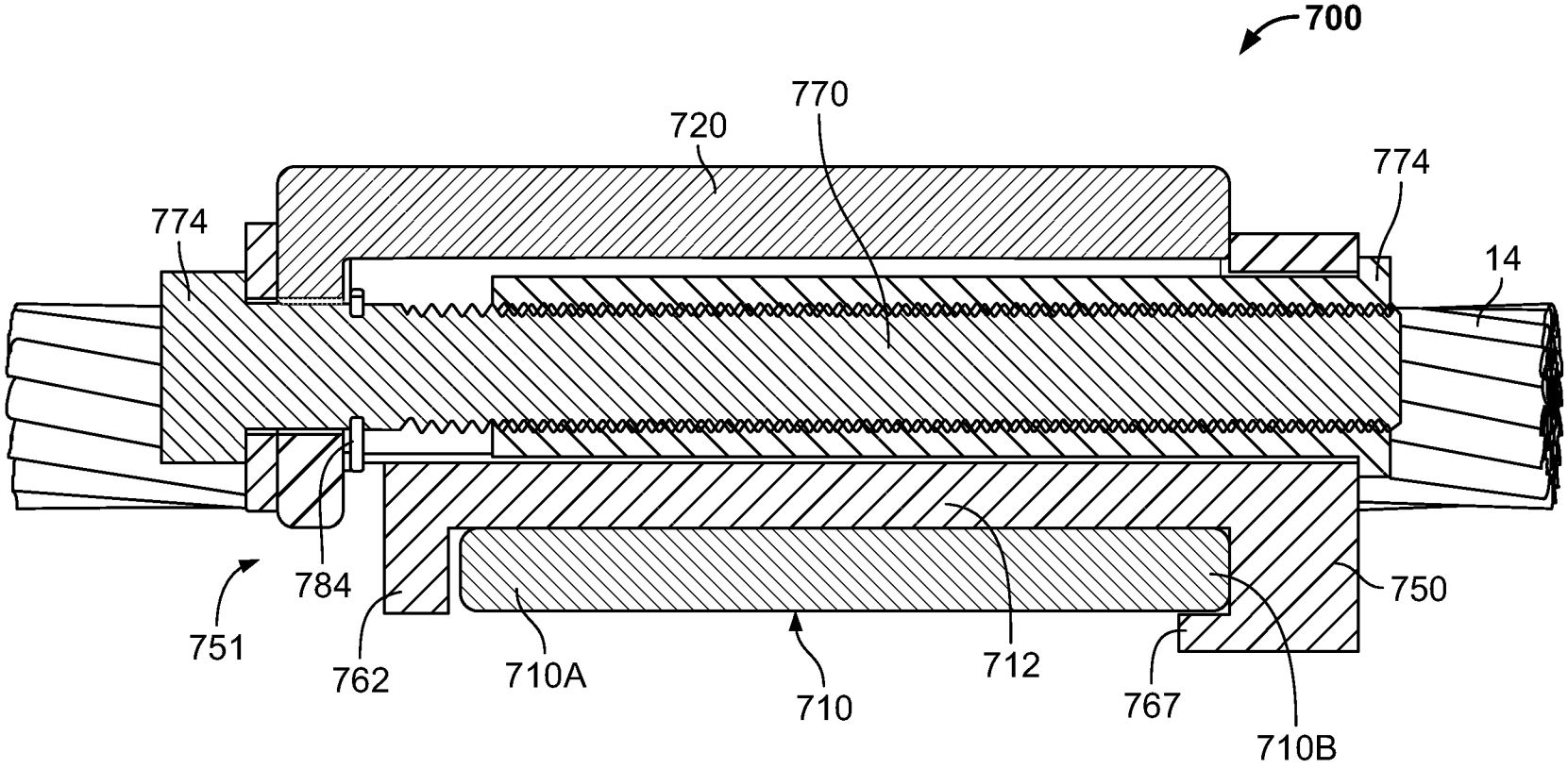
FIG. 32 is a cross-sectional view of a connection including the wedge connector system of FIG. 30 taken along the line 32-32 of FIG. 30.

With reference to FIGS. 30-32, a wedge connector system 701 and a wedge connector assembly 700 according to further embodiments is shown therein. The connector assembly 700 corresponds to and may be used in the same manner as the connector assembly 500, except as discussed below. The connector assembly 700 includes a sleeve member 710 and a wedge member 720, corresponding to the sleeve member 510 and the wedge member 520, respectively. The connector assembly 700 includes a drive/lock mechanism 751. The sleeve member 710 and the wedge member 720 are movable relative to one another to cooperatively mechanically capture the conductors 12, 14 therebetween and electrically connect the conductors 12, 14 to one another.

The lock mechanism 751 includes a lock member 750, a first drive member 770, a cooperating second drive member 776, a washer 778, and a retainer clip 784. In some embodiments and as shown, the first drive member is a drive bolt 770 and the second drive member is a nut 776. The drive bolt 770 and the nut 776 operate as a clamping mechanism.

The lock member 750 extends from a rear end 750A to a front end 750B along a lock member axis LC-LC. The lock member 750 includes a longitudinally extending body 752, an integral rear engagement or stop portion 762, an integral front engagement or hook portion 767, and an integral nut holder portion 768.

The stop portion 762 is located on the rear end 750A. The hook portion 767 is located on the front end 750B. The hook portion 767 defines a slot 767A. The stop portion 762 and the hook portion 767 project laterally toward the connecting wall 712 of the sleeve member 710 when the connector is assembled.

The nut holder portion 768 is a boss located on the front end 750B and projects laterally away from the connecting wall 712 of the sleeve member 710 when the connector is assembled. The nut holder portion 768 includes a bore 768A. Anti-rotation features in the form of flats are located in the bore 768A and define a hexagonal passage.

The retainer clip 784 is seated in an annular retainer ring mount slot 779 defined in the outer surface of the bolt 770 proximate the head 774. The retainer clip 784 is thereby positioned on front side of the boss 736, opposite the bolt head 774. The retainer clip 784 permits the bolt 770 to rotate about the bolt's lengthwise axis relative to the boss 736, but limits relative rearward axial displacement of the bolt 770 relative to the boss 736. In this way, the retainer clip 784 prevents the bolt from moving rearwardly out of the boss 736 beyond a relatively short prescribed distance. Other retention devices (e.g., a split pin) or features may be used in addition to or in place of the retainer clip 784 to axially constrain the bolt 770 relative to the wedge member 720 while permitting the bolt 770 to rotate relative to the wedge member 720.

The nut 776 is constructed in the same manner as the nut 576, except that the forward end of the bore terminates at an opening 776E so that the bolt 770 can extend fully through and beyond the front end of the nut 776. The nut 776 is seated in the bore 768A and functions in the same manner as described for the nut 576 and the bore 568A.

The sleeve member 710, wedge member 720, lock member 750, bolt 770, and nut 776 may be formed of materials and using techniques as described above for the sleeve member 110, wedge member 120, lock member 150, bolt 170, and nut 176.

The connector assembly 700 can be used in the same manner as the connector assembly 500, except as follows. The longitudinally extending body 752 is interposed laterally between the wedge member 720 and the connecting wall 712 of the sleeve member 710. The stop portion 762 is located adjacent and may abut the rear end 710A of the sleeve member 710. The hook portion 767 is located adjacent and receives the front end 710B of the sleeve member 710 in the slot 767A when the connector is assembled. The construction of the connector assembly 700 may allow for or facilitate use with other accessories such as hot-sticks.

The connector system 701 can be removed and disassembled by rotating the bolt 770 counterclockwise to force the nut 776 to move axially forwardly and away from the bolt head 774, and then striking (e.g., with a hammer) the front end of the nut 576 to drive the bolt 570 rearwardly, as described above for the connector system 501.

With reference to FIGS. 33-39, a wedge connector system or kit 801 and a wedge connector assembly 800 according to further embodiments is shown therein. The connector assembly 800 corresponds to and may be used in the same manner as the connector assembly 700, except as discussed below.

The wedge connector system 801, and the wedge connector assembly 800 formed therefrom, include a C-shaped channel or sleeve member 810, a wedge member 820, a clamp member 850, a drive member 870, and a washer 878. The sleeve member 810 and the wedge member 820 are movable relative to one another to cooperatively mechanically capture the conductors 12, 14 therebetween and electrically connect the conductors 12, 14 to one another.

The assembled connector assembly 800 has a lengthwise axis L-L and a transverse axis M-M.

The sleeve member 810 corresponds to the sleeve member 710.

The wedge member 820 has corresponds to the wedge member 720 except as shown and discussed below.

An axially extending receiver slot 832 is defined in the inner wall 829.

Figure 35:
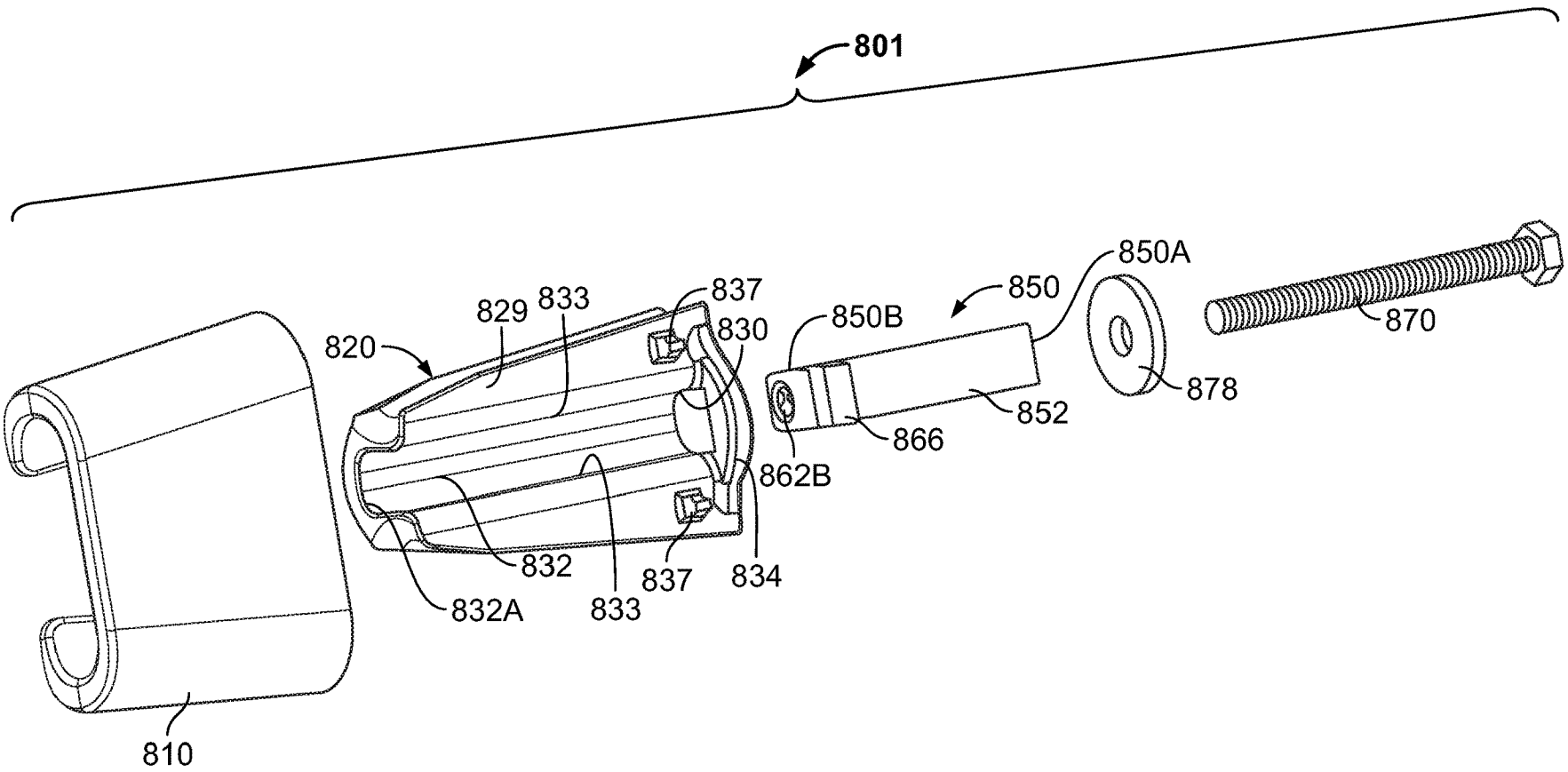
FIG. 35 is an exploded, front perspective view of the wedge connector system of FIG. 33.

The wedge member 820 includes integral anti-rotation features 833 in the receiver slot 832. In some embodiments and as shown, the anti-rotation features are a pair of opposed sidewall surfaces 833 (FIG. 35).

An integral end wall 836 is located proximate the rear end 820A. The end wall 836 projects inwardly from the body 822 in a direction transverse (e.g., perpendicular) to the connector axis L-L.

A keyhole or through hole 830 extends through the end wall 836 substantially parallel to the axis L-L. In some embodiments, the through hole 830 is nonthreaded. An integral inner lip or flange 834 forming a part of the end wall 836 extends below the through hole 830 and inwardly beyond the body 822 and the receiver slot 832.

Two integral stop features 837 project inwardly from the body 822 in a direction transverse (e.g., perpendicular) to the connector axis L-L. The stop features 837 are laterally spaced apart and are disposed on opposite sides of the receiver slot 832. Each of the stop features 837 is axially spaced apart from the flange 834 and end wall 836 to define a gap 837A between the front side of the stop feature 837 and the end wall 836. In some embodiments, the gap 837A has a width W1 (FIG. 37) in the range of from about 7/16 in. to 5/8 in.

Figure 36:
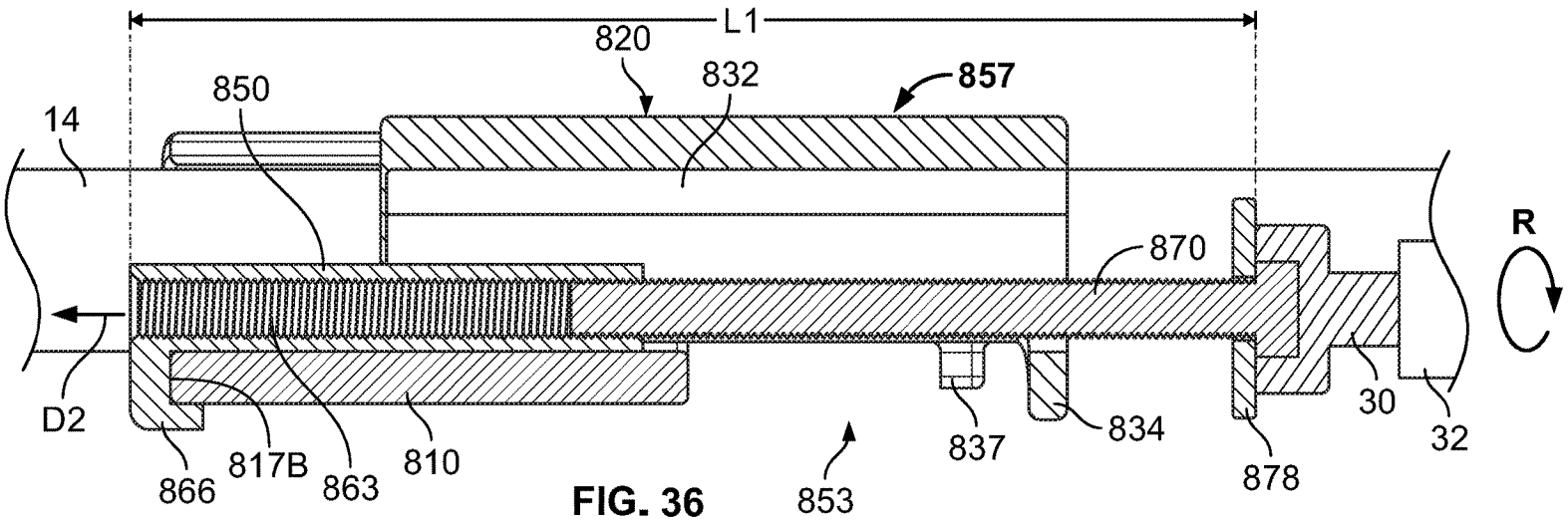
FIG. 36 is a cross-sectional view of the wedge connector system of FIG. 33 mounted on a pair of conductors, wherein the wedge connector system is in an open position and positioned to install a wedge member in a sleeve member of the wedge connector system.

With reference to FIGS. 35 and 36, the clamp member 850 extends from a rear end 850A to a front end 850B along a clamp member axis LC-LC. The clamp member 850 includes a body 852, an integral bolt receiving bore 860, and an integral hook or engagement portion 866.

The body 852 includes integral anti-rotation features 868. In some embodiments, the anti-rotation features 868 are a pair of opposed sidewall surfaces 868 (FIG. 34) spaced apart and shaped to co-operate with the anti-rotation features 833, as discussed below.

The bolt receiving bore 860 extends substantially parallel to the axis LC-LC fully from end 850A to end 850B, and terminates at openings 862A and 862B. An internal screw thread 863 is provided in the bore 860.

The hook feature 866 is located on the front end 850B and extends inwardly. The hook feature 866 defines a hook slot 866A.

In some embodiments and as shown, the drive member is a drive bolt 870. The bolt 870 has an externally threaded cylindrical shank, rod or shaft 872 and an integral driver engagement feature 874 on the rear end of the shaft 872. The driver engagement feature 874 may be provided in the form of a geometric head (e.g., a hexagonal faceted head) or a geometric socket. The drive head 874 may be a hex head as illustrated, for example.

The sleeve member 810, the wedge member 820, the clamp member 850, and the bolt 870 may be formed of materials as described above for the sleeve member 710, the wedge member 720, the clamp member 750, and the bolt 770.

With reference to FIGS. 36-39, exemplary methods for assembling and using the connector assembly 800 in accordance with embodiments of the present invention will now be described.

The sleeve member 810, the wedge member 820, the clamp member 850, the bolt 870, and the washer 878 may each be manufactured as individual, discrete parts from the others, and thereafter assembled together. Each of the assembly steps may be executed in a factory or by an end user or installer.

Figure 33:
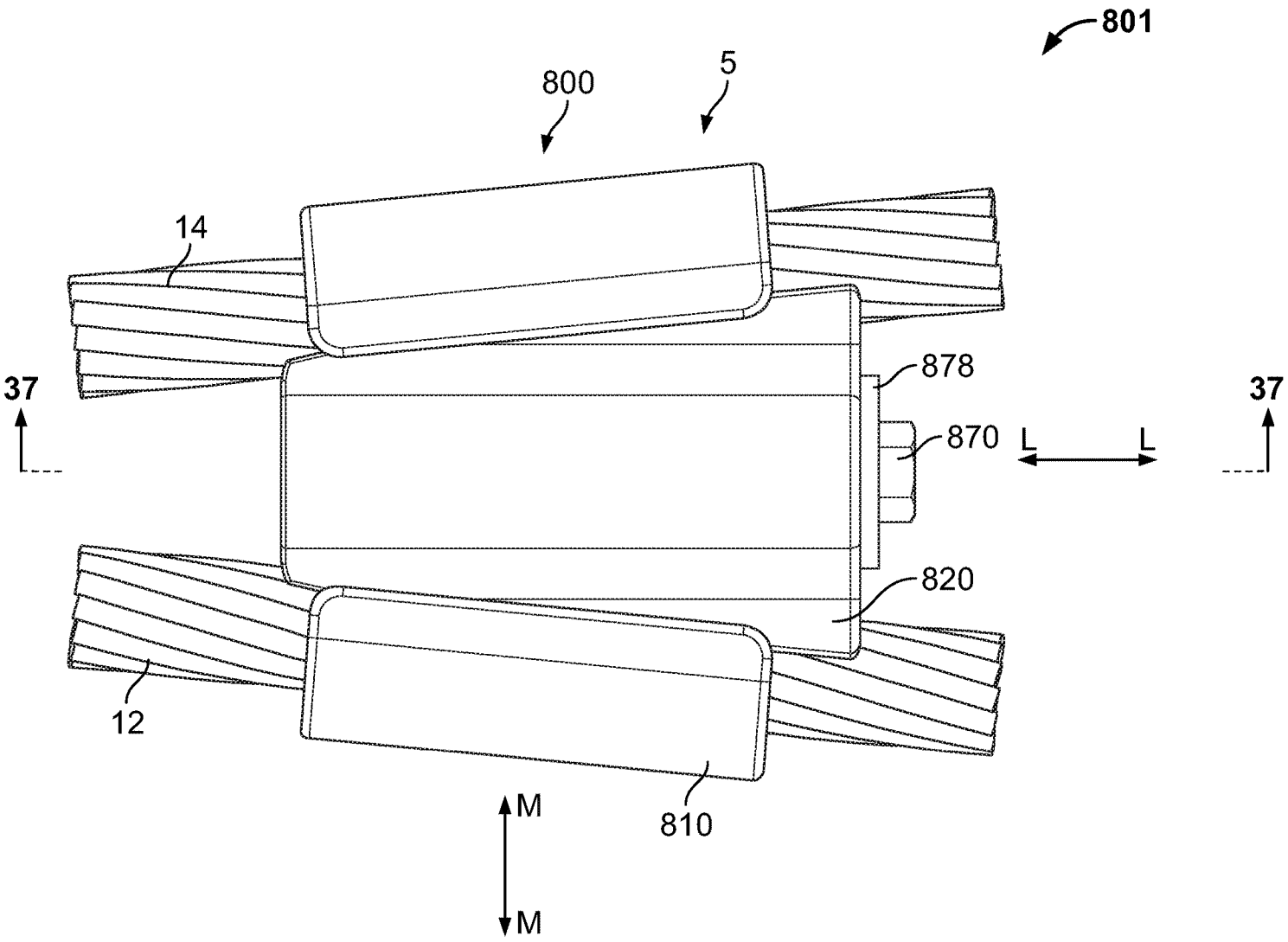
FIG. 33 is a side view of a wedge connector system and wedge connector assembly according to further embodiments of the invention.
Figure 34:
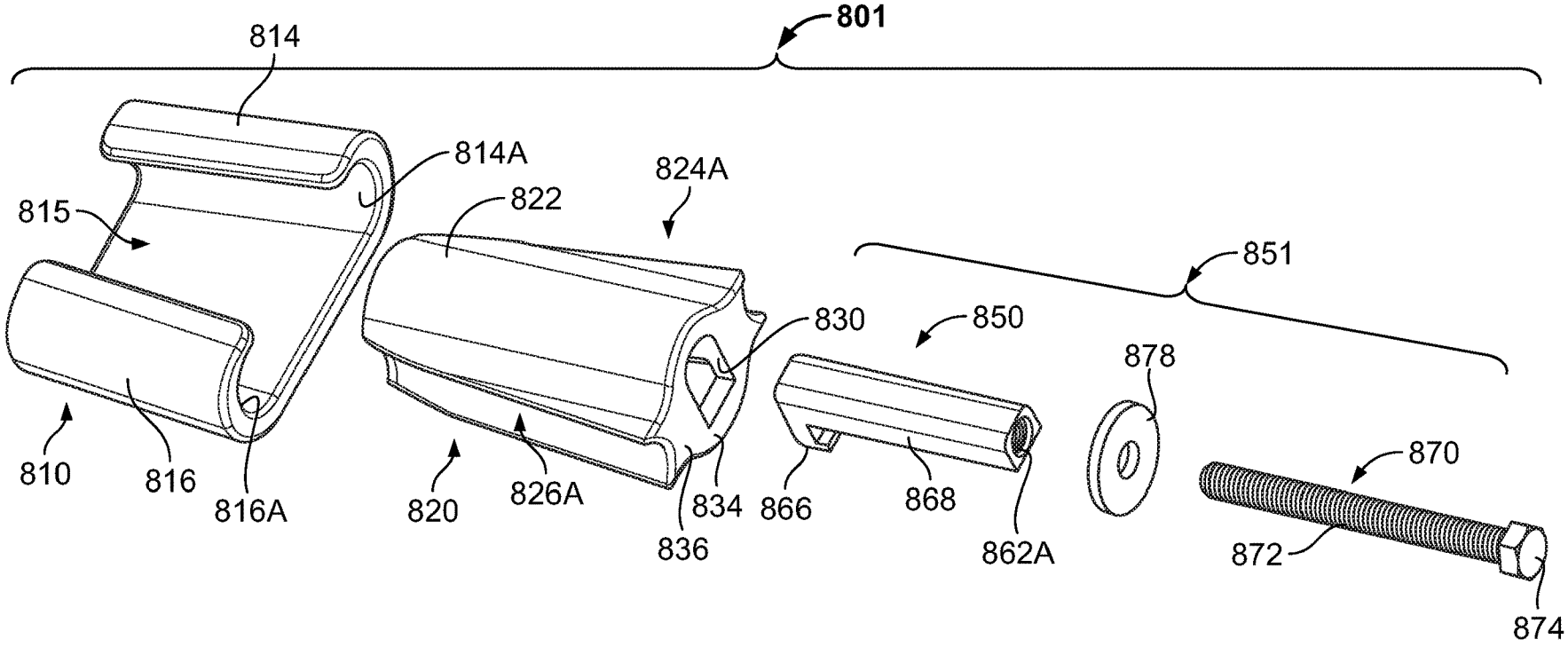
FIG. 34 is an exploded, rear perspective view of the wedge connector system of FIG. 33.

As shown in FIG. 33, the C-shaped sleeve member 810 is placed over the conductor 14 such that the conductor 14 is received in the side channel 814A. The conductor 12 is placed in the other side channel 816A.

As shown in FIG. 33, the wedge member 820 is then partially inserted into the cavity 815 between the conductors 12, 14 such that the conductors 12, 14 are received in the opposed grooves 824A, 826A. The wedge member 820 may be forced into the sleeve member 810 by hand or using a hammer or the like to temporarily hold the wedge member 820 and the conductors 12, 14 in position. This can enable the installer to execute the following installation steps without having to otherwise secure the wedge member 820 in the sleeve member 810.

The clamp member 850, the bolt 870, and the washer 878 are assembled together to form a preassembled clamp subassembly 853 (FIG. 36). More particularly, the shaft 872 of the bolt 870 is inserted through the washer 878 and threadedly engaged in the bore 860.

In some embodiments, the clamp subassembly 853 is assembled at the factory and provided to the end user or installer preassembled. In some embodiments, the clamp subassembly 853 is assembled prior to mounting the wedge member 820 in the sleeve 810 as described above.

However, in other embodiments, the clamp subassembly 853 is assembled by the end user and, in some embodiments, is assembled onsite at the location of the tap installation by the installer. In this case, the clamp subassembly 853 maybe assembled before or after mounting the wedge member 820 in the sleeve 810.

Figure 37:
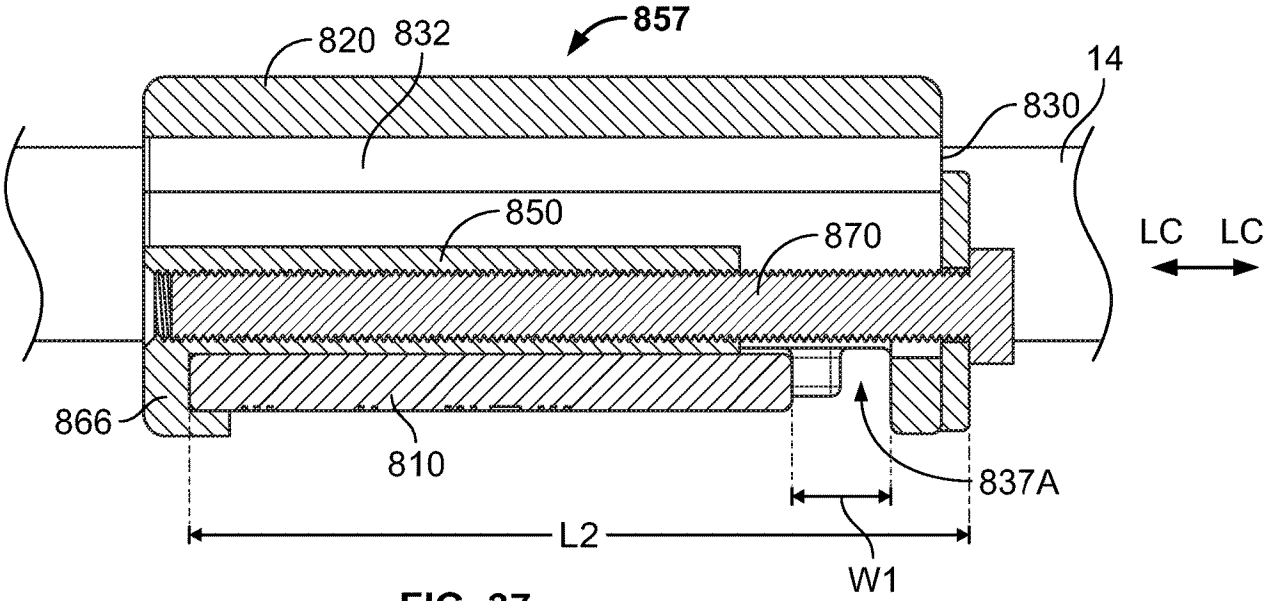
FIG. 37 is a cross-sectional view of the connection of FIG. 33 taken along the line 37-37 of FIG. 33.

The clamp subassembly 853 can assume an open position (as shown in FIG. 36) wherein the clamp member 850 is extended and the front end 850B of the clamp member 850 is spaced a distance L1 from the head 874 of the bolt 870. The clamp subassembly 853 can then assume a closed position (as shown in FIG. 37) wherein the bolt 870 is screwed further into the bore 860 and the front end 850B is spaced a distance L2 the head 174. The distance L2 is less than the distance L1.

With the clamp subassembly 853 in the open position, the clamp subassembly 853 is mounted on the wedge member 820 to form a clamp/wedge subassembly 857 (FIG. 36). More particularly, the clamp member 150 is axially inserted through the through hole 830 and into the receiver slot 832 in a direction D2 (FIG. 36) from the rear end 820A to the front end 820B. The clamp member 850 is further inserted through the receiver slot 832 between the wedge member 820 and the sleeve 810 until the hook feature 866 clears the front edge 817B of the sleeve 810. The hook portion 866 then drops over the front edge 817B and is pulled rearward to capture the front edge 817B in the hook slot 866A, as shown in FIG. 36. Over-insertion of the clamp member 850 is prevented by the bolt head 874 of the clamp subassembly 853.

The bolt 870 is then rotated (e.g., by hand or using the tool 30 with or without the driver 32 engaging the head 874) in a direction R relative to the clamp member 150. Advantageously, the head 874 is accessible for engagement with the tool 30 from the rear side of the wedge member 820. The anti-rotation features 833 of the wedge member 820 engage and cooperate with the anti-rotation features 868 of the clamp member 850 to prevent the clamp member 850 from rotating with the bolt 870 and to prevent the hook portion 866 from becoming misaligned with the edge 817B. If the hook portion 866 remains engaged with the edge 817B, the engagement between the hook portion 866 and the edge 817B may also prevent the clamp member 850 from rotating with the bolt 870. The rotation of the bolt 870 axially translates the bolt 870 into the clamp member 850, thereby drawing the head 874 closer to the hook portion 866. The wedge member 820 and the clamp member 850 are thereby linearly displaced and pulled together in opposed converging directions toward the closed position of the clamp subassembly 853. The wedge member 820 abuts the conductors 12, 14 in the sleeve member 810.

The driver 32 and tool 30 are used to forcibly rotate the bolt 870 so that the wedge member 820 is forced forwardly (direction D2, FIG. 36) relative to the sleeve member 810 until the wedge member 820 is in a desired final position to form the connection 5 as shown in FIGS. 33 and 37, and the clamp subassembly 853 has assumed a closed position. The preassembled clamp subassembly 853 thus operates as an integral drive mechanism or clamping mechanism 851 of the clamp/wedge subassembly 857. The connection 5 may be formed by forming interference fits between the wedge member 820, the C-shaped sleeve member 810 and the conductors 12, 14. Moreover, the wedge member 820 may be secured in place by the interlocking engagement between the hook portion 866 and the sleeve member 810.

Maximum insertion of the wedge member 820 into the sleeve member 810 is limited by the stops 837, which will abut the read edge 817A of the sleeve member 820 if the wedge member 820 is fully inserted.

The wedge member 820, the sleeve member 810 and/or the conductors 12, 14 may be deformed. The C-shaped sleeve member 810 may be elastically deformed so that it applies a bias or spring force against the wedge member 820 and the conductors 12, 14. The sleeve member 810 may be plastically deformed.

In some embodiments, the hook portions 814, 816 are deflected outward along the transverse axis M-M as described above with regard to the connector system 101.

Once the wedge member 820 has been installed on the conductors 12, 14 and the sleeve member 810, the clamp subassembly 853 can be retained in the connection 5 to serve as a lock mechanism that helps secure the connection 5.

Alternatively, the clamp subassembly 853 can be removed from the connection 5 so that only the wedge member 820, the conductors 12, 14 and the sleeve member 810 remain. In order to do this, the bolt 870 is rotated opposite the direction R (i.e., counterclockwise) to force the clamp member 850 to move axially forwardly and away from the bolt head 874, thereby placing the clamp subassembly 853 in an open position. The hook portion 866 is disengaged from the front edge 817B. In some embodiments, the clamp member 850 is withdrawn through the through hole 830 (in a direction opposite the direction D2) without removing the bolt 870 from threaded engagement with the bore 860. The removed clamp subassembly 853 can then be reused to install another connector system 801 or discarded.

Once installed, the connector system 801 can be operated as follows to disassemble the connection 5 and the connection assembly 800 in accordance with methods of the invention.

If not already removed, the clamp subassembly 853 is removed from the connection 5 as described above.

Notably, a gap G will be defined between the rear edge 817A of the sleeve member 810 and the flange 834. The gap G will have an axially extending width W3 (FIG. 38) that is at least as great as the width W1 (FIG. 37) because the stops 837 prevent the flange 834 from being positioned closer to the rear edge 817A. Accordingly, the stops 837 ensure at least a minimum sized gap G.

Figure 38:
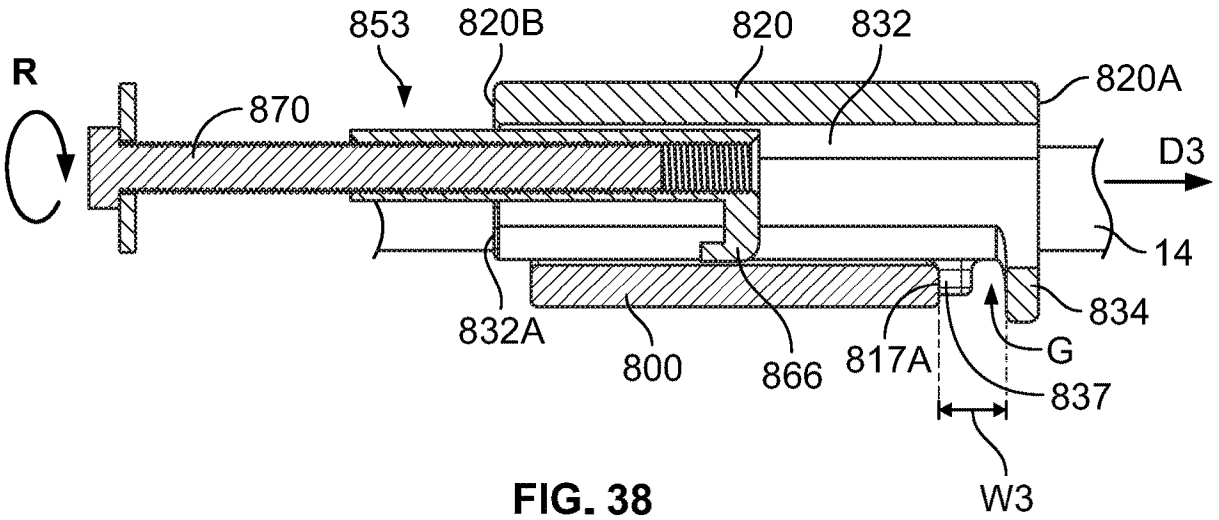
FIGS. 38 and 39 are cross-sectional views of the wedge connector system of FIG. 33 illustrating a procedure for removing the wedge member from the sleeve member.
Figure 39:
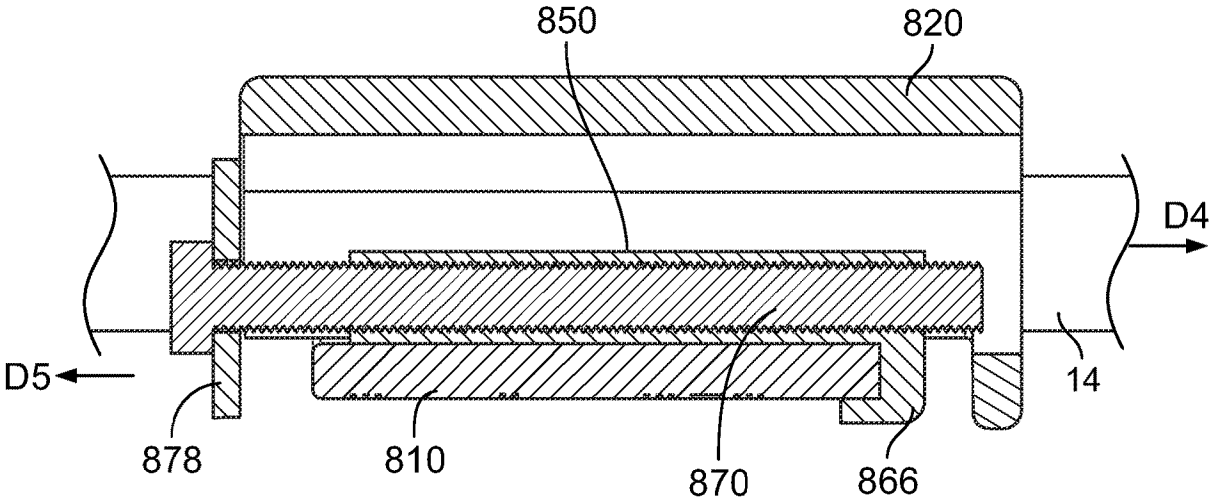
Figure 40:
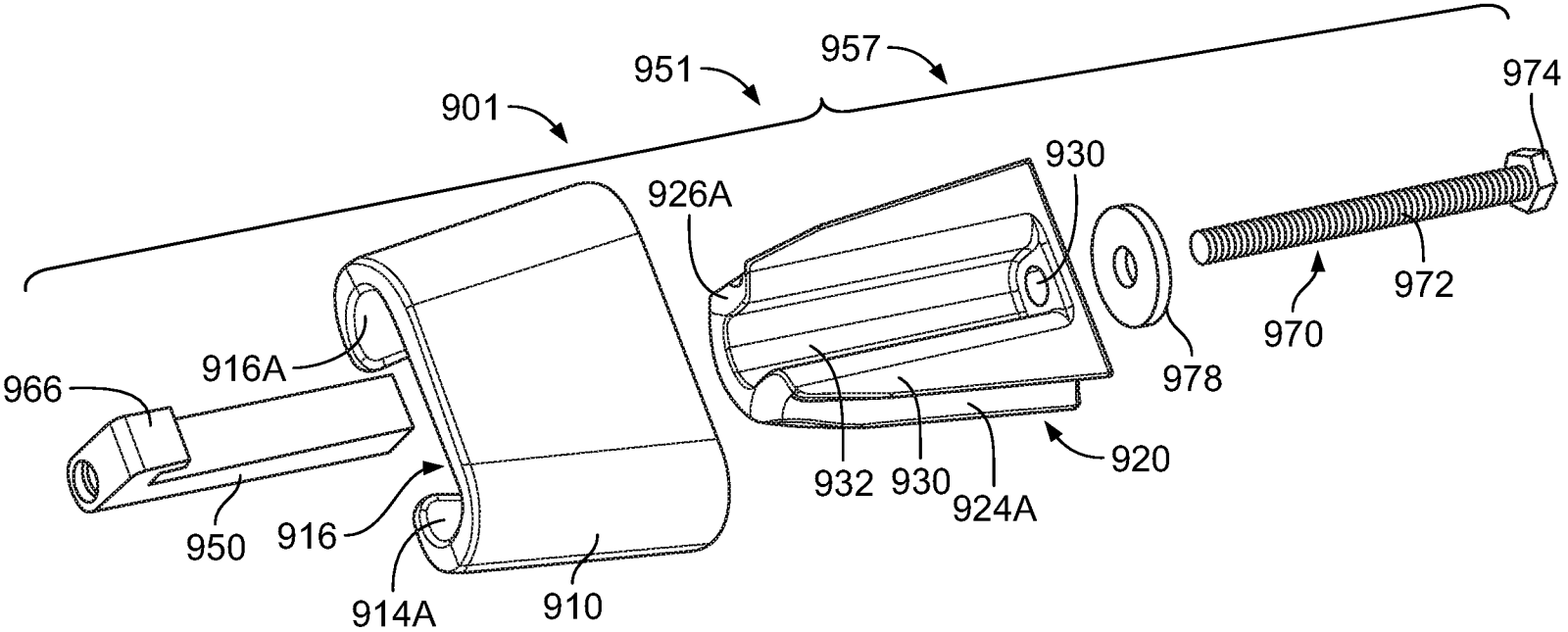
FIG. 40 is an exploded, front perspective view of a wedge connector system and wedge connector assembly according to further embodiments of the invention.

With the clamp subassembly 853 in the open position, the clamp subassembly 853 is mounted on the connection 5. More particularly, the clamp member 850 is axially inserted through the front end opening 832A of the receiver slot 832 and into the receiver slot 832 in a direction D3 from the front end 820B to the rear end 820A, as shown in FIG. 38. The clamp member 850 is further inserted through the receiver slot 832 between the wedge member 820 and the sleeve 810 until the hook feature 866 clears the rear edge 817A of the sleeve member 110. The hook portion 866 then drops over the rear edge 817A and into the gap G between the rear edge 817A and the flange 834. The hook portion 866 is then pulled forward (in direction D5) to capture the rear edge 817A in the hook slot 866A, as shown in FIG. 39.

The tool 30 is then engaged with the bolt head 874. The tool 30 is forcibly driven by the driver 32 to rotate the bolt 870 in the direction R relative to the clamp member 150. The engagement between the hook portion 866 and the edge 817A prevents the clamp member 850 from rotating with the bolt 870. The rotation of the bolt 870 axially translates the bolt 870 into the clamp member 850, thereby drawing the head 874 closer to the hook portion 866. The wedge member 820 and the sleeve member 810 are thereby axially displaced and pushed apart in opposed diverging directions (direction D4 for the wedge member 820, and direction D5 for the sleeve member 810; FIG. 39). The wedge member 820 is thereby released from the conductors 12, 14 and can be removed from the sleeve member 810.

The connector system 801 and, in particular, the clamp subassembly 853 facilitate quick positioning of the clamp/ wedge subassembly 857 between the conductors 12, 14 and the sleeve member 810. The clamp/wedge subassembly 857 can be quickly advanced into the sleeve member 810. By this action, the connector 5 is mechanically secured to the conductors 12, 14, putting the installer in a completely "hands free" situation prior to executing the final installation step.

Advantageously, the clamp subassembly 853 can be preassembled by the manufacturer, for example. This eliminates the need for an installer to assemble the clamp member 850 and the bolt 870. As a result, the preassembly can prevent inadvertent cross-threading between the threads of the clamp member 850 and the bolt 870 as may occur if the installer attempted the assembly steps. The preassembly of the clamp subassembly 853 also eases the installation (and removal) of the connector system 801 by reducing the number of complicated steps and parts that must be assembled at the site of the connection.

The driver 32 may be a driver as described above with regard to the connector system 101.

A corrosion inhibitor compound may be provided (i.e., applied at the factory) on the conductor contact surfaces of the wedge member 820 and/or the sleeve member 810 as discussed above.

With reference to FIGS. 40-43, a wedge connector system 901 and a wedge connector assembly 900 according to further embodiments is shown therein. The connector assembly 900 corresponds to and may be used in the same manner as the connector assembly 800, except as discussed below. The connector assembly 900 includes a sleeve member 910, a wedge member 920, a clamp member or bracket 950, a drive member or bolt 970, and a washer 978 corresponding to the sleeve member 810 and the wedge member 820, the clamp member 850, the drive member or bolt 870, and the washer 878, respectively, except as discussed below.

In place of the through hole 830, the wedge member 920 includes a smaller through hole 930. The through hole 930 is sized to permit passage of the bolt shank 272, but is not large enough to permit passage of the clamp member 950.

The wedge member 210 includes integral anti-rotation features corresponding to the anti-rotation features 833 in the form of a pair of spaced apart sidewall surfaces in the receiver slot 932.

The clamp member 950 includes integral anti-rotation features corresponding to the anti-rotation features 868 in the form of a pair of spaced apart sidewall surfaces on the body of the clamp member 950.

Figure 41:
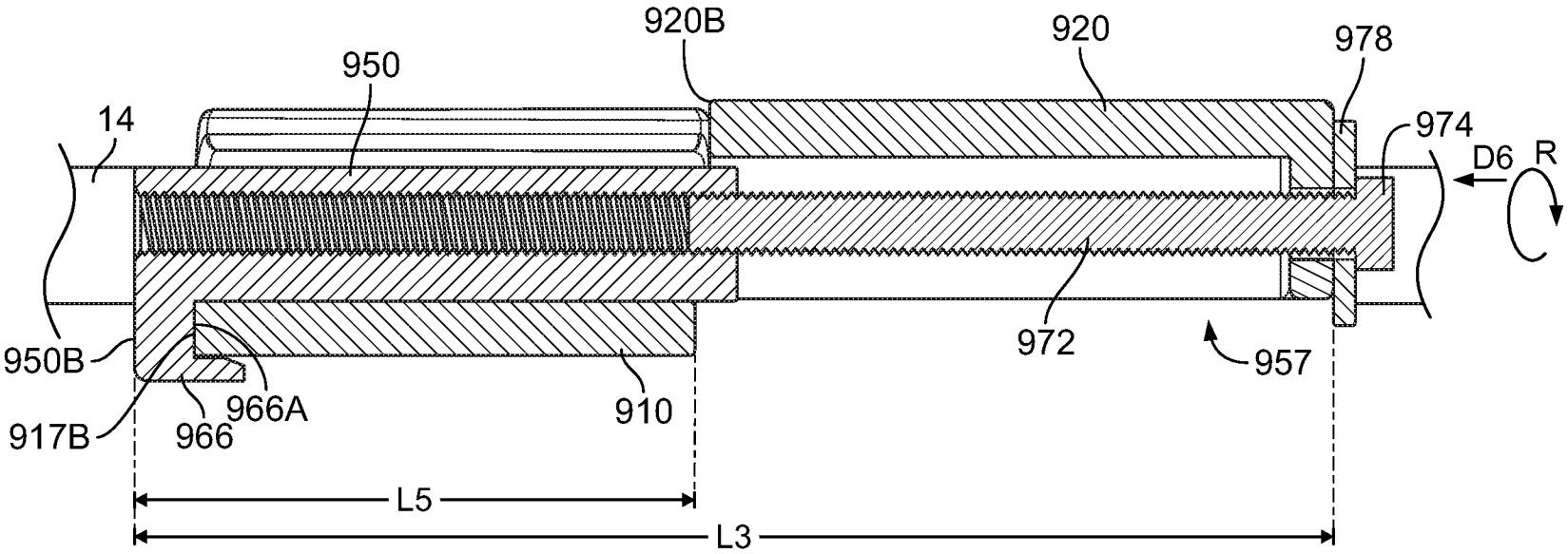
FIG. 41 is a cross-sectional view of the wedge connector system of FIG. 40 mounted on a pair of conductors, wherein the wedge connector system is in an open position and positioned to install a wedge member in a sleeve member of the wedge connector system.
Figures 42, 43:
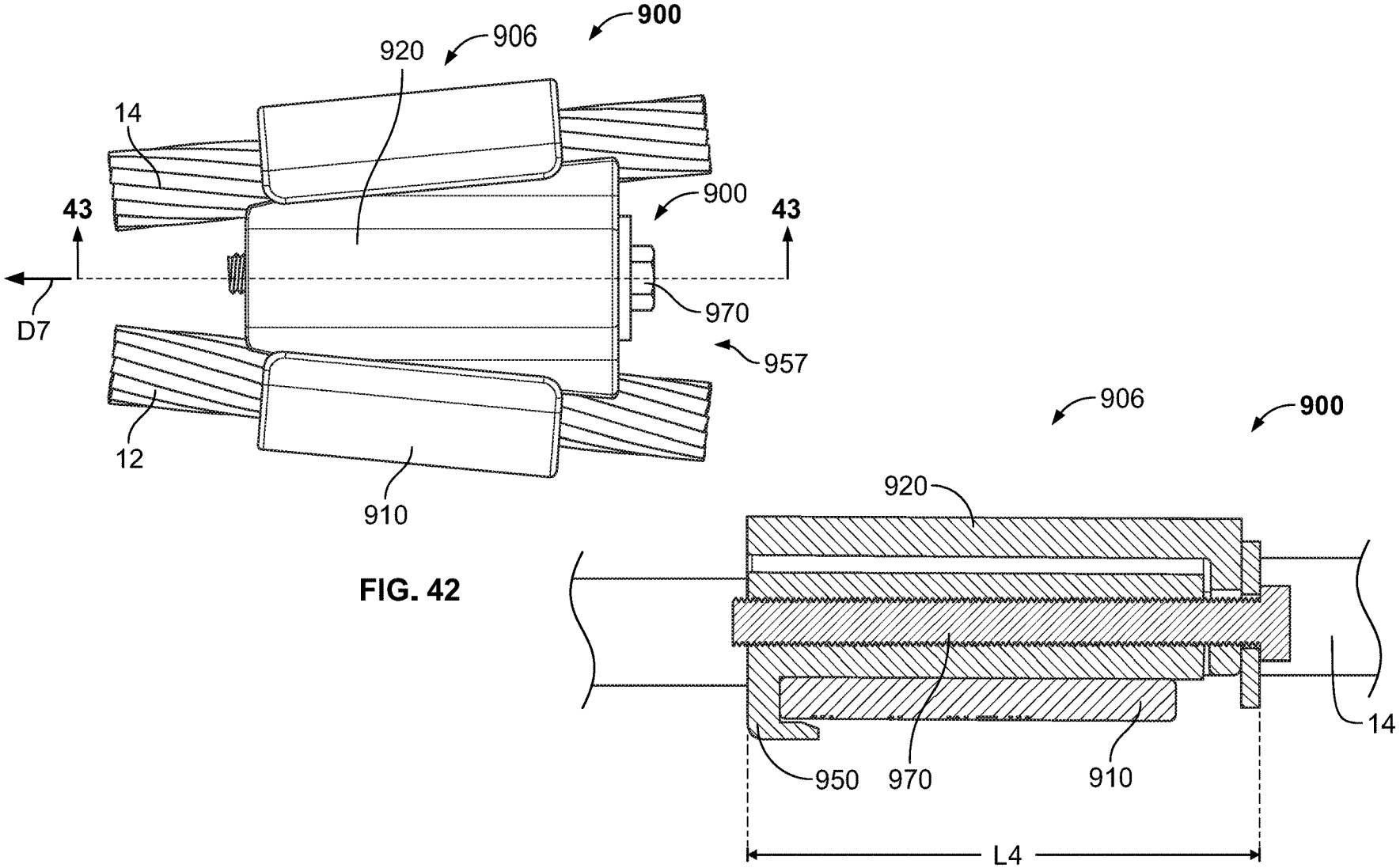
FIG. 42 is a side view of the wedge connector system of FIG. 40 mounted on the pair of conductors to form a wedge connector assembly.
FIG. 43 is a cross-sectional view of the connection of FIG. 40 taken along the line 43-43 of FIG. 40.

With reference to FIGS. 41-43, exemplary methods for assembling and using the connector assembly 900 in accordance with embodiments of the present invention will now be described.

As shown in FIG. 42, the C-shaped sleeve member 910 is placed over the conductor 14 such that the conductor 14 is received in the side channel 914A. The conductor 12 is placed in the other side channel 916A.

The clamp member 950, the bolt 970, the washer 978, and the wedge member 920 are assembled together to form a preassembled clamp/wedge subassembly 957 (FIG. 41). More particularly, the clamp member 950 is placed in the receiver slot 932, and the shaft 972 of the bolt 970 is inserted through the washer 978 and the through hole 930 and threadedly engaged in the bore 960 of the clamp member 950.

In some embodiments, the clamp/wedge subassembly 957 is assembled at the factory and provided to the end user or installer preassembled. In some embodiments, the clamp/wedge subassembly 957 is assembled prior to mounting the wedge member 920 in the sleeve 910.

However, in other embodiments, the clamp/wedge subassembly 957 is assembled by the end user and, in some embodiments, is assembled onsite at the location of the tap installation by the installer.

The clamp/wedge subassembly 957 can assume an open position (as shown in FIG. 41) wherein the clamp member 950 is extended and the front end 950B of the clamp member 950 is spaced a distance L3 from the head 974 of the bolt 970. The clamp/wedge subassembly 957 can then assume a closed position (as shown in FIG. 43) wherein the bolt 970 is screwed further into the bore 960 and the front end 950B is spaced a distance L4 from the head 974. The distance L4 is less than the distance L3.

The clamp/wedge subassembly 957 is mounted on the sleeve member 910 with the clamp/wedge subassembly 957 in the open position. More particularly, the bolt 970 is pushed forward in the wedge member 920 so that the front end 950B of the clamp member 950 is extended a distance L5 (FIG. 41) forward of the front end 920B of the wedge member 920. The clamp member 950 is then inserted into the cavity 915 of the sleeve member 910 such that the hook portion 966 of the clamp member 950 is laid over the front edge 917B of the sleeve member 910.

In some implementations, the clamp member 950 is then pulled rearward to capture the front edge 917B in the hook slot 966A as shown in FIG. 41. The clamp member 950 can be inserted laterally and/or at an angle through the slot between the hook portions 914, 916 to engage the hook portion 966 with the front edge 917B. In other implementations, the hook portion 966 is not yet engaged with the front edge 917B.

Whether hook portion 966 is engaged with the front edge 917B or not, the wedge member 910 is then pushed forward (direction D6; FIG. 41) into the cavity 915 between the conductors 12, 14 such that the conductors 12, 14 are received in the opposed grooves 924A, 926A, as shown in FIG. 42. The wedge member 920 may be forced into the sleeve member 910 by hand or using a hammer or the like to temporarily hold the wedge member 920 and the conductors 12, 14 in position. This can enable the installer to execute the following installation steps without having to otherwise secure the wedge member 920 in the sleeve member 910.

The bolt 970 is then rotated (e.g., by hand or using the tool 30 with or without the driver 32 engaging the head 974) in a direction R relative to the clamp member 950. Advantageously, the head 974 is accessible for engagement with the tool 30 from the rear side of the wedge member 920. The integral anti-rotation features of the wedge member 920 and the clamp member 950 mate and cooperate to prevent the clamp member 950 from rotating with the bolt 970 and to prevent the hook portion 966 from becoming misaligned with the edge 917B. The rotation of the bolt 970 axially translates the bolt 970 into the clamp member 950, thereby drawing the head 974 closer to the hook portion 966. The wedge member 920 and the clamp member 950 are thereby axially displaced and pulled together in opposed converging directions toward the closed position of the clamp/wedge subassembly 957. The wedge member 920 abuts the conductors 12, 14 in the sleeve member 910.

The driver 32 and tool 30 are used to forcibly rotate the bolt 970 so that the wedge member 920 is forced forwardly (direction D7; FIG. 42) relative to the sleeve member 910 until the wedge member 920 is in a desired final position to form the connection 6 as shown in FIGS. 42 and 43, and the clamp/wedge subassembly 957 has assumed a closed position. The clamp member 950 and the bolt 970 thus operate as a drive mechanism or clamping mechanism 951 of the clamp/wedge subassembly 957. The connection 6 may be formed by forming interference fits between the wedge member 920, the C-shaped sleeve member 910 and the conductors 12, 14. Moreover, the wedge member 920 may be secured in place by the interlocking engagement between the hook portion 966 and the sleeve member 910.

Optionally, the clamp member 950 and the bolt 970 may be slid rearward in the slot 932 with respect to the sleeve member 910 and the wedge member 920 to capture the front edge 917B of the sleeve member 910 in the hook portion 966 prior to driving the bolt 970 to close the clamp/wedge subassembly 957. In that case, the engagement between the hook portion 966 and the edge 917B may also prevent the clamp member 950 from rotating with the bolt 970.

The clamp member 950, the bolt 970 and the washer 978 may be retained in the connection 6 or removed.

As discussed above with regard to the connector system 801, the connector system 901 can similarly facilitate quick positioning of the clamp/wedge subassembly 957 between the conductors 12, 14 and the sleeve member 910. The clamp/wedge subassembly 957 can be quickly advanced into the sleeve member 910. By this action, the connector 6 is mechanically secured to the conductors 12, 14, putting the installer in a completely "hands free" situation prior to executing the final installation step.

Advantageously, the clamp/wedge subassembly 957 can be preassembled by the manufacturer, for example. This eliminates the need for an installer to assemble the clamp member 950 and the bolt 970. As a result, the preassembly can prevent inadvertent cross-threading between the threads of the clamp member 950 and the bolt 970 as may occur if the installer attempted the assembly steps. The preassembly of the clamp/wedge subassembly 957 also eases the installation (and removal) of the connector system 901 by reducing the number of complicated steps and parts that must be assembled at the site of the connection.

With reference to FIGS. 44-59, a wedge connector system or kit 1001 and a wedge connector assembly 1000 according to further embodiments is shown therein. The connector assembly 1000 corresponds to and may be used in the same manner as the connector assembly 900, except as discussed below.

The wedge connector system 1001, and the wedge connector assembly 1000 formed therefrom, include a C-shaped channel or sleeve member 1010, a wedge member 1020, a lock member 1050, a drive member 1070, a washer 1078, and a retainer member, ring, clip or washer 1084. The sleeve member 1010 and the wedge member 1020 are movable relative to one another to cooperatively mechanically capture the conductors 12, 14 therebetween and electrically connect the conductors 12, 14 to one another.

Optionally, the wedge connector system may 1001 may include and use a spacer insert 1019 (FIG. 46) and a mounting feature 1019A (e.g., a bore) in the sleeve member 1010, for example, as disclosed in U.S. Published Patent Application No. 2018/0342818 A1, the disclosure of which is incorporated herein by reference.

The assembled connector assembly 1000 has a lengthwise axis L-L, a first transverse or heightwise axis M-M, and a second transverse or depthwise axis N-N. The heightwise axis M-M is transverse (and, in some embodiments, perpendicular) to the lengthwise axis L-L and extends through the wedge channels 1024A, 1026A. The depthwise axis N-N is transverse (and, in some embodiments, perpendicular) to both the lengthwise axis L-L and the heightwise axis M-M.

The sleeve member 1010 corresponds to the sleeve member 710.

The wedge member 1020 corresponds to the wedge member 720 except as shown and discussed below.

Figure 50:
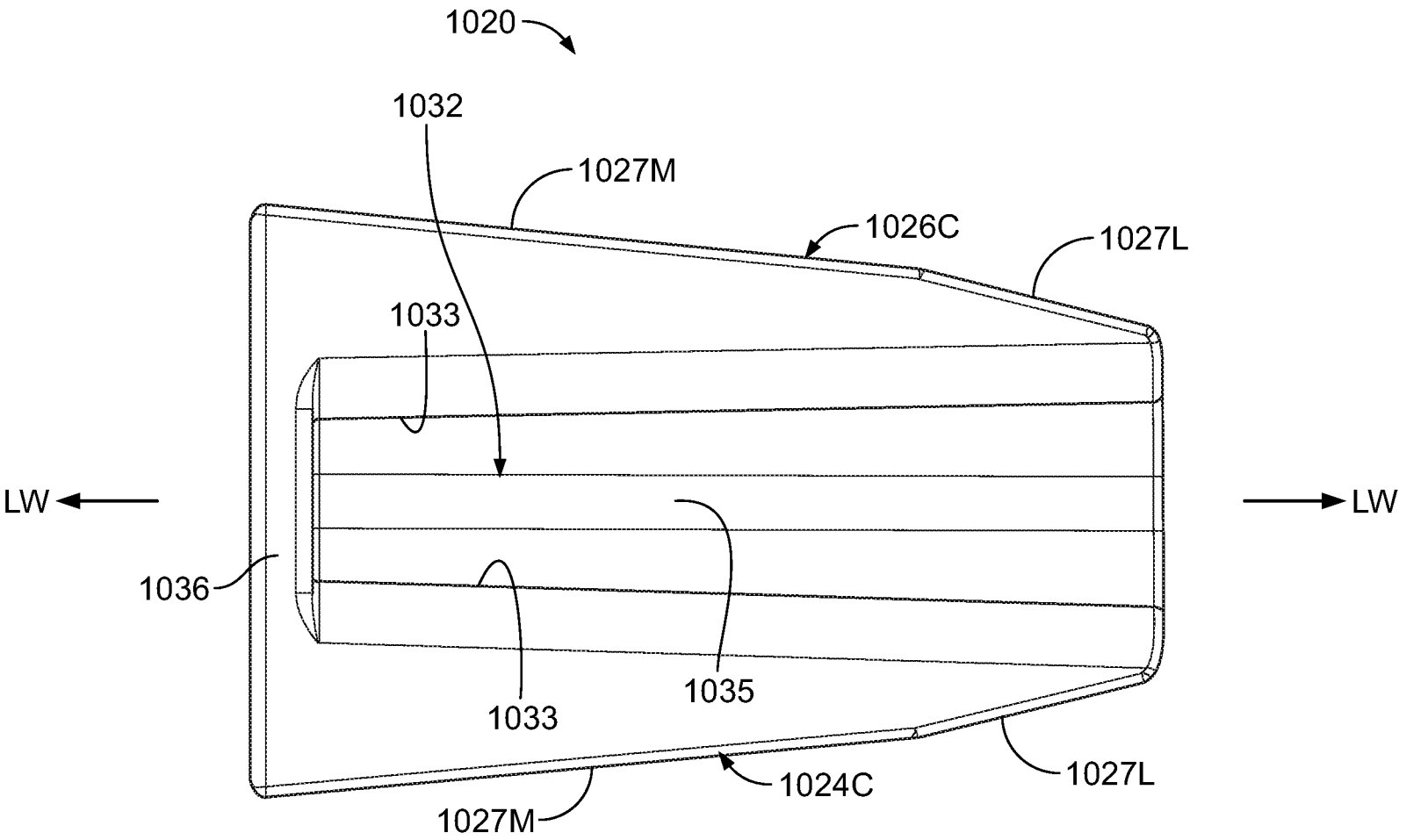
FIG. 50 is a first side view of the wedge member of FIG. 47.

The wedge member 1020 has a body 1022 and a lengthwise axis LW-LW (FIG. 50). The lengthwise axis LW-LW is substantially parallel or coaxial with the lengthwise axis L-L when the connector assembly 1000 is assembled.

An axially extending receiver slot 1032 is defined in the inner wall 1029 and extends parallel with the lengthwise axis LW-LW. The receiver slot 1032 has a back wall surface 1035 opposite the open side of the slot 1032. The back wall surface 1035 is located opposite the connecting portion 1012 of the sleeve member 1010 when the connector assembly 1000 is assembled.

Figure 47:
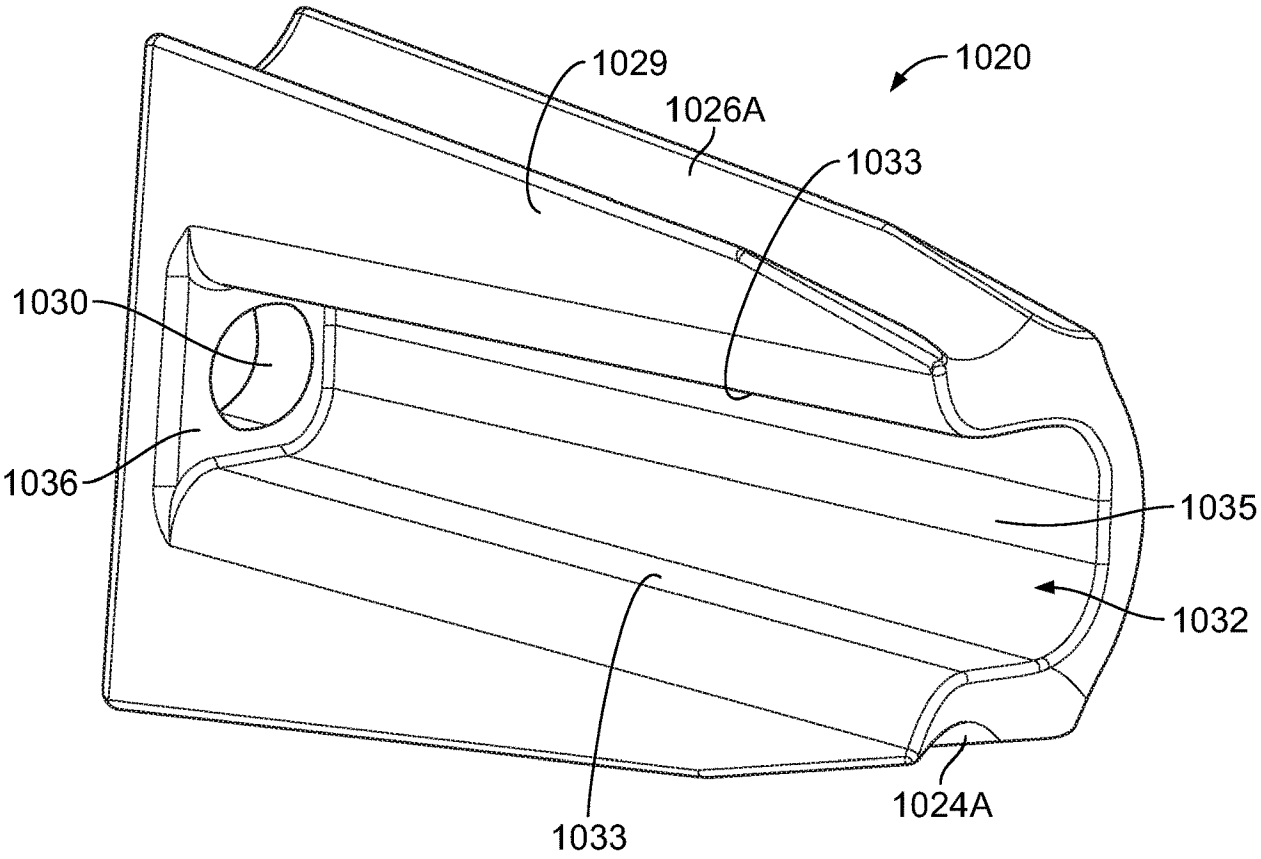
FIG. 47 is a front perspective view of a wedge member forming a part of the wedge connector system of FIG. 44.
Figure 46:
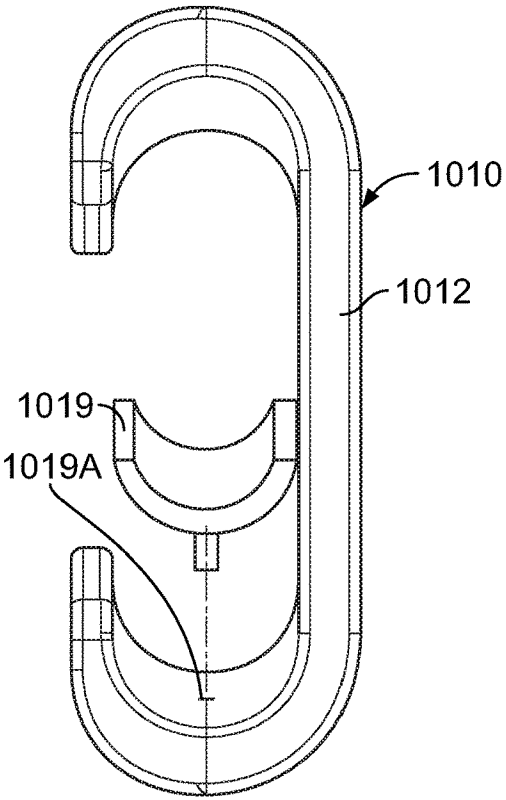
FIG. 46 is an exploded, rear end view of a sleeve member and a spacer insert forming a part of the wedge connector system of FIG. 44.

The wedge member 1020 includes integral anti-rotation features 1033 in the receiver slot 1032. In some embodiments and as shown, the anti-rotation features are a pair of opposed sidewall surfaces 1033 (FIG. 47).

An integral end wall or boss 1036 is located proximate the rear end 1020A. The boss 1036 projects inwardly from the body 1022 along the depthwise axis N-N in a direction transverse (e.g., perpendicular) to the lengthwise axis LW-LW.

A through hole slot 1030 extends axially through the boss 1036 substantially parallel to the lengthwise axis LW-LW. In some embodiments, the through hole slot 1030 is non-threaded.

Figure 48:
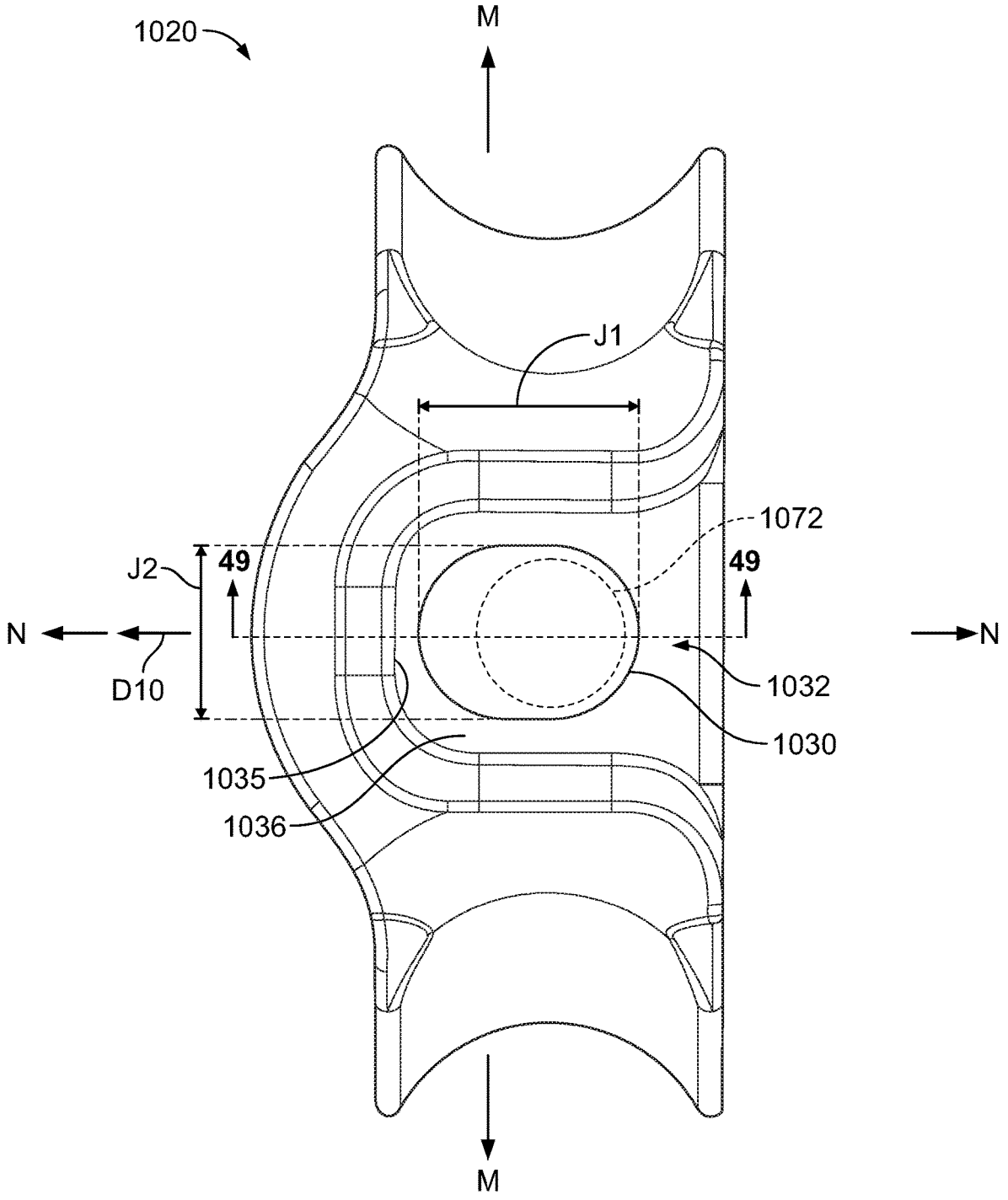
FIG. 48 is a front end view of the wedge member of FIG. 47.

The slot 1030 is oblong or elongated with its lengthwise dimension extending substantially parallel with the depthwise axis N-N. In some embodiments and as shown, the slot 1030 is elliptical. The slot 1030 has a depthwise dimension J1 (FIG. 48; parallel to the depthwise axis N-N) that is greater than its heightwise dimension J2 (FIG. 48; parallel to the heightwise axis M-M). In some embodiments, the depthwise dimension J1 is in the range of from about 0.1 to 0.2 inch greater than the heightwise dimension J2.

Figure 49:
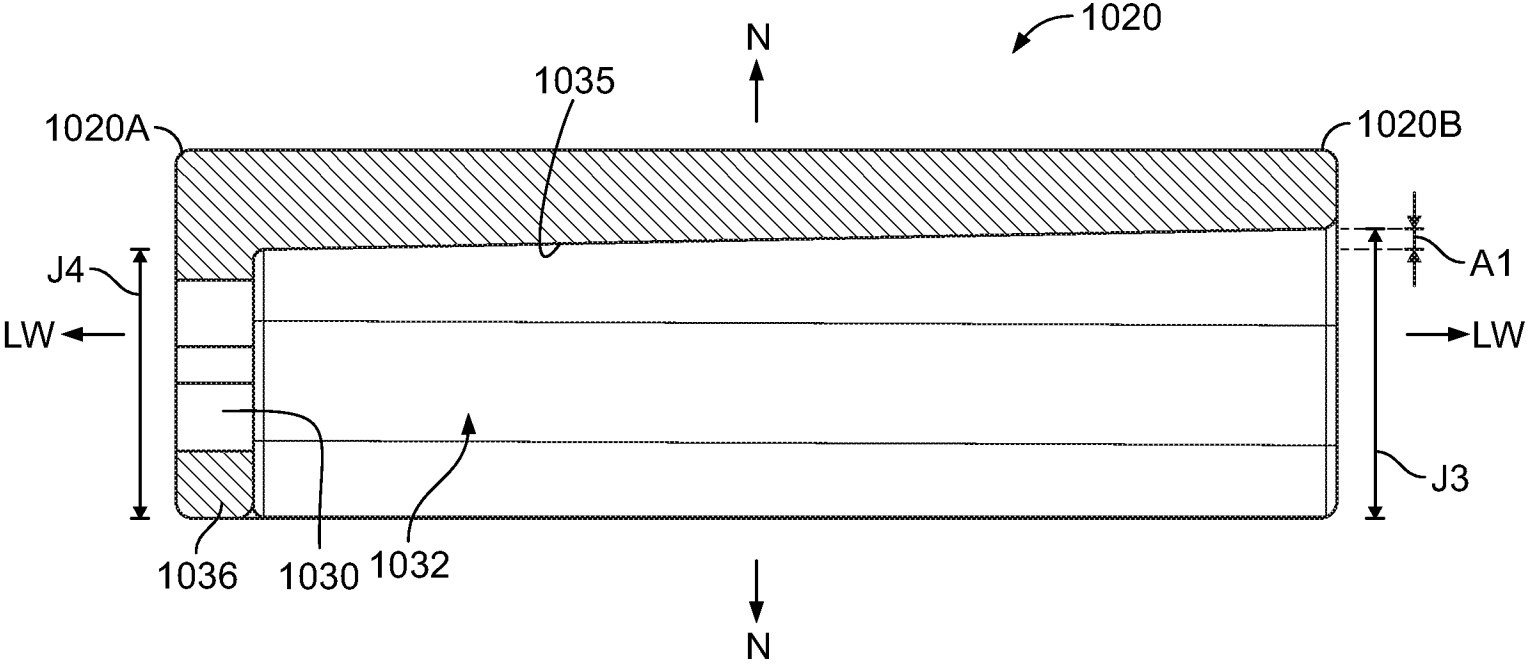
FIG. 49 is a cross-sectional view of the wedge member of FIG. 47 taken along the line 49-49 of FIG. 48.

The back wall surface 1035 is axially sloped or angled relative to the axis LW-LW from the open end of the slot 1032 (proximate the front or leading end 1020B) to the boss 1036 (proximate the rear end 1020A). As a result, the depth (along the depthwise axis N-N) of the receiver slot 1032 tapers from a front depth J3 to a rear depth J4 (FIG. 49). In some embodiments, the angle A1 (FIG. 49) of the slope or draft of the back wall surface 1035 relative to the axis LW-LW is in the range of from about 0.5 to 2.5 degrees.

Figure 51:
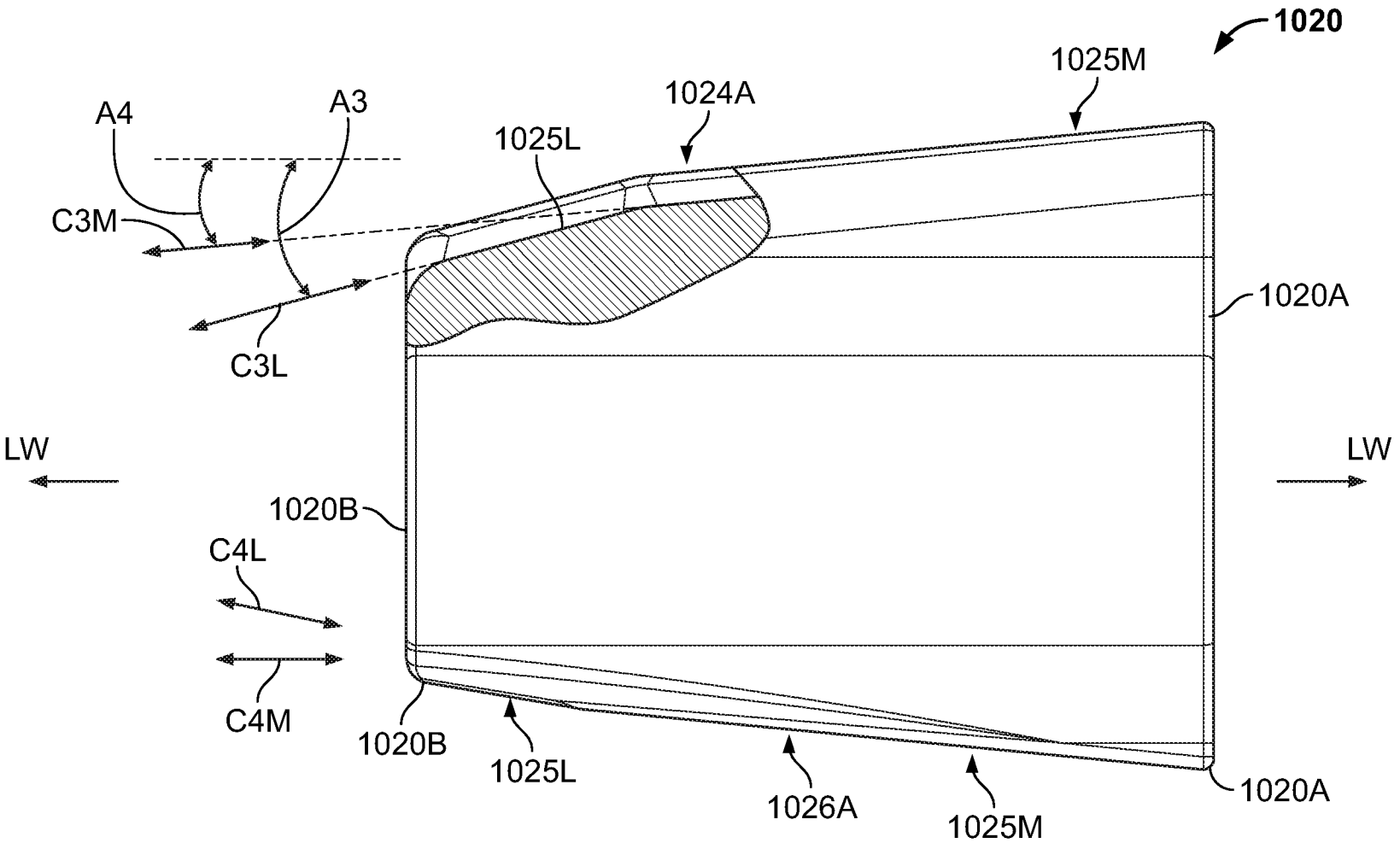
FIG. 51 is a fragmentary, opposing side view of the wedge member of FIG. 47.

With reference to FIG. 51, the conductor channel 1024A includes a main section 1025M (proximate the rear end 1020A) and a lead section 1025L (proximate the front end 1020B). The main section 1025M defines a channel axis C3M. The lead section 1025L defines a channel axis C3L.

Similarly, the conductor channel 1026A includes a main section 1025M (proximate the rear end 1020A) and a lead section 1025L (proximate the front end 1020B). The main section 1025M defines a channel axis C4M. The lead section 1025L defines a channel axis C4L.

The channel axes C3M, C3L, C4M, C4L each form an oblique angle with the wedge lengthwise axis LW-LW (and, when the connector is assembled, the connector lengthwise axis L-L) so that the wedge member is axially tapered inwardly from the rear end 1020A to the front end 1020B. However, the angle A3 of each lead section axis C3L, C4L is greater than the angle A4 of each main section axis C3M, C4M. As a result, each conductor channel 1024A, 1026A is a double angle channel.

In some embodiments, the angle A3 is in the range of from about 4 to 8 degrees greater than the angle A4.

In some embodiments, the angle A3 is in the range of from about 9 to 14 degrees.

In some embodiments, the angle A4 is in the range of from about 5 to 6 degrees.

Moreover, with reference to FIG. 50, the outer (axially extending) edges 1024C, 1026C defining the channels 1024A, 1026A each have a leading section 1027L and a main section 1027M. As a result, the leading section 1027L and the main section 1027M of the wedge member 1020 are both inwardly tapered, but the leading section 1027L has a different rate of heightwise taper than that of the main section 1027M. More particularly, the leading section 1027L is more steeply tapered than the main section 1027M. In some embodiments, the ranges of angles of the edge sections 1027L, 1027M are the same as described above for the channel axes C3M, C3L, C4M, C4L.

Figure 44:
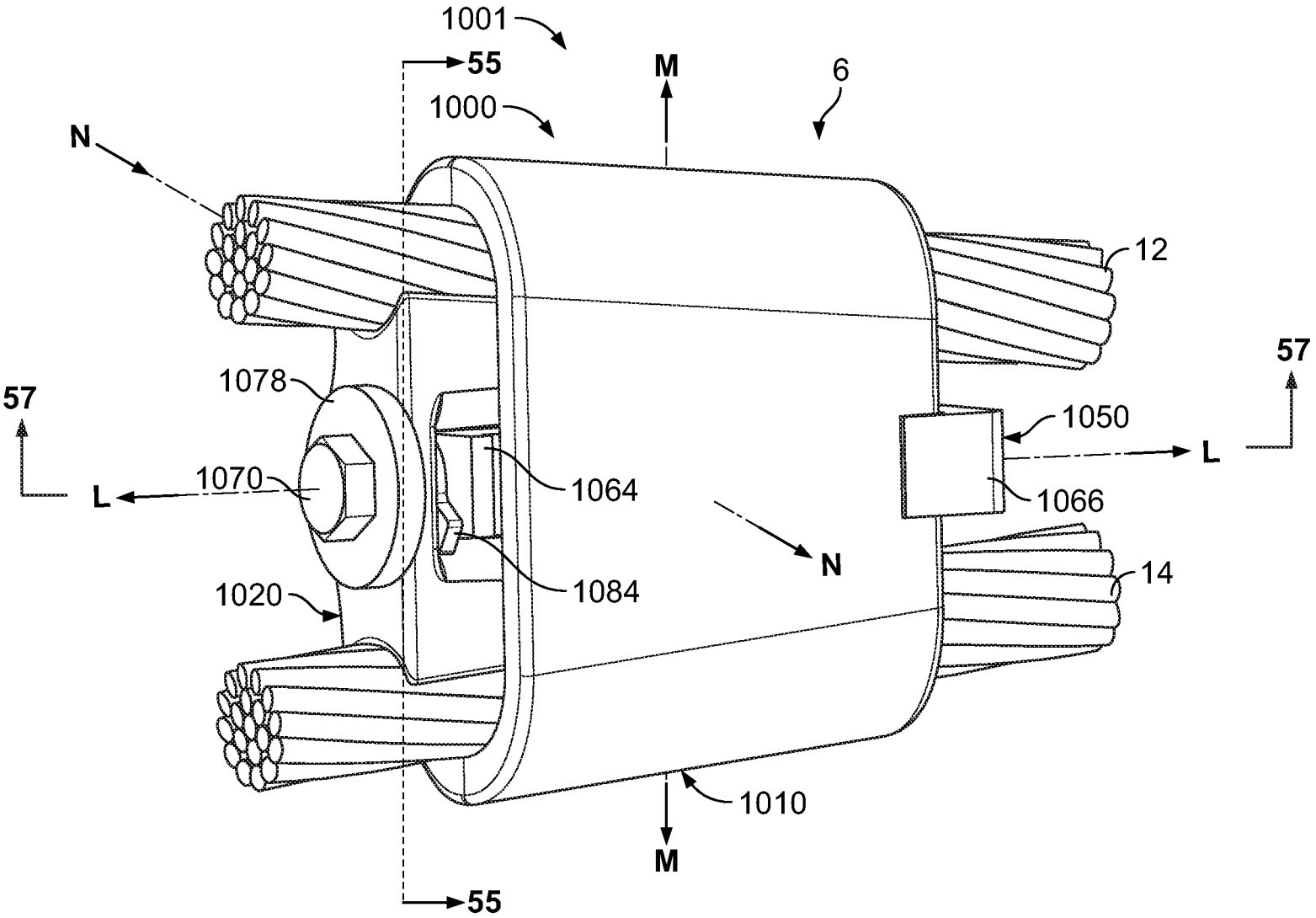
FIG. 44 is a rear perspective view of a wedge connector system and wedge connector assembly according to further embodiments of the invention.
Figure 45:
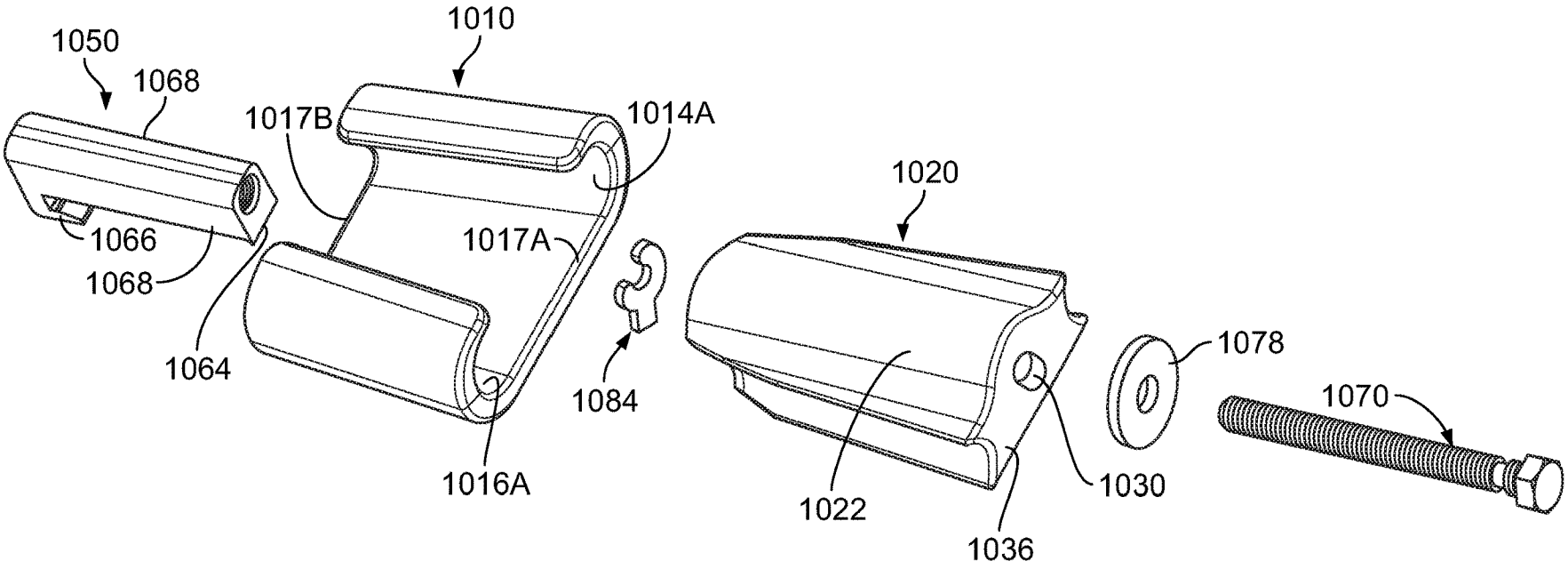
FIG. 45 is an exploded, rear perspective view of the wedge connector system of FIG. 44.
Figure 52:
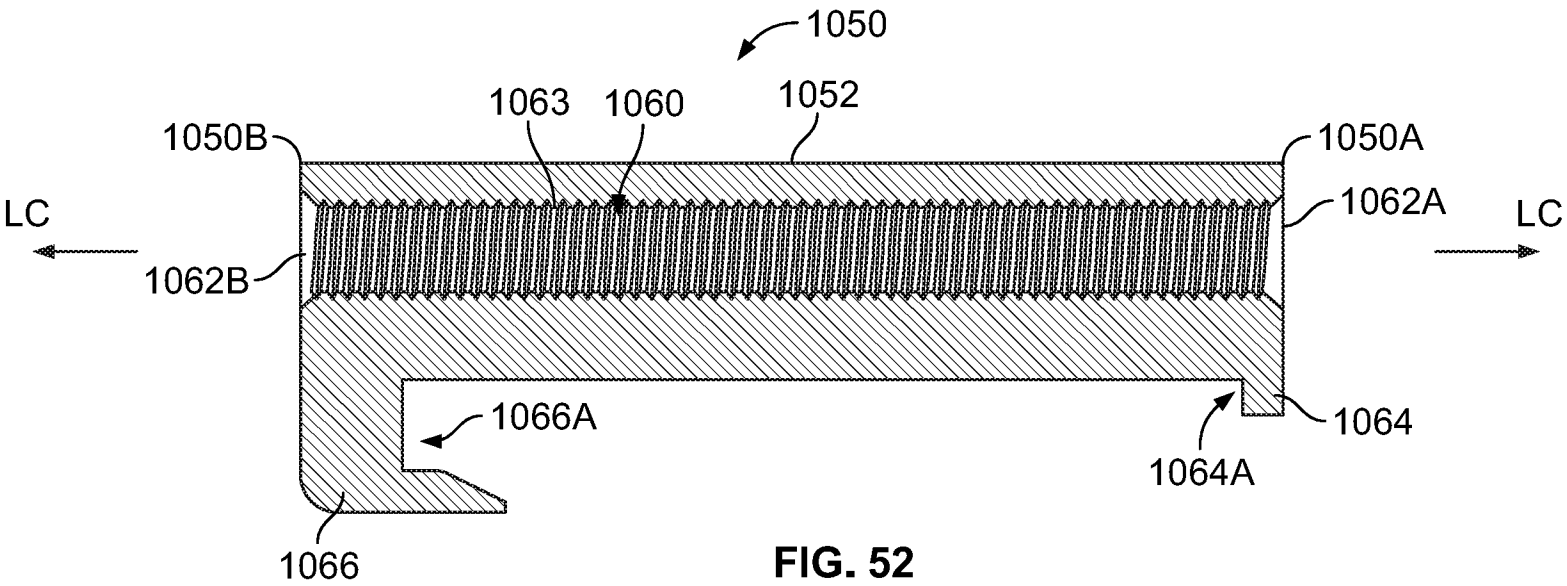
FIG. 52 is a cross-sectional view of a lock member forming a part of the wedge connector system of FIG. 44.
Figure 53:
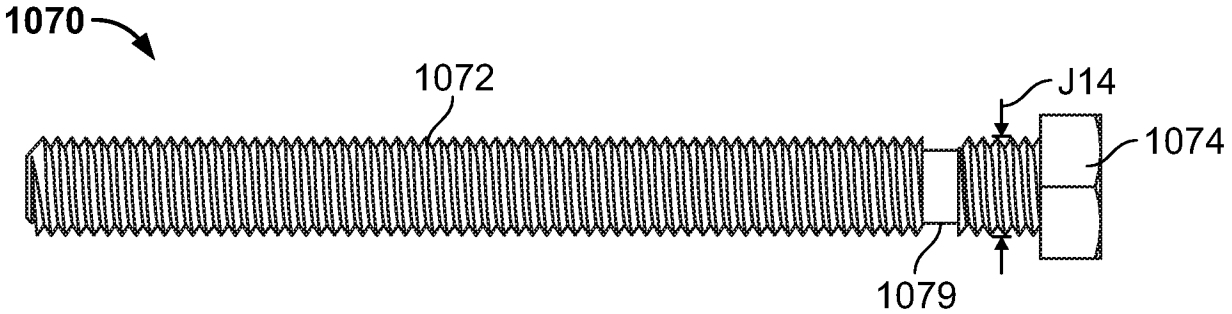
FIG. 53 is a side view of a drive member forming a part of the wedge connector system of FIG. 44.
Figure 54:
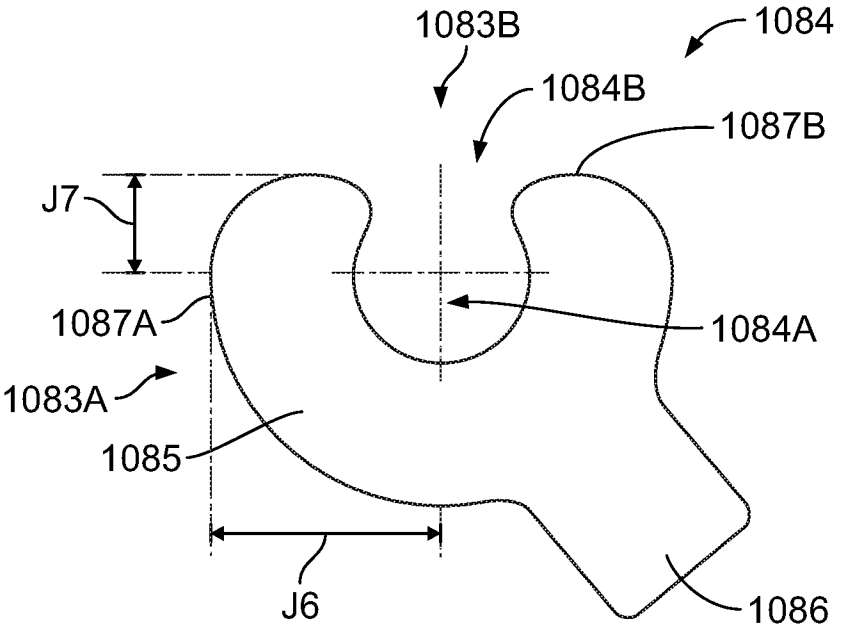
FIG. 54 is a front view of a retainer member forming a part of the wedge connector system of FIG. 44.

With reference to FIGS. 44, 45 and 52, the lock member 1050 extends from a rear end 1050A to a front end 1050B along a lock member axis LC-LC. The lock member 1050 includes a body 1052, an integral bolt receiving bore 1060, an integral removal tab or rear engagement portion 1064, and an integral hook or sleeve engagement portion 1066.

The body 1052 includes integral anti-rotation features 1068. In some embodiments, the anti-rotation features 1068 are a pair of opposed sidewall surfaces 1068 (FIG. 45) spaced apart and shaped to co-operate with the anti-rotation features 1033, as discussed below.

The bolt receiving bore 1060 extends substantially parallel to the axis LC-LC fully from end 1050A to end 1050B. The bolt receiving bore 1060 terminates at openings 1062A and 1062B. An internal screw thread 1063 is provided in the bore 1060.

The hook feature 1066 is located on the front end 1050B and extends inwardly (along axis N-N) and rearwardly. The hook feature 1066 defines a hook or receiver slot 1066A.

The removal or rear tab 1064 is located on the rear end 1050A and extends inwardly (along axis N-N). The rear tab 1064 defines a corner or recess 1064A with the inner face of the body 1052.

In some embodiments and as shown, the drive member is a drive bolt 1070. The bolt 1070 has an externally threaded cylindrical shank, rod or shaft 1072, an integral driver engagement feature 1074, and an annular retainer clip mount slot or groove 1079.

The integral driver engagement feature 1074 is located on the rear end of the shaft 1072. The driver engagement feature 1074 may be provided in the form of a geometric head (e.g., a hexagonal faceted head) or a geometric socket. The drive head 1074 may be a hex head as illustrated, for example.

The groove 1079 is defined in the outer surface of the bolt 1070 on the rear end of the drive bolt 1070 between the feature 1074 and the front end of the bolt 1070, proximate the head 1074).

The outer diameter J14 (FIG. 53) of the shaft 1027 between the groove 1079 and the head 1074 is sized to fit within the slot 1030. In some embodiments, the outer diameter J14 is slightly smaller than the dimension J2 (FIG. 48) of the slot 1030, so that the shaft 1072 can slide in the slot 1030 along the axis N-N without binding or undue interference, but cannot shift substantially in the slot 1030 along the heightwise axis M-M. The outer diameter J14 is substantially smaller than the dimension J1 of the slot 1030, so that the shaft 1072 can slide in the slot 1030 along the axis N-N as discussed herein a substantial distance to permit the shaft 1072 to tilt.

In some embodiments, the outer diameter J14 is in the range of from about 0.03 to 0.65 inch smaller than the dimension J2. In some embodiments, the outer diameter J1.

The retainer member 1084 (FIG. 54) has a full, wide or securing side 1083A and an opposing truncated, narrow or release side 1083B. The retainer member 1084 includes a C-shaped portion or body 1085 and an integral extension portion or tab 1086.

The body 1085 defines a receiver slot 1084A and a side opening 1084B on the release side 1083B. The side opening 1084B communicates with the receiver slot 1084A.

The extension tab 1086 projects radially from the body 1085 between the securing side 1083A and the release side 1083B.

The retainer member 1084 has a first width J6 (FIG. 54) extending from the center of the receiver slot 1084A to the outer edge 1087A of the retainer member 1084 on the securing side 1083A. The retainer member 1084 has a second or reduced width J7 extending from the center of the receiver slot 1084A to the outer edge 1087B of the retainer member 1084 on the release side 1083B. The width J6 is greater than the width J7. In some embodiments, the width J6 is in the range of from about 0.1 to 0.2 inch greater than the width J7.

The retainer member 1084 may be formed of any suitable material. According to some embodiments, the retainer member 1084 is formed of metal. According to some embodiments, the retainer member 1084 is formed of aluminum or steel.

The sleeve member 1010, the wedge member 1020, the lock member 1050, and the bolt 1070 may be formed of materials as described above for the sleeve member 110, the wedge member 120, the lock member 150, and the bolt 170.

With reference to FIGS. 55-58, exemplary methods for assembling and using the connector assembly 1000 in accordance with embodiments of the present invention will now be described.

The sleeve member 1010, the wedge member 1020, the lock member 1050, the bolt 1070, the washer 1078, and the retainer member 1084 may each be manufactured as individual, discrete parts from the others, and thereafter assembled together. Each of the assembly steps may be executed in a factory or by an end user or installer.

Figure 57:
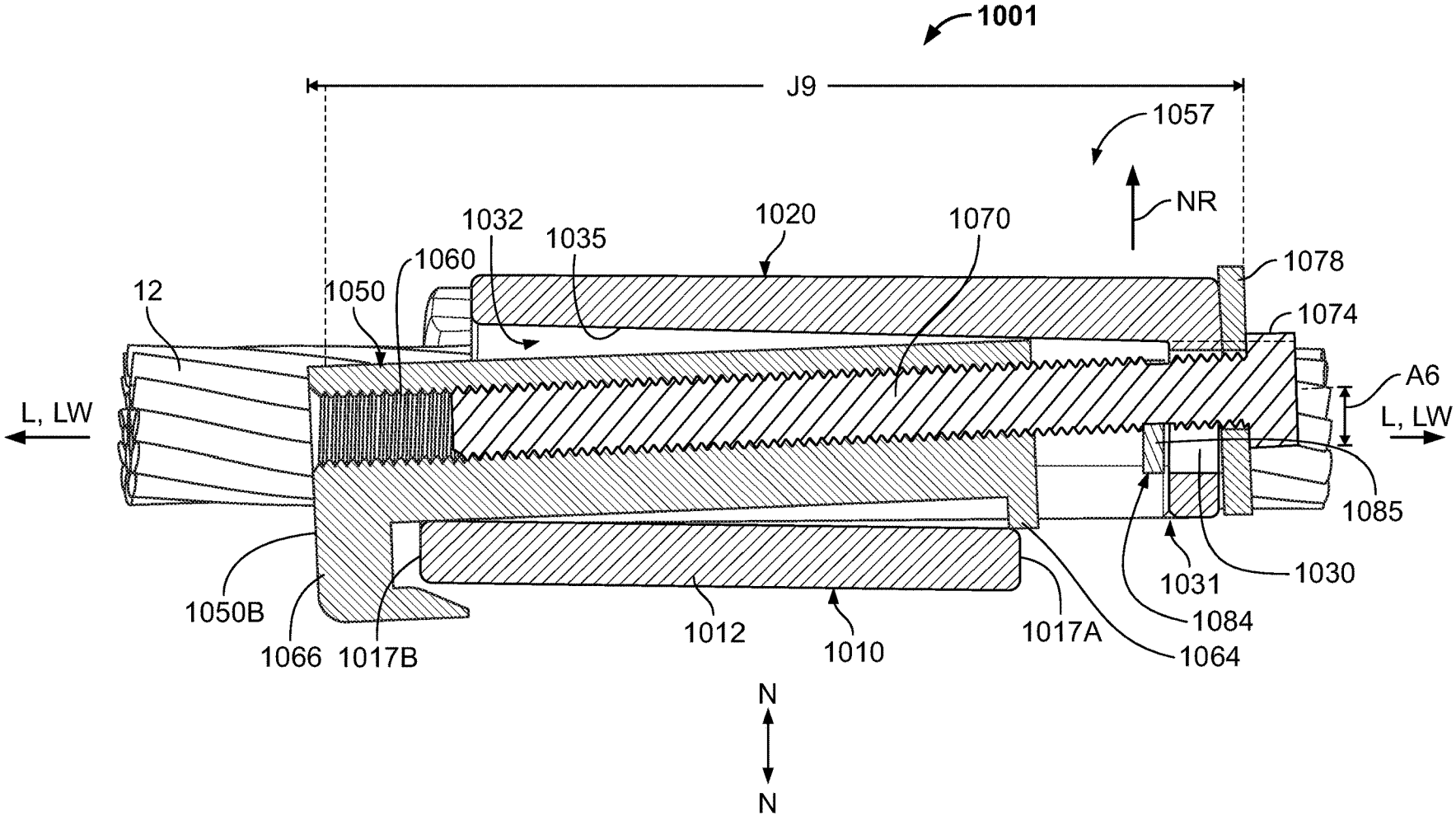
FIGS. 57 and 58 are cross-sectional views of the wedge connector system of FIG. 44 taken along the line 57-57 of FIG. 44 illustrating installation of the wedge connector assembly.

In some embodiments, the wedge member 1020, the lock member 1050, the bolt 1070, the washer 1078, and the retainer member 1084 are preassembled together to form a lock/wedge subassembly 1057 (FIG. 57). More particularly, the lock member 1050 is seated in the receiver slot 1032. The shaft 1072 of the bolt 1070 is inserted through the slot 1030 and threadedly engages with the lock member bore 1060. The lock member 1050 is prevented from rotation with the bolt 1070 by the features 1068, 1033. The retainer member 1084 is installed in the slot 1079 to axially secure or limit the bolt 1070 relative to the wedge member 1020. The boss 1036 is captured axially between the retainer member 1084 and the bolt head 1074. In some embodiments, the body 1085 of the retainer member 1084 circumscribes the bolt by more than 180 degrees so that the retainer member 1084 is effectively clipped or locked onto the bolt 1070.

Figure 58:
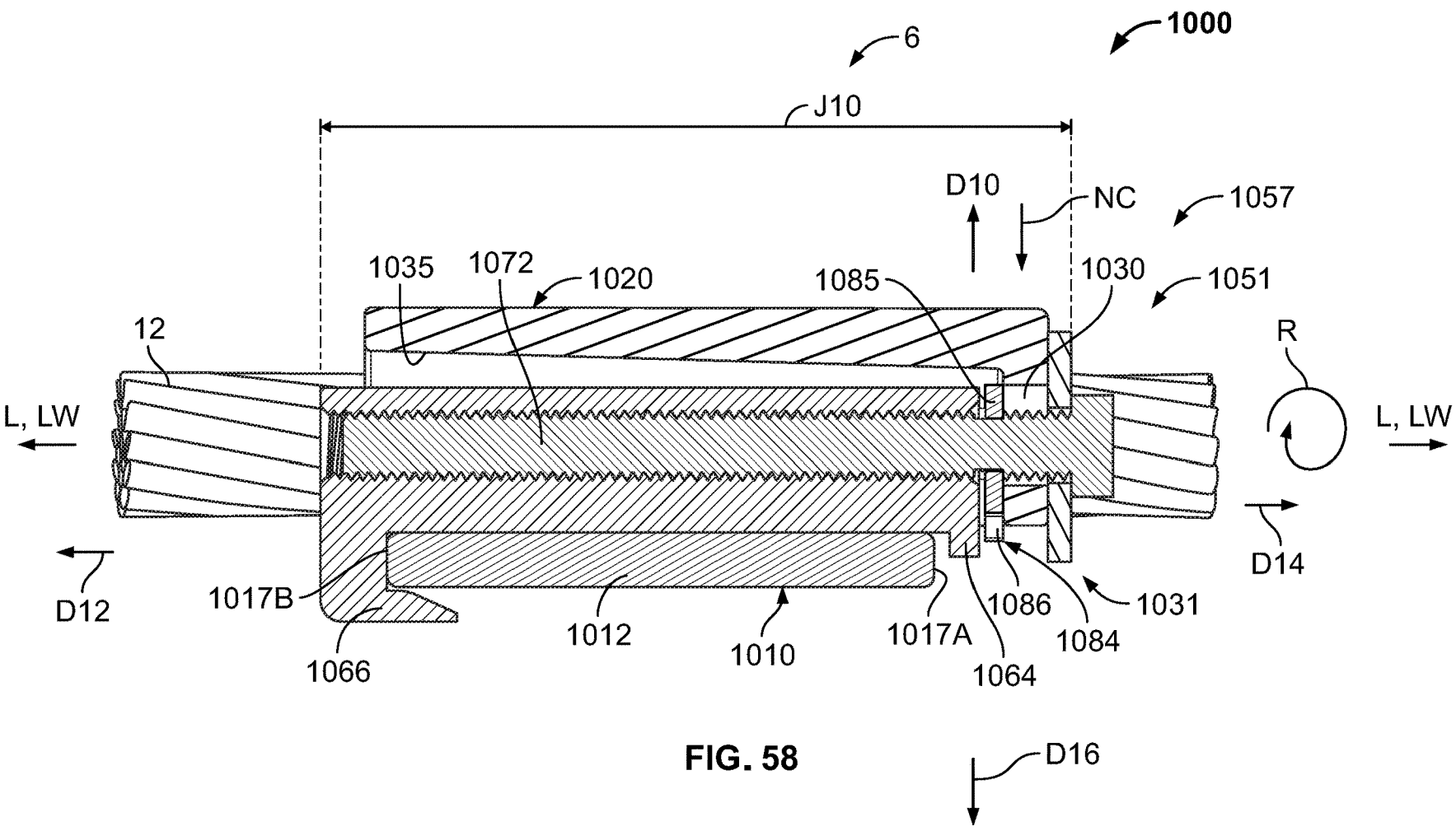

The drive bolt 1070 and the threaded bore 1060 operate as a clamping mechanism 1051 that can be operated to generate an installation drive force to force the wedge member 1020 into the sleeve member 1010 to form a connection 6 (FIG. 58).

The drive bolt 1070, the elongated slot 1030, the retainer member 1084, and the back wall surface 1035 operate as a securing mechanism 1031 that can be used to control the position of the lock member 1050 relative to the wedge member 1020. More particularly, the securing mechanism 1031 can be used to control lateral displacement or positioning of the lock member 1050 relative to the wedge member lengthwise axis LW-LW, as well as the tilt angle or orientation of the lock member 1050 relative to the axis LW-LW.

In some embodiments, the lock/wedge subassembly 1057 is assembled at the factory and provided to the end user or installer preassembled. In some embodiments, the lock/wedge subassembly 1057 is assembled prior to mounting the wedge member 1020 in the sleeve 1010.

However, in other embodiments, the lock/wedge subassembly 1057 is assembled by the end user and, in some embodiments, is assembled onsite at the location of the tap installation by the installer.

The lock/wedge subassembly 1057 can assume an open position (as shown in FIG. 57) wherein the lock member 1050 is extended and the front end 1050B of the lock member 1050 is spaced a relatively long distance from the head 1074 of the bolt 1070. This open distance is typically substantially greater than the partially closed distance J9 shown in FIG. 57. The lock/wedge subassembly 1057 can then assume a closed position (as shown in FIGS. 44 and 58) wherein the bolt 1070 is screwed further into the bore 1060 and the front end 1050B is spaced a distance J10 (FIG. 58) from the head 1074. The distance J10 is less than the fully open distance and the partially closed distance J9. In some embodiments, the fully open position distance is at least 50% greater than the fully installed or closed distance J10.

As shown in FIG. 44, the C-shaped sleeve member 1010 is placed over the conductor 14 such that the conductor 14 is received in the side channel 1014A. The conductor 12 is placed in the other side channel 1016A.

The lock/wedge subassembly 1057 is mounted on the sleeve member 1010 with the lock/wedge subassembly 1057 in the open position. More particularly, the bolt 1070 is pushed forward in the wedge member 1020 so that the front end 1050B of the lock member 1050 is extended a distance forward of the front end 1020B of the wedge member 1020.

The lock member 1050 is then inserted into the cavity 1015 of the sleeve member 1010 such that the hook portion 1066 is positioned in front of the leading edge 1017B and the body 1052 overlies the sleeve member connecting portion 1012.

The wedge member 1020 is then partially inserted into the cavity 1015 between the conductors 12, 14 such that the conductors 12, 14 are received in the opposed grooves 1024A, 1026A, shown in FIG. 57. The wedge member 1020 may then be forced forwardly (direction D15) into the sleeve member 1010 to temporarily hold or snug the wedge member 1020 and the conductors 12, 14 in position. The wedge member 1020 may be forced forward by hand or using a hammer or the like. This can enable the installer to execute the following installation steps without having to otherwise secure the wedge member 1020 in the sleeve member 1010. In some embodiments, this step is executed before the lock member 1050 has been seated on the sleeve member 1010 as described below. In other embodiments, this step is not executed until the lock member 1050 has been seated on the sleeve member 1010 as described above.

The more steeply tapered leading edge sections 1027L can assist the installer in more easily initially inserting the wedge member 1020 between the conductors 12, 14.

The lock/wedge subassembly 1057 or the bolt 1070 is then pulled rearward to seat the lock member 1050 on the sleeve member 1010 as shown in FIG. 58. In the seated position, the front edge 1017B is captured in the hook slot 1066, and the rear tab 1064 is located behind the rear edge 1017A as shown in FIG. 58.

This step of seating the lock member 1050 on the sleeve member 1010 is facilitated by the depthwise draft (angle A1, FIG. 49) of the back wall 1035 of the receiver slot 1032, the configuration of the slot 1030, and the configuration of the retainer member 1084.

As the lock member 1050 is slid rearward over the connecting portion 1012 of the sleeve member 1010, the lock member 1050 must be tilted or cocked in the depthwise plane (defined by the axes N-N and L-L) relative to the axis L-L because the rear tab 1064 engages the interior surface of the sleeve member section 1012. This tilting is enabled by the shape of the slot 1030.

Because the depthwise dimension J1 of the slot 1030 is greater than the outer diameter J14 of portion of the bolt 1070 therein, the bolt 1070 is permitted to shift, slide or translate in a displacement direction D10 along the depthwise axis N-N. More particularly, during the step of sliding the lock member 1050 into its seated position, the portion of the bolt 1070 in the slot 1030 slides or translates across the slot 1030 in an inward direction NR along the axis N-N (FIG. 57). This enables the lock member 1050 to tilt (as shown in FIG. 57) a distance and at an angle sufficient for the rear end 1050A to pass between the back wall surface 1032A and the sleeve member section 1012 until the rear tab 1064 drops (in direction D16; FIG. 58) over the rear edge 1017A of the sleeve member 1010.

When the rear tab 1064 drops over the rear edge 1017A, the bolt 1070 will slide back across the slot 1030 in the direction NC (FIG. 58) so that the bolt 1070 and the lock member 1050 are no longer tilted and are substantially parallel with the axis connector L-L and the wedge member axis LW-LW. However, in other embodiments, the bolt 1070 and the lock member 1050 remain somewhat tilted or angled relative to the axis L-L and the wedge member axis LW-LW, but at a lesser angle than angle A6.

According to some embodiments, the tilt angle A6 (FIG. 57) of the bolt 1070 (and the lock member 1050) relative to the wedge member lengthwise axis LW-LW in the range of from about 1 to 5 degrees.

The greater depth J3 of the receiver slot 1032 at the front end also eases the passage of the rear end 1050A of the lock member 1050 to its seated position. Nonetheless, the taper of the back wall surface 1035 also helps to ensure that the rear tab 1064 does not become dislodged after the connector assembly 1000 is assembled.

Thus, it will be appreciated that the configuration of the lock/wedge assembly 1057 permits the lock member 1050 to be laterally displaced (along depthwise axis N-N, and laterally with respect to the wedge member lengthwise axis LW-LW) relative to the wedge member 1020 into an open position (as shown in FIG. 57) to facilitate installation of the lock member 1050 onto the sleeve member 1010 into an assembled position (FIG. 58). Because the front end 1050B of the lock member 1050 is free or constrained by an interlock between the hook 1066 and the front edge 1017B, the lock member 1050 will tilt (angle A6) when laterally displaced at its rear end 1050A. This allows the lock member 1050 to both slide through across the sleeve member 1010 and hook onto the front edge 1017B.

The translation of the bolt 1070 across the slot 1030 is controlled by the securing mechanism 1031. The retainer member 1084 can selectively assume each of a securing position (as shown in FIGS. 56 and 58) and, alternatively, a release position (as shown in FIGS. 44, 55 and 57).

The retainer member 1084 is retained in its release position during the step of sliding the lock member 1050 into the slot 1032 in order to permit the bolt 1070 to slide in the slot 1030 to its laterally displaced or tilted position (i.e., the open position of the lock member 1050). The retainer member 1084 may be manually placed in the release position. Alternatively, the retainer member 1084 may automatically assume its release position. In this case, the retainer member 1084 will initially rotate clockwise with the bolt 1070 until it abuts the wedge member 1020. The bolt 1070 will then continue to rotate with respect to the retainer member 1084.

In the release position, the retainer member 1084 is angularly positioned such that its release side edge 1087B faces the back wall surface 1035.

Figure 55:
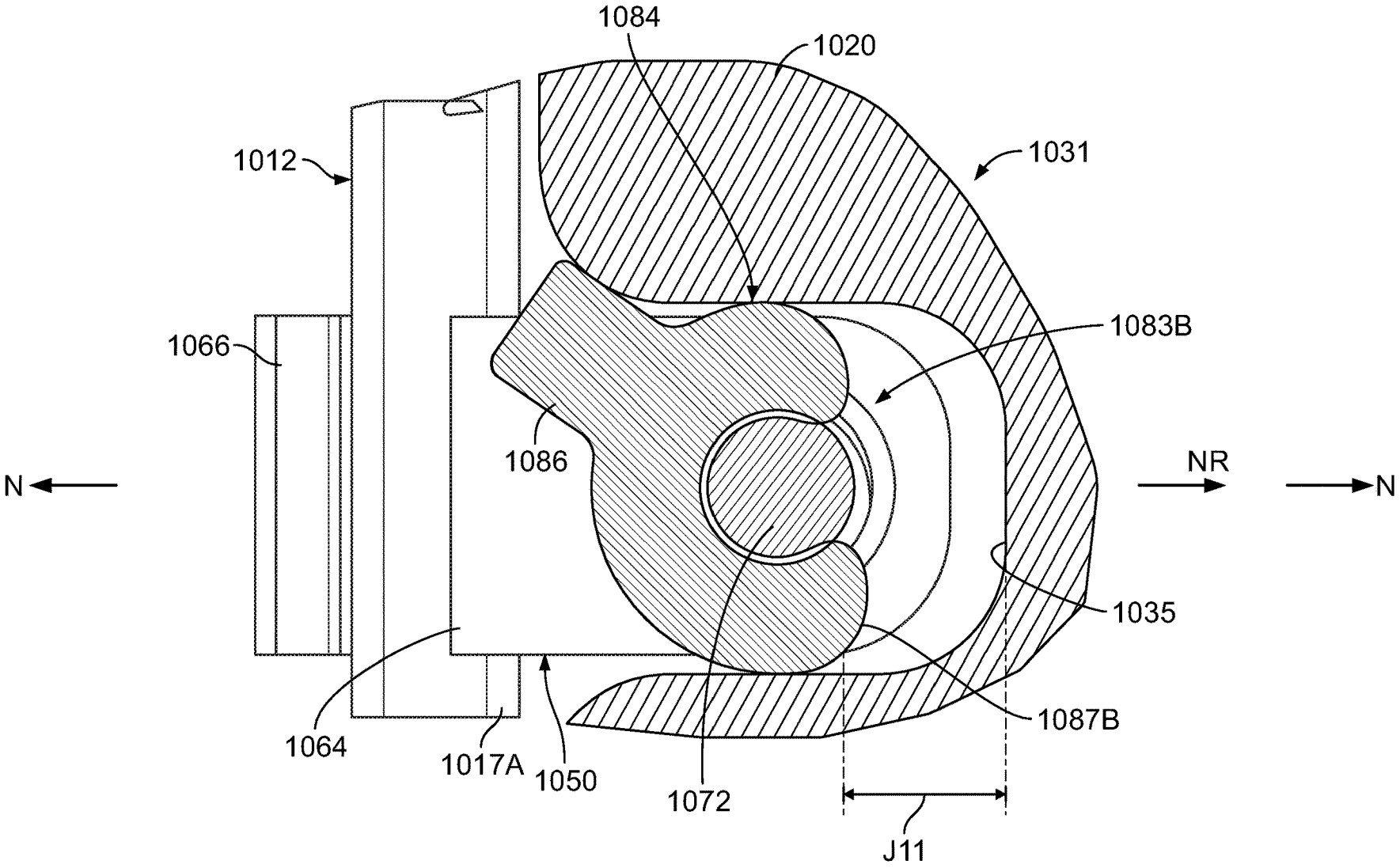
FIG. 55 is a cross-sectional view of the wedge connector assembly of FIG. 44 taken along the line 55-55 of FIG. 44.
Figure 56:
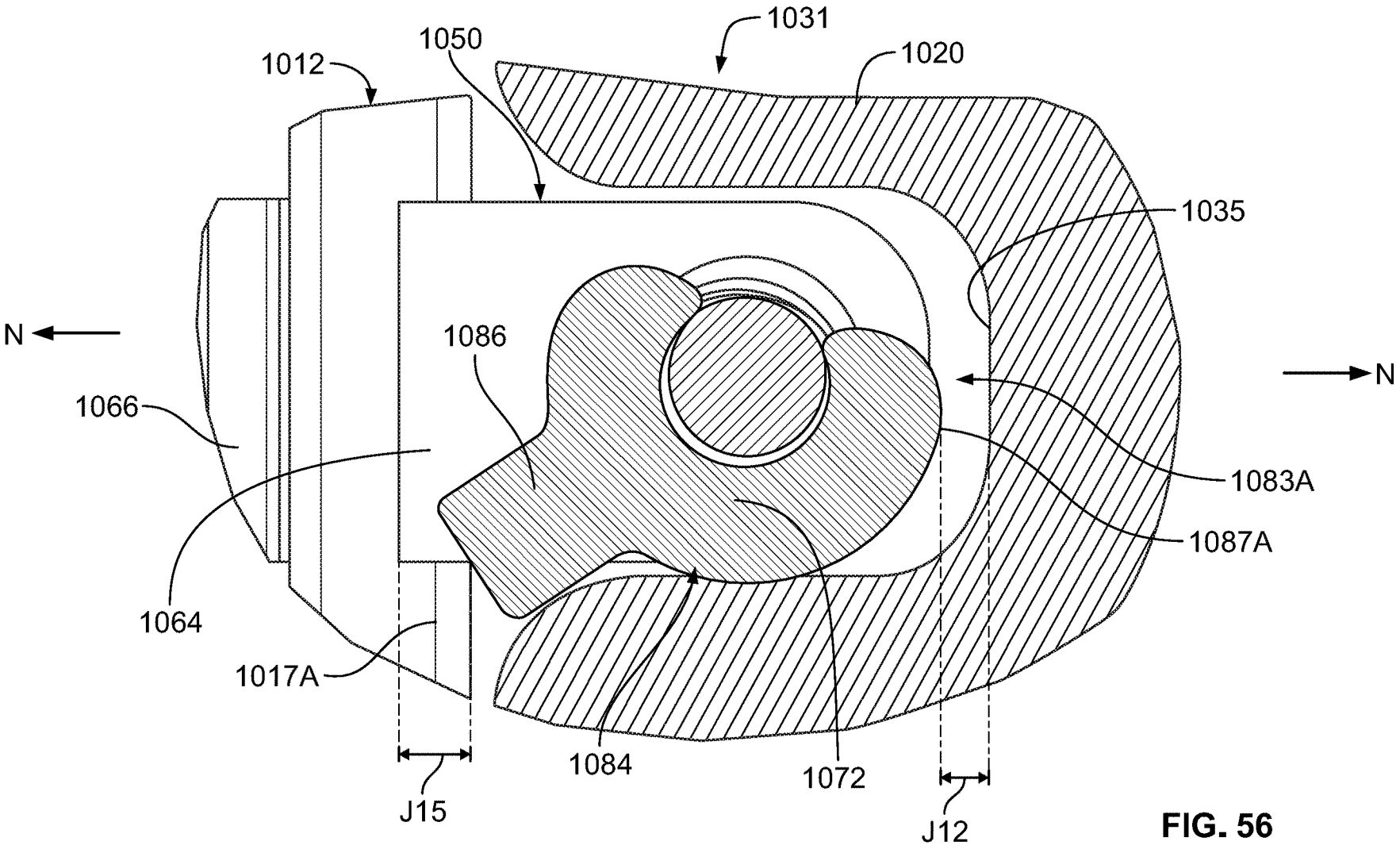
FIG. 56 is a cross-sectional view of the wedge connector assembly of FIG. 44 taken along the line 55-55 of FIG. 44 during a wedge member retraction procedure.

As will be appreciated from FIG. 55, when the retainer member 1084 is in its release position, this provides a relatively large gap distance ill between the retainer member 1084 and the back wall surface 1035. The large gap distance ill is sized to permit the bolt 1070 to slide a sufficient distance in direction D10 to assume a sufficient tilt angle A6 to prevent the rear tab 1064 from binding on the interior surface of the sleeve member section 1012.

The bolt 1070 is then rotated (e.g., by hand or using the tool 30 (FIG. 2) with the driver 32 engaging the head 1074) in a direction R relative to the lock member 1050. Advantageously, the head 1074 is accessible for engagement with the tool 30 (FIG. 2) from the rear side of the wedge member 1020. The integral anti-rotation features 1033, 1068 of the wedge member 1020 and the lock member 1050 mate and cooperate to prevent the lock member 1050 from rotating with the bolt 1070 and to prevent the hook portion 1066 from becoming misaligned with the edge 1017B. The rotation of the bolt 1070 axially translates the bolt 1070 into the lock member 1050, thereby drawing the head 1074 and the hook portion 1066 axially closer together. The wedge member 1020 and the lock member 1050 are thereby axially displaced and pulled together in opposed converging directions toward the closed position of the lock/wedge subassembly 1057 until the hook portion 1066 fits snugly against the front edge 1017B and the bolt head 1074 fits snugly against the rear end 1020A of the wedge member 1020. The wedge member 1020 abuts the conductors 12, 14 in the sleeve member 1010.

The driver 32 and tool 30 are used to further rotate the head 1074 in the direction R to forcibly rotate the bolt 1070 so that the wedge member 1020 is forced forwardly (direction D12; FIG. 58) relative to the sleeve member 1010. Because the lock member 1050 holds the sleeve member 1010 relative to the wedge member 1020, the wedge member 1020 is thereby driven deeper into the sleeve member 1010 in direction D12. This rotation step is executed until the wedge member 1020 is in a desired final position to form the connection 6 as shown in FIGS. 1 and 58, and the lock/wedge subassembly 1057 has assumed a closed position. The lock member 1050 and the bolt 1070 thus operate as a drive mechanism or clamping mechanism 1051 of the lock/wedge subassembly 1057. The connection 6 may be formed by forming interference fits between the wedge member 1020, the C-shaped sleeve member 1010 and the conductors 12, 14. Moreover, the wedge member 1020 may be secured in place by the interlocking engagement between the hook portion 1066 and the sleeve member 1010.

The wedge member 1020, the sleeve member 1010 and/or the conductors 12, 14 may be deformed. The C-shaped sleeve member 1010 may be elastically deformed so that it applies a bias or spring force against the wedge member 1020 and the conductors 12, 14. The sleeve member 1010 may be plastically deformed.

The double angled sections 1025L, 1025M (FIG. 51) of the wedge conductor channels 1024A, 1026A can help to reduce or prevent birdcaging of stranded conductors 12, 14, for example. The steeper taper angles A3 of the leading channel sections 1025L can prevent the wedge member 1020 from initially biting or pinching the conductors 12, 14. Such early pinching may tend to cause the strands to bunch up as the wedge member 1020 is forced axially into the sleeve member 1010. Instead, full compression on the conductors 12, 14 is delayed until the wedge member 1020 is further inserted and the main channel sections 1025M are in contact with the conductors 12, 14.

Once installed, the connector system 1001 can be operated as follows to disassemble the connection assembly 1000 in accordance with methods of the invention. The bolt 1070 is rotated opposite the direction R (i.e., counterclockwise) to force the wedge member 1020 to move axially rearwardly and away from the lock member 1050.

The drive bolt 1070, the wedge boss 1036, the lock member 1050 (including the rear tab 1064), the retainer slot 1079, and the retainer member 1084 operate as a retraction or removal mechanism 1081 that can be operated to remove the wedge member 1020 from the sleeve member 1010 to disassemble the connection 6.

The retainer member 1084 is located on front side of the wedge boss 1036, opposite the bolt head 1074. The retainer member 1084 permits the bolt 1070 to rotate about the bolt's lengthwise axis within and relative to the boss 1036, but limits relative rearward axial displacement of the bolt 1070 relative to the boss 1036. In this way, the retainer member 1084 prevents the bolt 1070 from moving rearwardly out of the boss 1036 beyond a relatively short prescribed distance.

Because the axial position of the retainer member 1084 on the bolt 1070 is fixed and the rear engagement portion 1064 prevents relative axial displacement between the lock member 1050 and the sleeve member 1010, the bolt rotation force is applied to the wedge member 1020 via the retainer member 1084 to displace the wedge member 1020 rearwardly (direction D14 in FIG. 58) relative to the sleeve member 1010. In this way, the sleeve member 1010 and the wedge member 1020 are freed from one another and the connection 6. The entirety of the lock/wedge subassembly 1057 can then be removed from the sleeve member 1010.

In order for the lock member 1050 to apply the load of the bolt 1070 to the sleeve member 1010 to push the sleeve member 1010 away, the rear tab 1064 should remain securely interlocked with the rear edge 1017A of the sleeve member 1010 to push the rear edge 1017A away from the boss 1036. Maintenance of this interlock is facilitated by the tapered configuration of the receiver slot 1032, the retainer member 1084, and operation of the securing mechanism 1031.

As seen in FIG. 49, the narrow rear depth dimension J4 of the receiver slot 1032 limits permitted displacement of the rear end of the lock member 1050 in the direction D10. In some embodiments, the permitted displacement of the lock member 1050 when the connection assembly 1000 is in its finally assembled configuration is too small to permit the rear tab 1064 to clear the rear edge 1017A.

The securing mechanism 1031 also operates to limit or prevent undesired displacement of the lock member 1050 during retraction of the wedge member 1020.

When the bolt 1070 is rotated counterclockwise, the retainer member 1084 will initially rotate with the bolt 1070 until the tab 1064 abuts the lock member 1050 and fixes the retainer member 1084 in its securing position (FIG. 56). The retainer member 1084 is thereby automatically repositioned into its securing position.

In the securing position, the securing side 1083A of the retainer member 1084 faces the back wall surface 1035. As a result, the retainer member 1084 limits the distance the bolt 1070 can slide in direction D10 in the slot 1030. This can prevent the lock member 1050 from being laterally displaced a distance great enough, or tilted at an angle large enough, to dislodge the rear tab 1064 from the rear edge 1017A even as the rear end 1050A of the lock member 1050 passes through the deeper portions of the receiver slot 1032. That is, the securing mechanism 1031, when positioned in its securing position (FIG. 56), prevents the lock member 1050 from moving (or being able to move) into its open position (FIG. 57). As a result, the securing mechanism 1031 maintains the rear tab 1064 in proper axial alignment with the rear edge 1017A of the sleeve member 1010 to abut and apply the removal drive force to the sleeve member 1010.

It will be appreciated that the permitted displacement distance ill (FIG. 55) of the bolt 1070 along the axis N-N in the slot 1030 when the retainer member 1084 is in the release position is greater than the corresponding displacement distance J12 (FIG. 56) when the retainer member 1084 is in the securing position. In some embodiments, the displacement distance ill is at least 0.14 inch more than the displacement distance J12.

In some embodiments, the permitted displacement distance J12 is less that the depthwise overlap distance J15 (FIG. 56) between the rear tab 1064 and the rear edge 1017A when the connector assembly 1000 is fully assembled with the bolt 1070 oriented parallel with the wedge member axis LW-LW.

In some embodiments, the displacement distance ill is in the range of from about 0.25 to 0.30 inch.

In some embodiments, the displacement distance J12 is less than 0.125 inch.

Figure 59:
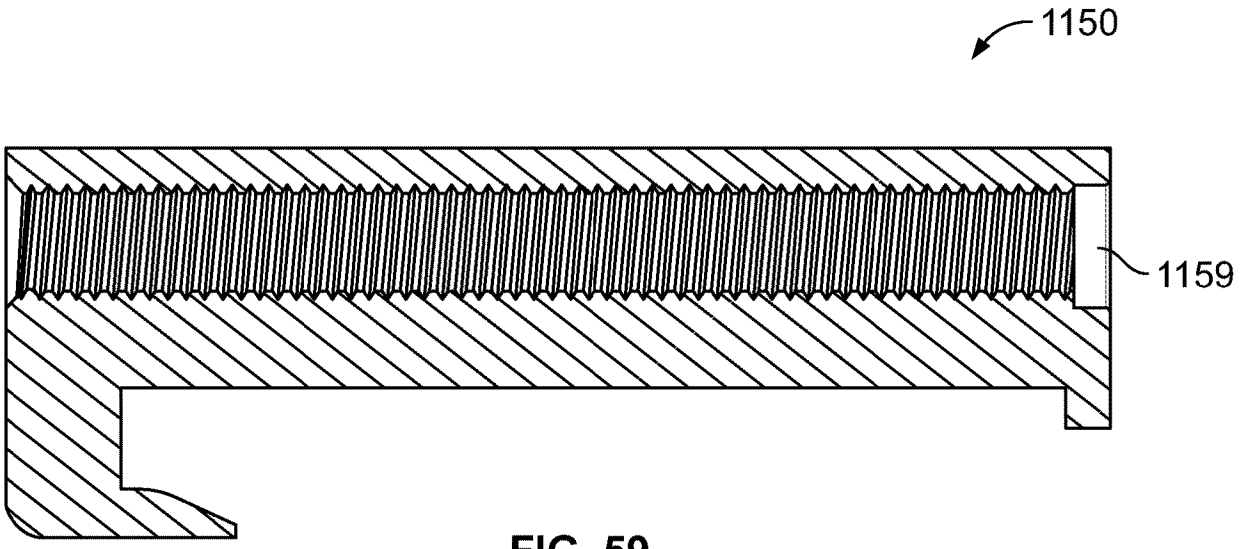
FIG. 59 is a cross-sectional view of an alternative lock member for use in the wedge connector system of FIG. 44.
Figure 60:
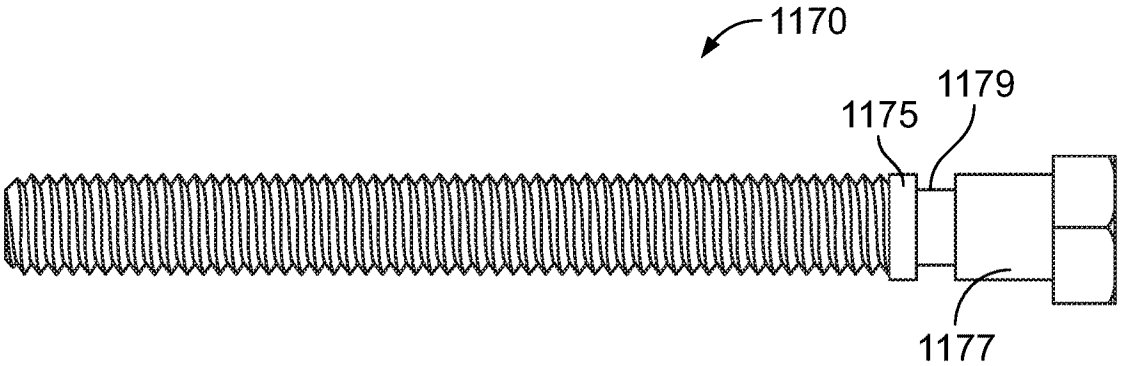
FIG. 60 is a side view of an alternative drive member for use in the wedge connector system of FIG. 44.

With reference to FIGS. 59 and 60, a drive bolt 1170 and a lock member 1150 according to further embodiments is shown therein. The bolt 1170 and the lock member 1150 may be used in the connector assembly 1000 in place of the bolt 1070 and the lock member 1050, respectively.

The bolt 1170 differs from the bolt 1070 in that the bolt 1170 is a shoulder bolt having a retainer mount groove 1179 defined between a rear shoulder 1177 and a front flange 1175. The lock member 1150 is modified to include a counterbore 1159 that receives the flange 1175.

The bolt 1170 and the lock member 1150 may be preferred over the bolt 1070 and the lock member 1050 in the case of smaller bolts, as may be employed for smaller sized connectors. In the case of smaller diameter bolts, the height of the thread may not be great enough to reliably support the retainer member 1084 during the wedge retraction procedure. Forming the retention groove more deeply into the bolt may unacceptably reduce its tensile strength.

Figure 62:
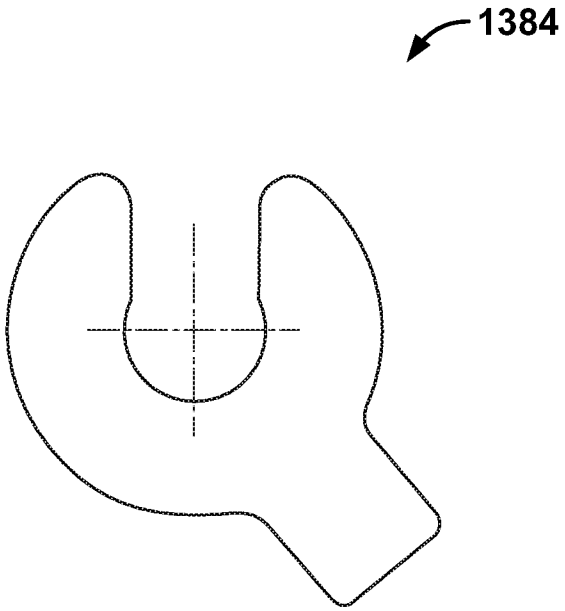
FIG. 62 is a front view of an alternative retainer member for use in the wedge connector system of FIG. 44.
Figure 61:
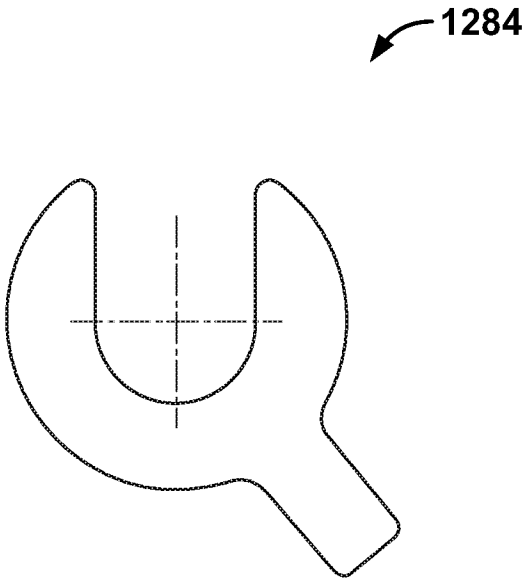
FIG. 61 is a front view of an alternative retainer member for use in the wedge connector system of FIG. 44.

With reference to FIGS. 61 and 62, retainer members 1284 and 1384 according to alternative embodiments are shown therein. The retainer members 1284, 1384 may be used in place of the retainer member 1084 in accordance with further embodiments. The retainer member 1284 is an open slide, non-interference fit design. The retainer marker 1384 is an interference fit (with bolt) design.

Lock members as described herein can be retained in the connection to serve as a lock mechanism that helps secure the wedge member in the sleeve member. The lock members can be retained in this manner until (if ever) the wedge member is removed from the sleeve member.

Alternatively, in some embodiments, the lock member can be removed from the wedge member and the sleeve member while leaving the wedge member and the sleeve member engaged and the connection intact. In this case, the lock member (and, in some embodiments, a lock/wedge subassembly) may be used only to force or clamp the wedge member into the sleeve member to form the connection, and not to perform a locking function thereafter.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A wedge connector system for connecting first and second elongate electrical conductors, the wedge connector system comprising:

- a C-shaped sleeve member defining a sleeve cavity and opposed first and second sleeve channels on either side of the sleeve cavity;
- a wedge member including a wedge body having first and second opposed wedge side walls, the wedge member having a wedge member lengthwise axis;
- a locking mechanism including:
  - a lock member including a sleeve engagement portion; and
  - a clamping mechanism coupled to the lock member; and
- a securing mechanism;
- wherein:
  - the sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall;
  - the locking mechanism is mounted on or configured to be mounted on the wedge member to collectively form a lock/wedge subassembly;
  - the lock/wedge subassembly is mountable on the sleeve member such that the sleeve engagement portion interlocks with the sleeve member and the clamping mechanism can be operated to force the wedge member into the sleeve cavity to apply clamping loads on the first and second conductors;
  - in the lock/wedge subassembly, the lock member is mounted on the wedge member to permit lateral displacement of the lock member relative to the wedge member into an open position to facilitate installation of the lock member onto the sleeve member; and
  - the securing mechanism is positionable into a securing position wherein the securing mechanism prevents the lock member from moving into the open position from an assembled position on the sleeve member.

2. The wedge connector system of claim 1 wherein:

the lock member is tilted at a first angle relative to the wedge member lengthwise axis when the lock member is in the open position;

the lock member is parallel with or tilted at a second angle relative to the wedge member lengthwise axis when the lock member is in the assembled position; and the first angle is greater than the second angle.

3. The wedge connector system of claim 1 wherein:

the wedge member includes an integral second sleeve engagement feature configured to transmit a removal force to the sleeve member to force the wedge member out of the sleeve member; and in the securing position, the securing mechanism maintains the second sleeve engagement feature in axial alignment with the sleeve member.

4. The wedge connector system of claim 1 wherein:

the wedge member includes an elongate slot through which a portion of the locking mechanism extends;

said portion of the locking mechanism is slidable along the elongate slot to displace the lock member into the open position; and the elongate slot has a slot lengthwise axis extending transverse to the wedge member lengthwise axis.

5. The wedge connector system of claim 4 wherein:

the wedge member has:

a heightwise axis extending transverse to the wedge member lengthwise axis and through the wedge side walls; and a depthwise axis extending transverse to the wedge member lengthwise axis and transverse to the heightwise axis; and the slot lengthwise axis is substantially parallel with the depthwise axis.

6. The wedge connector system of claim 4 wherein:

the clamping mechanism includes a threaded drive member; and the elongate slot slidably receives the threaded drive member.

7. The wedge connector system of claim 6 wherein:

the wedge member includes an integral boss;

the elongate slot is defined in the boss; and the integral boss is configured to transfer a drive force from the threaded drive member to the wedge member to force the wedge member into the sleeve cavity to apply the clamping loads on the first and second conductors.

8. The wedge connector system of claim 7 including a threaded bore on the lock member, wherein the threaded drive member threadedly engages the threaded bore.

9. The wedge connector system of claim 8 wherein:

the clamping mechanism includes a bolt having a head and a threaded shaft extending from the head;

the wedge member has opposed front and rear ends;

the front end leads the rear end as the wedge member is advanced into the sleeve cavity by the clamping mechanism; and the bolt head is accessible from the rear end of the wedge member to be engaged by a tool to rotate the bolt and thereby force the wedge member into the sleeve cavity.

10. The wedge connector system of claim 1 wherein:

the clamping mechanism includes a threaded drive member;

the wedge member includes an integral boss;

the threaded drive member extends through the boss;

the wedge connector system includes a retainer member mounted on the threaded drive member;

the integral boss is configured to transfer an installation drive force from the threaded drive member to the wedge member to force the wedge member into the sleeve cavity to apply the clamping loads on the first and second conductors; and the retainer member is configured to transfer a removal drive force from the threaded drive member to the wedge member to force the wedge member out of the sleeve cavity to remove the wedge member from the sleeve member.

11. The wedge connector system of claim 10 wherein:

the retainer member forms a part of the securing mechanism;

the securing mechanism is configured to be placed in a release position, wherein the securing mechanism permits the lock member to move into its open position, by putting the retainer member in a first position on the threaded drive member; and the securing mechanism is configured to be placed in its securing position by putting the retainer member in a second position on the threaded drive member different from the first position.

12. The wedge connector system of claim 11 wherein the first position of the retainer member is a first rotational position of the retainer member on the threaded drive member, and the second position of the retainer member is a second rotational position of the retainer member on the threaded drive member different from the first rotational position.

13. The wedge connector system of claim 1 wherein:

the wedge member has opposed front and rear ends;

the front end leads the rear end as the wedge member is advanced into the sleeve cavity by the clamping mechanism;

the wedge member includes an axially extending receiver slot;

the receiver slot includes a back wall surface that slopes inwardly in a rearward direction extending from the front end toward the rear end;

the lock member is received in the receiver slot; and the wedge connector system is configured to slide the lock member in the rearward direction relative to the wedge member during installation of the lock/wedge assembly on the sleeve member.

14. The wedge connector system of claim 1 wherein:

the wedge member has opposed front and rear ends;

the front end leads the rear end as the wedge member is advanced into the sleeve cavity in a forward direction by the clamping mechanism;

the wedge member includes first and second opposed wedge channels defined in the first and second wedge side walls, respectively; and each of the first and second wedge channels includes:

a main section proximate the rear end and disposed at a first angle relative to the wedge member lengthwise axis; and a leading section proximate the front end and disposed at a second angle relative to the wedge member lengthwise axis;

the second angles are greater than the first angles;

the main sections of the first and second wedge channels taper inwardly in the forward direction; and the leading sections of the first and second wedge channels taper inwardly in the forward direction.

15. The wedge connector system of claim 1 wherein:
the wedge member has opposed front and rear ends;
the front end leads the rear end as the wedge member is advanced into the sleeve cavity in a forward direction by the clamping mechanism;
the wedge member includes first and second opposed wedge outer side edges defined by the first and second wedge side walls, respectively; and
each of the first and second wedge outer side edges includes:
a main section proximate the rear end and disposed at a first angle relative to the wedge member lengthwise axis; and
a leading section proximate the front end and disposed at a second angle relative to the wedge member lengthwise axis;
the second angles are greater than the first angles;
the main sections of the first and second wedge outer side edges taper inwardly in the forward direction; and
the leading sections of the first and second wedge outer side edges taper inwardly in the forward direction.

16. The wedge connector system of claim 1 wherein the sleeve member is a resilient spring member that elastically deflects when the wedge member is forced into the sleeve cavity to apply the clamping loads on the first and second conductors.

17. The wedge connector system of claim 1 wherein the sleeve engagement portion includes a sleeve receiver slot configured to hold a front end of the sleeve member when the locking mechanism is mounted on the sleeve member.

18. The wedge connector system of claim 1 wherein the locking mechanism does not form a part of the sleeve member.

19. A method for connecting first and second elongate electrical conductors, the method comprising:
providing a wedge connector system including:
a C-shaped sleeve member defining a sleeve cavity and opposed first and second sleeve channels on either side of the sleeve cavity;
a wedge member including a wedge body having first and second opposed wedge side walls, the wedge member having a wedge member lengthwise axis;
a locking mechanism including:
a lock member including an sleeve engagement portion; and
a clamping mechanism coupled to the wedge member; and a securing mechanism;
wherein the locking mechanism is mounted on the wedge member to collectively form a lock/wedge subassembly;
mounting the lock/wedge subassembly on the sleeve member such that:
the first conductor is received in the first sleeve channel between the sleeve member and the first wedge side wall, and the second conductor is received in the second sleeve channel between the sleeve member and the second wedge side wall;
the lock member is laterally displaced relative to the wedge member into an open position to facilitate installation of the lock member onto the sleeve member; and
the sleeve engagement portion interlocks with the sleeve member;
operating the clamping mechanism to force the wedge member into the sleeve cavity to apply clamping loads on the first and second conductors; and
positioning the securing mechanism into a securing position wherein the securing mechanism prevents the lock member from moving into the open position from an assembled position on the sleeve member.

20. A wedge connector system for connecting first and second elongate electrical conductors, the wedge connector system comprising:
a C-shaped sleeve member defining a sleeve cavity and opposed first and second sleeve channels on either side of the sleeve cavity;
a wedge member including a wedge body having first and second opposed wedge side walls; and
a locking mechanism including:
a lock member including a sleeve engagement portion; and
a clamping mechanism coupled to the wedge member;
wherein:
the sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall;
the locking mechanism is mountable on the sleeve member and the wedge member such that the sleeve engagement portion interlocks with the sleeve member and the clamping mechanism can be operated to force the wedge member and the lock member to converge and thereby force the wedge member into the sleeve cavity to apply clamping loads on the first and second conductors;
the sleeve member includes a connecting portion between the first and second sleeve channels; and
the lock member includes a longitudinally extending body disposed between the connecting portion and the wedge member when the locking mechanism is mounted on the sleeve member.

21. A wedge connector system for connecting first and second elongate electrical conductors, the wedge connector system comprising:
a C-shaped sleeve member defining a sleeve cavity and opposed first and second sleeve channels on either side of the sleeve cavity;
a wedge member including a wedge body having first and second opposed wedge side walls; and
a locking mechanism including:
a lock member including a sleeve engagement portion; and
a clamping mechanism coupled to the wedge member;
wherein:
the sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall;
the locking mechanism is mountable on the sleeve member and the wedge member such that the sleeve engagement portion interlocks with the sleeve member and the clamping mechanism can be operated to force the wedge member and the lock member to converge and thereby force the wedge member into the sleeve cavity to apply clamping loads on the first and second conductors; and the sleeve engagement portion includes a sleeve receiver slot configured to hold a front end of the sleeve member when the locking mechanism is mounted on the sleeve member.

22. The wedge connector system of claim 21 wherein:

the wedge member includes first and second opposed wedge channels defined in the first and second wedge side walls, respectively; and the sleeve member and the wedge member are configured to capture the first and second conductors such that the first conductor is received in the first sleeve channel between the sleeve member and the first wedge side channel and the second conductor is received in the second sleeve channel between the sleeve member and the second wedge channel.

23. A wedge connector system for connecting first and second elongate electrical conductors, the wedge connector system comprising:

a C-shaped sleeve member defining a sleeve cavity and opposed first and second sleeve channels on either side of the sleeve cavity;

a wedge member including a wedge body having first and second opposed wedge side walls; and a locking mechanism including:

a lock member including a sleeve engagement portion; and a clamping mechanism coupled to the wedge member;

wherein:

the sleeve member and the wedge member are configured to capture the first and second conductors such that the first conductor is received in the first sleeve channel between the sleeve member and the first wedge side wall and the second conductor is received in the second sleeve channel between the sleeve member and the second wedge side wall;

the locking mechanism is mountable on the sleeve member and the wedge member such that the sleeve engagement portion interlocks with the sleeve member and the clamping mechanism can be operated to force the wedge member and the lock member to converge and thereby force the wedge member into the sleeve cavity to apply clamping loads on the first and second conductors; and wherein:

the clamping mechanism includes a threaded drive member;

the wedge member includes an integral boss;

the threaded drive member extends through the boss;

the wedge connector system includes a retainer member mounted on the threaded drive member;

the integral boss is configured to transfer an installation drive force from the threaded drive member to the wedge member to force the wedge member into the sleeve cavity to apply the clamping loads on the first and second conductors; and the retainer member is configured to transfer a removal drive force from the threaded drive member to the wedge member to force the wedge member out of the sleeve cavity to remove the wedge member from the sleeve member.

* * * * *